US012768093B2

(12) United States Patent
Park et al.

(10) Patent No.: US 12,768,093 B2
(45) Date of Patent: Oct. 20, 2026

(54) WASHING MACHINE

(71) Applicant: SAMSUNG ELECTRONICS CO., LTD., Suwon-si (KR)

(72) Inventors: Jaeryong Park, Suwon-si (KR); Dongpil Seo, Suwon-si (KR); Kanghyun Lee, Suwon-si (KR); Youngjin Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 136 days.

(21) Appl. No.: 18/952,051

(22) Filed: Nov. 19, 2024

(65) Prior Publication Data

US 2025/0075402 A1 Mar. 6, 2025

Related U.S. Application Data

(63) Continuation of application No. PCT/KR2023/007015, filed on May 23, 2023.

(30) Foreign Application Priority Data

Jun. 28, 2022 (KR) ..... 10-2022-0079293
Jul. 27, 2022 (KR) ..... 10-2022-0093491
Oct. 11, 2022 (KR) ..... 10-2022-0130085

(51) Int. Cl.
*D06F 39/02* (2006.01)
*D06F 39/08* (2006.01)
(Continued)

(52) U.S. Cl.
CPC ..... *D06F 39/028* (2013.01); *D06F 39/083* (2013.01); *D06F 39/10* (2013.01); *D06F 39/12* (2013.01)

(58) Field of Classification Search
None
See application file for complete search history.

(56) References Cited

U.S. PATENT DOCUMENTS 6,267,879 B1 7/2001 Gil
11,066,771 B2 7/2021 Zarcone et al.
(Continued)

FOREIGN PATENT DOCUMENTS

CN 103917710 B 3/2017
CN 215856820 U 2/2022
(Continued)

OTHER PUBLICATIONS

Google Scholar search (Year: 2026).*
(Continued)

*Primary Examiner* — Rita P Adhlakha
(74) *Attorney, Agent, or Firm* — STAAS & HALSEY LLP

(57) ABSTRACT

A washing machine may include: a housing; a tub inside the housing; a drawer case in the housing and including an inlet and outlet through which water is flowable; a drawer insertable into, and withdrawable from, the drawer case, and configured to receive a detergent; a filter detachably mountable in the drawer and configured so that, with the filter mounted in the drawer and the drawer inserted into the drawer case, water that flows into the drawer case through the inlet passes through the filter and then flows out through the outlet; a circulation pipe to guide, to the tub, water that flows out of the outlet; a drain pipe to guide, to an outside of the housing, water that flows out of the outlet; and a flow path switching device configured to flow the water that flows out of the drawer case into the circulation and/or drain pipe.

15 Claims, 46 Drawing Sheets

(51) Int. Cl.
*D06F 39/10* (2006.01)
*D06F 39/12* (2006.01)

(56) References Cited

U.S. PATENT DOCUMENTS

| | | | |
|---|---|---|---|
| 11,261,558 | B2 | 3/2022 | Eiselt et al. |
| 2022/0145517 | A1 | 5/2022 | Schaumann et al. |

FOREIGN PATENT DOCUMENTS

| | | | |
|---|---|---|---|
| EP | 0 597 513 | A1 | 5/1994 |
| EP | 2 994 564 | B1 | 8/2018 |
| JP | 2008-104541 | A | 5/2008 |
| JP | 2015-44026 | A | 3/2015 |
| JP | 2018-143524 | A | 9/2018 |
| JP | 6936593 | B2 | 9/2021 |
| KR | 10-2004-0021942 | | 3/2004 |
| KR | 10-2011-0004754 | A | 1/2011 |
| KR | 10-2020-0070255 | A | 6/2020 |
| KR | 10-2020-0070278 | A | 6/2020 |
| KR | 10-2021-0071824 | A | 6/2021 |
| KR | 10-2021-0125178 | A | 10/2021 |
| KR | 10-2022-0061888 | A | 5/2022 |
| WO | WO 2020/251512 | A2 | 12/2020 |
| WO | WO 2020/251513 | A2 | 12/2020 |
| WO | WO 2022/025849 | A1 | 2/2022 |

OTHER PUBLICATIONS

Park B, Yoon H-J, Park H. Development and Efficiency Evaluation of Microplastic Removal Filter for Laundry Machines. Water. 2025; 17(3):358. https://doi.org/10.3390/w17030358 (Year: 2026).*

Brodin, Malin, et al. "Filters for washing machines: Mitigation of microplastic pollution." (2018). (Year: 2026).*

International Search Report dated Sep. 15, 2023 for International Application No. PCT/KR2023/007015.

Extended European Search Report dated Aug. 5, 2025 for European Application No. 23831736.6.

* cited by examiner

WASHING MACHINE

CROSS-REFERENCE TO RELATED APPLICATIONS

This is a continuation application, under 35 U.S.C. § 111 (a), of International Application PCT/KR2023/007015, filed May 23, 2023, which claims priority under 35 U.S.C. § 119 to Korean Patent Application No. 10-2022-0079293, filed Jun. 28, 2022, Korean Patent Application No. 10-2022-0093491, filed Jul. 27, 2022, and Korean Patent Application No. 10-2022-0130085, filed Oct. 11, 2022 in the Korean Intellectual Property Office, the disclosures of which are incorporated herein in their entireties by reference.

TECHNICAL FIELD

The present disclosure relates to a washing machine having a filter.

BACKGROUND ART

A washing machine is a home appliance for washing clothes, towels, bedding, etc. Washing machines may be classified into a drum-type washing machine washing laundry by rotating a drum to repeatedly raise and drop the laundry and an electric washing machine washing laundry using a water current occurred by a pulsator when a drum rotates.

A washing machine may circulate washing water in a tub in a process of supplying the washing water to the tub to wash or rinse laundry. The washing machine may drain the washing water in the tub to the outside in a process of discharging the washing water from the tub and removing moisture from the laundry.

DISCLOSURE

Technical Problem

The present disclosure is directed to providing a washing machine having a filter for filtering washing water.

The present disclosure is directed to providing a washing machine capable of circulating or draining filtered washing water.

The present disclosure is directed to providing a washing machine having an easy-to-maintain filter.

The present disclosure is directed to providing a washing machine having an easy-to-clean and/or to-replace filter.

The present disclosure is directed to providing a washing machine with increased space utilization.

Technical tasks to be achieved in this document are not limited to the technical task mentioned above, and other technical tasks not mentioned will be clearly understood by those skilled in the art from the description below.

Technical Solution

An aspect of the present disclosure includes a washing machine including a housing: a tub inside the housing: a drawer case in the housing and including an inlet portion through which washing water is flowable into the drawer case and an outlet portion through which the washing water is flowable out of the drawer case; a drawer insertable into, and withdrawable from, the drawer case, and configured to receive a detergent to be supplied to the tub: a filter detachably mountable in the drawer and configured so that, with the filter mounted in the drawer and the drawer inserted into the drawer case, the washing water that flows into the drawer case through the inlet portion passes through the filter so as to be filtered by the filter and then flows out of the drawer case through the outlet portion: a circulation pipe to guide, to the tub, washing water that flows out of the drawer case through the outlet portion: a drain pipe to guide, to an outside of the housing, washing water that flows out of the drawer case through the outlet portion and a flow path switching device to flow the washing water that flows out of the drawer case through the outlet portion into at least one of the circulation pipe and the drain pipe.

The washing machine may further include a pump device to pump washing water from the tub to the inlet portion of the drawer case.

With the filter mounted in the drawer, the filter may be insertable into, and withdrawable from, the drawer case.

The filter may include a first filter port to allow washing water that is filtered by the filter to flow out of the filter toward the circulation pipe, and a second filter port to allow washing water that is filtered by the filter to flow out toward the drain pipe.

The flow path switching device may include a valve configured to open and close the first filter port, and the washing machine may further include a controller configured to control the valve to close the first filter port in a draining process.

The valve may be a first valve, the flow path switching device may further include a second valve configured to open and close the second filter port, and the controller may be configured control the second valve to open the second filter port in the draining process.

The circulation pipe may be positioned lower than the drain pipe, the flow path switching device may include a valve configured to open and close the circulation pipe, and the washing machine may further include a controller configured to control the valve to close the circulation pipe in a draining process.

The flow path switching device may include a first valve configured to open and close the circulation pipe; and a second valve configured to open and close the drain pipe, and the washing machine may further include a controller configured to control, in a draining process, the first valve to close the circulation pipe, and the second valve to open the drain pipe.

The washing machine may further include a main pipe extending from the outlet portion, wherein the circulation pipe and the drain pipe may be branched from the main pipe at a branch point, and the flow path switching device may be at the branch point.

The drawer may include a detergent receiving portion configured to receive the detergent, and a filter mounting portion configured so that the filter may be detachably mountable therein, and that may be arranged to be parallel to the detergent receiving portion.

The drawer may include a first detergent receiving portion configured to receive a first detergent to be supplied to the tub in a washing process, a second detergent receiving portion configured to receive a second detergent to be supplied to the tub in a rinsing process, and a filter mounting portion configured so that the filter may be detachably mountable therein, and that is between the first detergent receiving portion and the second detergent receiving portion.

The filter may form a collection space therein, and the collection space may be configured to collect foreign substances contained in the washing water as the washing water passes through the filter from an inside of the filter to an outside of the filter.

The washing water that passes through the filter may flow between the drawer and the drawer case and then flow out of the drawer case through the outlet portion.

The drawer case may be inclined downward toward the outlet portion to guide the washing water that flows between the drawer and the drawer case to the outlet portion.

The drawer may further include a detergent receiving portion configured to receive the detergent, and the washing machine may further include a detergent pump at a rear of the drawer case and that is configured to pump the detergent received in the detergent receiving portion to the drawer case.

An aspect of the present disclosure provides a washing machine including a housing, a tub provided inside the housing, a pump device provided to pump washing water in the tub, and a detergent supply device provided to supply a detergent to the tub and including a filter provided to filter washing water delivered from the pump device. The washing machine may include a connection pipe provided to connect the pump device and the detergent supply device, a circulation pipe provided to connect the detergent supply device and the tub, and a drain pipe provided to connect the detergent supply device and the outside of the housing. The washing machine may include a flow path switching device provided to allow washing water flowed out from the detergent supply device to flow into the circulation pipe or to allow the washing water flowed out from the detergent supply device to flow into the drain pipe.

The detergent supply device may include a drawer including a detergent receiving portion provided to be capable of receiving the detergent and a filter mounting portion provided to be partitioned from the detergent receiving portion so that the filter is detachably mounted therein, and a drawer case provided to be capable of accommodating the drawer. The drawer case may include an outlet portion formed at a bottom of the drawer case. The outlet portion may be connected to the circulation pipe to supply at least one of the detergent received in the drawer and washing water passed through the filter to the tub.

The filter may include a first filter port provided to be capable of communicating with the circulation pipe and to allow filtered washing water to flow out. The filter may include a second filter port provided to be capable of communicating with the drain pipe and to allow the filtered washing water to flow out.

The first filter port may be positioned lower than the second filter port. The flow path switching device may include a valve provided to open and close the first filter port.

The pump may include a circulation pump and a drainage pump. The washing machine may further include a controller configured to control the valve to close the valve based on an operation of the drainage pump.

Advantageous Effects

According to the present disclosure, a washing machine can effectively collect foreign substances contained in washing water.

According to the present disclosure, the washing machine can circulate or drain washing water passed through a filter.

According to the present disclosure, maintenance of the filter can be facilitated.

According to the present disclosure, cleaning and/or replacement of the filter can be facilitated.

According to the present disclosure, space utilization of the washing machine can be increased.

Effects obtainable from the present disclosure are not limited to the effects mentioned above, and other effects not mentioned will be clearly understood by those skilled in the art from the description below.

MODE OF THE DISCLOSURE

Figure 1:
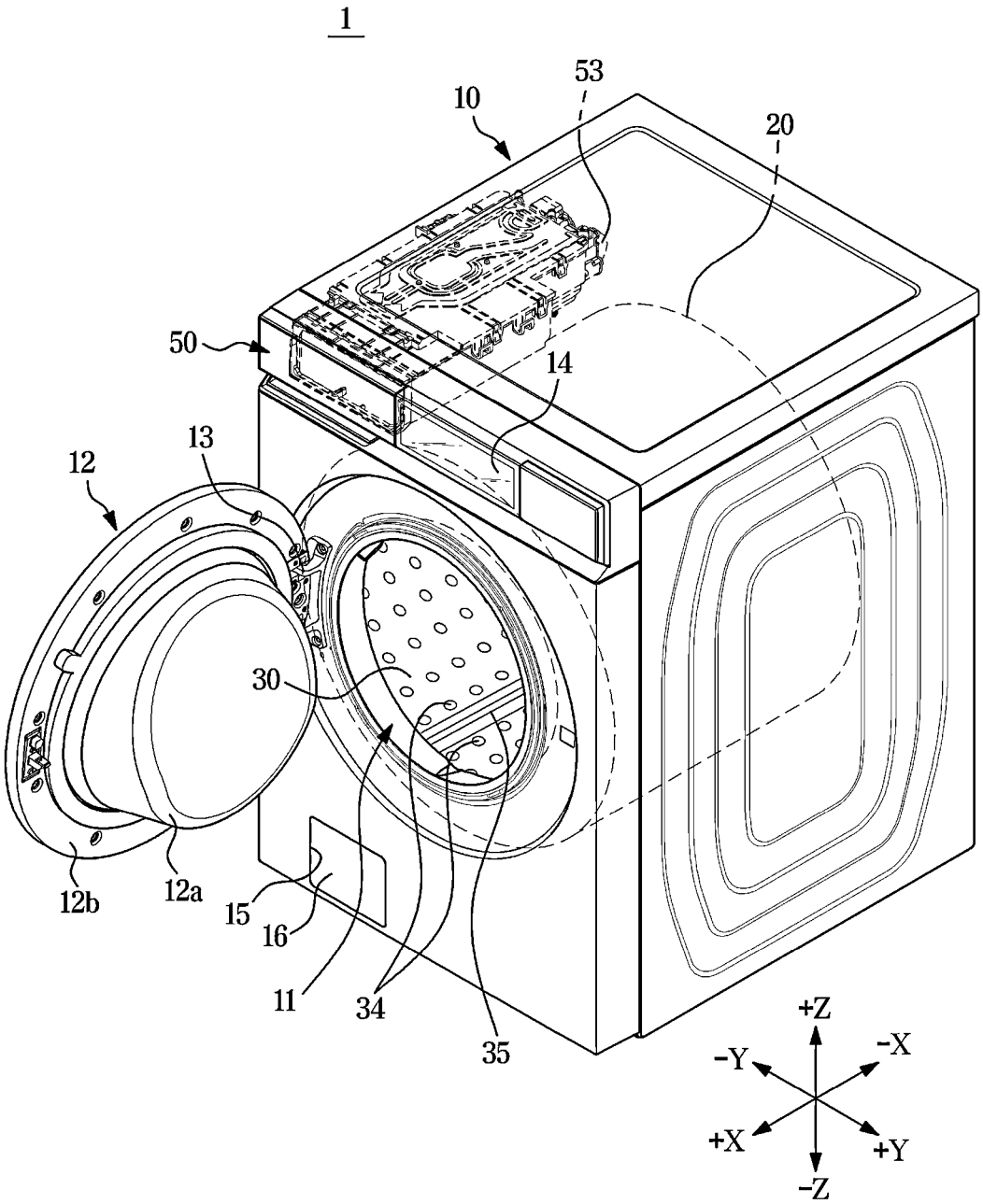
FIG. 1 is a perspective view of an example of a washing machine according to one embodiment.

Various embodiments and terms in this document are not intended to limit the technical features described in this document to specific embodiments, and should be understood to include various modifications, equivalents, or substitutes of the embodiments.

In connection with the description of the drawings, like reference numbers may be used for like or related components.

The singular form of a noun corresponding to an item may include one item or a plurality of items, unless the relevant context clearly dictates otherwise.

In this document, each of phrases such as "A or B," "at least one of A and B," "at least one of A or B," "A, B or C," "at least one of A, B and C," and "at least one of A, B, or C" may include any one of the items listed together in the corresponding one of the phrases, or all possible combinations thereof.

The term "and/or" includes any combination of a plurality of related components or any one of a plurality of related components.

Terms such as "first," "second," "primary," and "secondary" may simply be used to distinguish a given component from other corresponding components, and do not limit the corresponding components in any other aspect (e.g., importance or order).

When any (e.g., a first) component is referred to as being "coupled" or "connected" to another (e.g., a second) component with or without the terms "functionally" or "communicatively", this means that the any component may be connected to the other component directly (e.g., by a wire), wirelessly, or through a third component.

The terms "comprises," "has," and the like are intended to indicate that there are features, numbers, steps, operations, components, parts, or combinations thereof described in this document, and do not exclude the presence or addition of one or more other features, numbers, steps, operations, components, parts, or combinations thereof.

When any component is referred to as being "connected," "coupled," "supported" or "in contact" with another component, this includes a case in which the components are indirectly connected, coupled, supported, or in contact with each other through a third component as well as directly connected, coupled, supported, or in contact with each other.

When any component is referred to as being located "on" or "over" another component, this includes not only a case in which any component is in contact with another component but also a case in which another component is present between the two components.

A washing machine according to various embodiments may be an example of a clothes treating apparatus.

Washing machines according to various embodiments may include a top-loading washing machine in which a laundry inlet for putting in or taking out laundry is provided to face the top or a front-loading washing machine in which a laundry inlet for putting in or taking out laundry is provided to face the front. A washing machine according to various embodiments may include a washing machine of another loading method other than a top-loading washing machine and a front-loading washing machine.

In the case of a top-loading washing machine, laundry may be washed using a water current occurred by a rotating body such as a pulsator. In the case of a front-loading washing machine, laundry may be washed by rotating a drum to repeatedly raise and drop the laundry. In the case of a front-loading washing machine, lifters may be provided to raise laundry. Washing machines according to various embodiments may include washing machines of other washing methods other than the washing methods described above.

The terms "front-rear direction," "forward," "rearward," "left-right direction," "right," "left," "up-down direction," "upward," "downward," etc., used in the following description are defined with reference to the drawings, and the shape and position of each component are not limited by these terms. For example, a +X direction may be defined as forward, and a −X direction may be defined as rearward. For example, a +Y direction may be defined as right, and a −Y direction may be defined as left. For example, a +Z direction may be defined as upward, and a −Z direction may be defined as downward.

Hereinafter, embodiments according to the present disclosure are described in detail with reference to the accompanying drawings.

Figure 2:
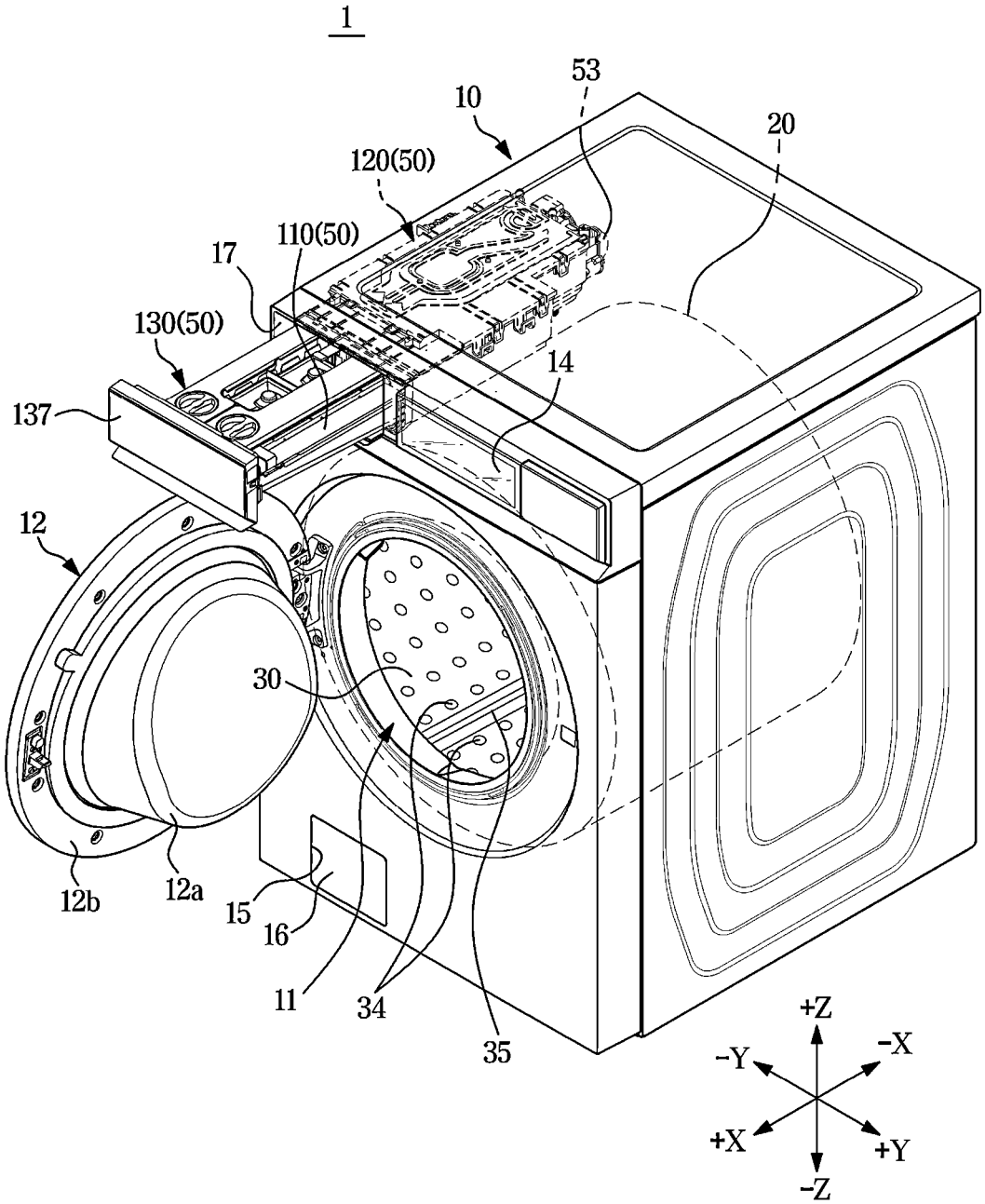
FIG. 2 is a schematic drawing illustrating an example of a state in which a drawer of a detergent supply device illustrated in FIG. 1 is withdrawn.
Figure 3:
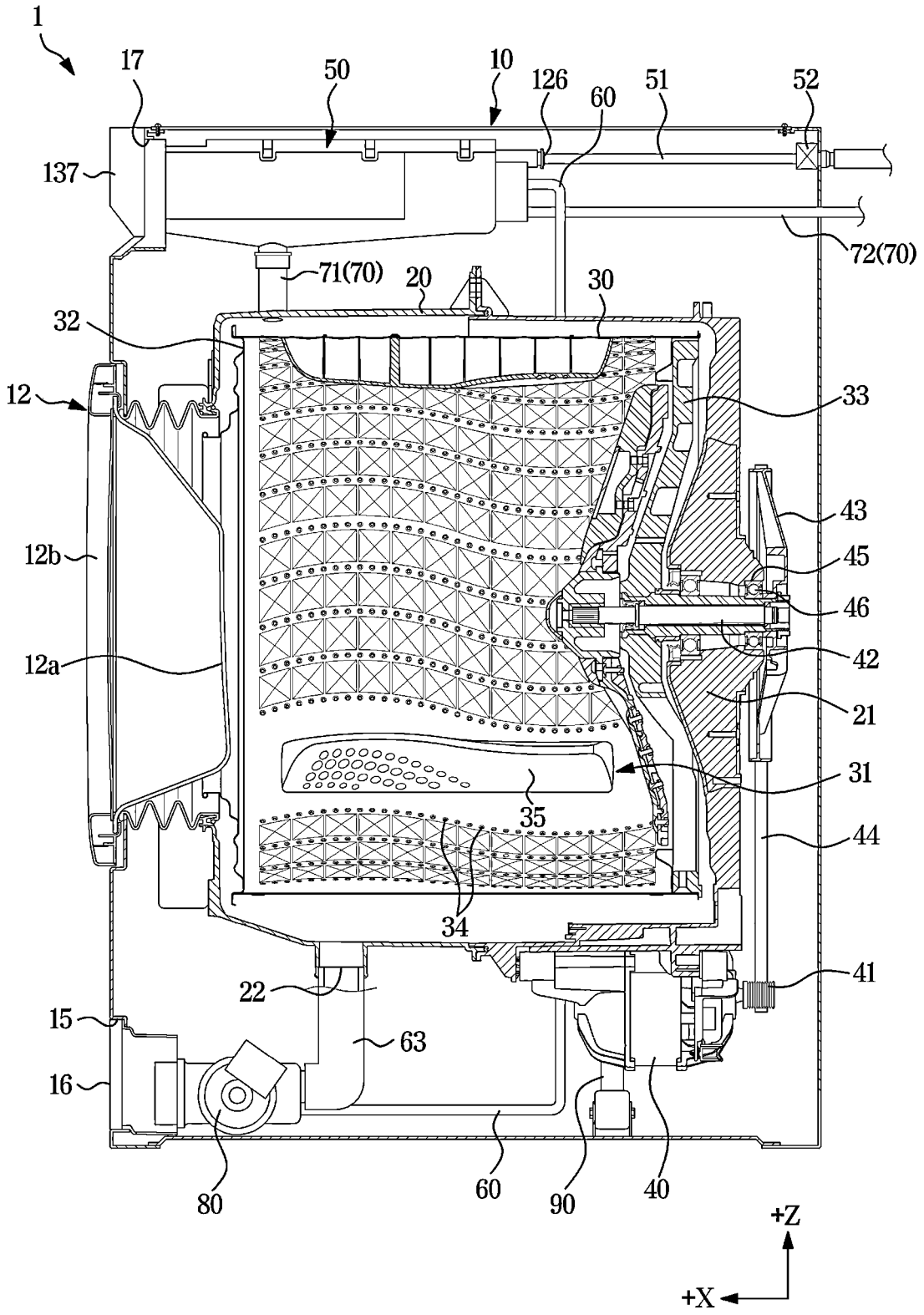
FIG. 3 is a cross-sectional view of an example of the washing machine according to one embodiment.

FIG. 1 is a perspective view of an example of a washing machine according to one embodiment. FIG. 2 is a schematic drawing illustrating an example of a state in which a drawer of a detergent supply device illustrated in FIG. 1 is withdrawn. FIG. 3 is a cross-sectional view of an example of the washing machine according to Referring to FIGS. 1 to 3, a washing machine 1 may include a housing 10.

The washing machine 1 may include a tub 20 disposed inside the housing 10. The washing machine 1 may include a drum 30 disposed inside the tub 20. The washing machine 1 may include a driving motor 40 provided to drive the drum 30.

The housing 10 may be provided to form an exterior of the washing machine 1. The housing 10 may accommodate components of the washing machine 1. For example, the housing 10 may be provided to have a substantially box shape.

The washing machine 1 may include a laundry inlet 11. The housing 10 may include the laundry inlet 11. The laundry inlet 11 may be provided to allow laundry (e.g., clothes, towels, bedding, etc.) to be put into or taken out of the inside of the drum 30. The laundry inlet 11 may be formed at the front of the housing 10. The laundry inlet 11 may be provided to be open toward the front. However, the laundry inlet 11 is not limited thereto, and may be formed on an upper side of the housing 10 in the case of a top-loading washing machine. In this case, the laundry inlet 11 may be provided to be open toward the upper side of the housing 10. A shape and/or position of the laundry inlet 11 may vary depending on the type of washing machine.

The washing machine 1 may include a door 12. The door 12 may be provided to open and close the laundry inlet 11. The door 12 may be rotatably installed in the housing 10. For example, the door 12 may be provided to rotate by a hinge 13.

For example, the door 12 may include a door glass 12*a* provided to allow a user to check the inside of the drum 30. For example, the door glass 12*a* may include a transparent tempered glass material. For example, the door 12 may include a door frame 12*b* provided to support the door glass 12*a*.

The tub 20 may be disposed inside the housing 10. The tub 20 may be provided to capable of receiving washing water. The tub 20 may be provided to store washing water. An opening for loading laundry may be formed at the front of the tub 20. The opening of the tub 20 may correspond to the laundry inlet 11. For example, the tub 20 may have a substantially cylindrical shape.

The washing machine 1 may include a damper 90. The tub 20 may be supported in the housing 10 by the damper 90. For example, the damper 90 may connect an inner bottom surface of the housing 10 and an outer surface of the tub 20. Vibration occurring in tub 20 may be reduced by the damper 90. Noise occurring in tub 20 may be reduced by the damper 90. Impact occurring in the tub 20 may be reduced by the damper 90.

The washing machine 1 may include a detergent supply device 50. The detergent supply device 50 may be provided to supply the detergent to the tub 20. The detergent supply device 50 may be provided to accommodate the detergent. For example, the detergent supply device 50 may accommodate liquid detergent, powder detergent, fabric softener, rinse, bleach, etc. The type of detergent is not limited, as long as the detergent received in the detergent supply device 50 is for washing laundry.

The detergent supply device 50 may be accommodated inside the housing 10. The detergent supply device 50 may be provided in a space formed between the housing 10 and the tub 20. The detergent supply device 50 may be provided in a space formed between an inner side of the housing 10 and an outer side of the tub 20.

For example, referring to FIGS. 1 and 2, the detergent supply device 50 may be provided between the housing 10 and an upper left portion of the tub 20. However, it is not limited to the example illustrated in the drawings. For example, the detergent supply device 50 may be provided between the housing 10 and an upper right portion of the tub 20. For example, the detergent supply device 50 may be provided between the housing 10 and a lower left portion of the tub 20. For example, the detergent supply device 50 may be provided between the housing 10 and a lower right portion of the tub 20. The position of the detergent supply device 50 is not limited, as long as the detergent supply device 50 may be provided not to interfere with other components of the washing machine 1 inside the housing 10.

The detergent supply device 50 may include a drawer 130 capable of receiving the detergent. The detergent supply device 50 may include a drawer case 120 provided to be capable of accommodating the drawer 130. The drawer 130 may be provided to be withdrawable from the drawer case 120. The drawer 130 may be provided to be insertable into the drawer case 120. The filter 110 may be detachably mounted in the drawer 130. A detailed explanation of this will be given later.

The washing machine 1 may include a housing opening 17 provided to correspond with the detergent supply device 50. The housing opening 17 may be provided for insertion of the drawer 130 of the detergent supply device 50. The housing opening 17 may be provided for withdrawal of the drawer 130. For example, the housing opening 17 may be formed on a front surface of the housing 10. For example, the housing opening 17 may be provided to correspond to a case opening 120*c* of the drawer case 120, which will be described later.

For example, referring to FIGS. 1 and 2, a detergent pump 53 may be connected to the rear of the detergent supply device 50. The detergent supply device 50 may be provided to automatically supply the detergent to the tub 20 by means of the detergent pump 53. The detergent supply device 50 may be provided to supply the detergent to the tub 20 in a timely manner by means of the detergent pump 53. However, the detergent pump 53 may be optionally provided as needed. The detergent pump 53 may be omitted.

The washing machine 1 may include a water supply pipe 51. The water supply pipe 51 may be provided to supply water to the tub 20. One side of the water supply pipe 51 may be connected to an external water supply source (not shown). The other side of the water supply pipe 51 may be connected to the detergent supply device 50. Water supplied through the water supply pipe 51 may be supplied to the inside of the tub 20 together with the detergent through the detergent supply device 50.

The washing machine 1 may include a water supply valve 52. The water supply valve 52 may be installed in the water supply pipe 51 to control the water supply. The water supply valve 52 may be provided to open and close the water supply pipe 51. The water supply valve 52 may be provided to adjust a degree of opening of the water supply pipe 51.

The drum 30 may be disposed inside the tub 20. The drum 30 may be provided to be rotatable inside the tub 20. The drum 30 may be provided to rotate about a rotation axis. For example, the drum 30 may have a substantially cylindrical shape.

The drum 30 may be provided to be capable of receiving laundry put through the laundry inlet 11. The drum 30 may be provided to wash laundry while rotating.

The drum 30 may include a cylindrical part 31. The drum 30 may include a front plate 32 disposed at the front of the cylindrical part 31. The drum 30 may include a rear plate 33 disposed at the rear of the cylindrical part 31. The front plate 32 may be provided with an opening for allowing laundry to be put and taken out. The opening of the drum 30 may correspond to the laundry inlet 11. A shaft 42 for transmitting a driving force of the driving motor 40 may be connected to the rear plate 33.

The drum 30 may include a passing hole 34. The passing hole 34 may be provided for the flow of washing water. The passing hole 34 may be formed around a circumference of the drum 30. For example, the passing hole 34 may be provided as a plurality of the passing holes 34.

The drum 30 may include a lifter 35. The lifter 35 may be provided to raise and drop laundry as the drum 30 rotates. The lifter 35 may be formed on an inner circumferential surface of the drum 30. For example, lifter 35 may be provided as a plurality of the lifters 35.

The drum 30 and the driving motor 40 may be connected through the shaft 42. Depending on a connection form between the shaft 42 and the driving motor 40, a direct driving type in which the shaft 42 is directly connected to the driving motor 40 to rotate the drum 30 and an indirect driving type in which a shaft pulley 43 is connected between the driving motor 40 and the shaft 42 to drive the drum 30 may be provided.

In the washing machine 1 according to an example of the present disclosure, the indirect driving type may be provided. However, the present disclosure is not limited thereto, and a technical feature of the present disclosure may also be applied to the direct driving type.

One end of the shaft 42 may be connected to the rear plate 33 of the drum 30. The other end of the shaft 42 may extend to outside of a rear side 21 of the tub 20. The other end of the shaft 42 may be provided to be inserted into the shaft pulley 43 to receive the driving force from the driving motor 40. A motor pulley 41 may be formed on a rotation shaft of the driving motor 40. A driving belt 44 may be provided between the motor pulley 41 and the shaft pulley 43. The shaft 42 may be driven by the driving belt 44. The driving belt 44 may drive the shaft 42 while rotating clockwise or counterclockwise.

A bearing housing 45 may be provided on the rear side 21 of the tub 20 to rotatably support the shaft 42. The bearing housing 45 may be made of aluminum alloy. The bearing housing 45 may be inserted into the rear side 21 of the tub 20 when the tub 20 is injection molded. A plurality of bearings 46 may be provided between the bearing housing 45 and the shaft 42 to allow the shaft 42 to rotate smoothly.

The washing machine 1 may include a pump device 80. The pump device 80 may be provided to pump the washing water inside the tub 20. The pump device 80 may be provided to deliver washing water in the tub 20 to the detergent supply device 50. The pump device 80 may be provided to deliver washing water in the tub 20 to the filter 110. The pump device 80 may be provided to move the washing water in the tub 20 to the filter 110. For example, the pump device 80 may be provided below the tub 20.

The pump device 80 may be connected to a discharge port 22 of the tub 20 to allow the washing water in the tub 20 to be introduced therein. The discharge port 22 may be formed at a lower end of tub 20. The pump device 80 may be connected to the tub 20 through a tub discharge pipe 63.

Figure 34:
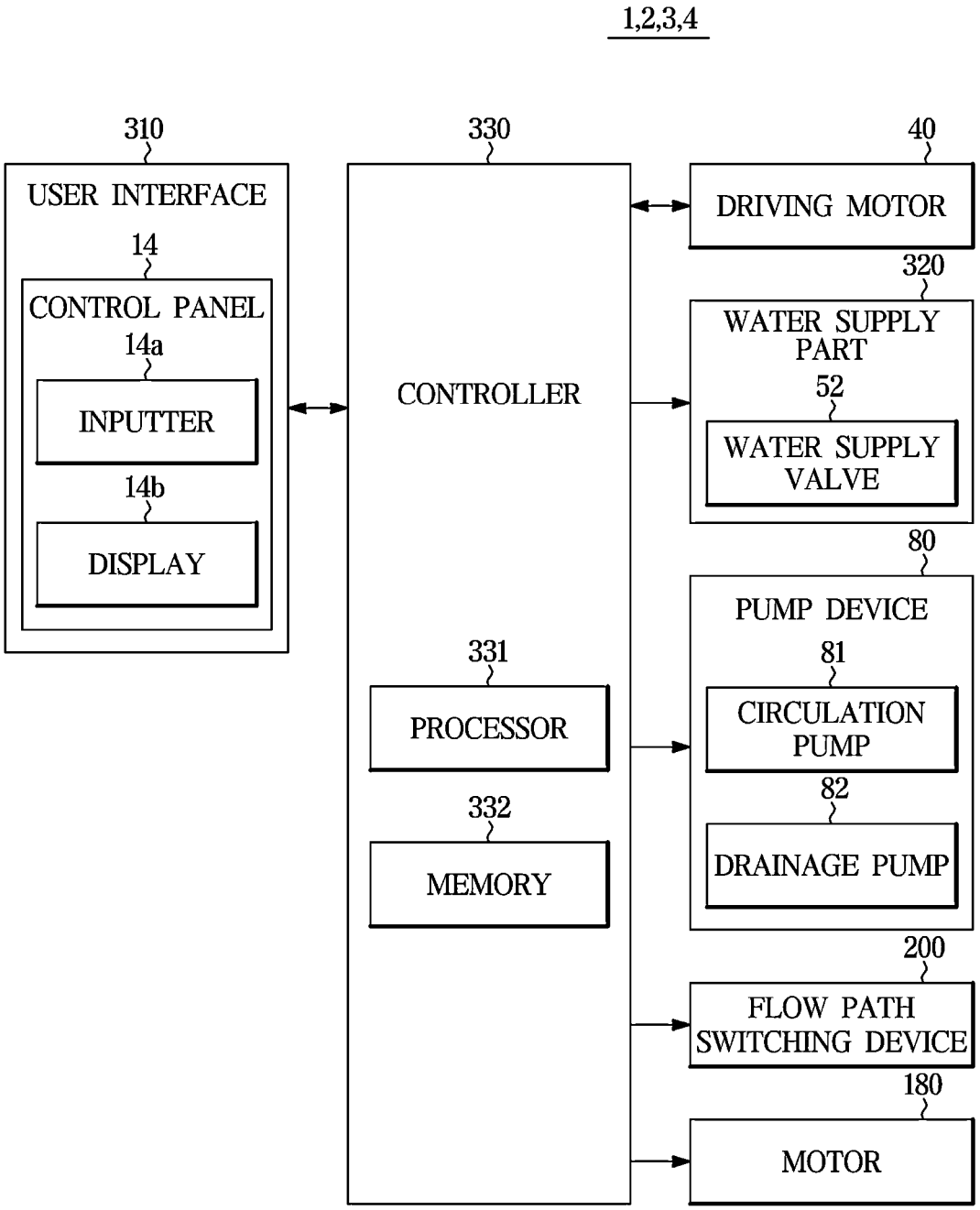
FIG. 34 is a control block diagram of the washing machine according to one embodiment.

For example, the pump device 80 may include a circulation pump 81 (see FIG. 34). The circulation pump 81 may generate a pumping force to circulate the washing water inside the tub 20. The circulation pump 81 may be referred to as the first pump 81.

For example, the pump device 80 may include a drainage pump 82 (see FIG. 34). The drainage pump 82 may generate a pumping force to drain the washing water inside the tub 20. The drainage pump 82 may be referred to as the second pump 82.

However, the pump device 80 is not limited thereto and may include a single pump as an example. As an example, the pump device 80 may include three or more pumps. There is no limitation on the number of pumps of the pump device 80 as long as the pump device 80 may move the washing water in the tub 20 to the filter 110.

The washing machine 1 may include a pump opening 15 formed on the housing 10 to correspond with the pump device 80. The pump opening 15 may allow entry into the pump device 80. For example, the pump opening 15 may be provided to be open toward the front of the housing 10. For example, the pump opening 15 may be formed on the front surface of the housing 10.

The washing machine 1 may include a pump cover 16 provided to cover the pump device 80. The pump cover 16 may be provided to open and close the pump opening 15. The pump cover 16 may be detachably mounted in the pump opening 15. For example, the pump cover 16 may be provided to be rotatable with respect to the housing 10. For example, the pump cover 16 may be provided to be rotatable with respect to the pump opening 15.

The washing machine 1 may include a control panel 14. The control panel 14 may be provided at an upper portion of the front surface of the housing 10. The control panel 14 may be provided as an example of a user interface 310. For example, the control panel 14 may include a display **14*b* for displaying a state of washing machine 1. For example, the control panel 14 may include an inputter 14*a* for receiving commands from the user. For example, the control panel 14** may include a printed circuit board assembly (not shown).

Pipes of the washing machine 1 will be described below with reference to FIG. 3 as an example.

The washing machine 1 may include the tub discharge pipe 63. The tub discharge pipe 63 may be provided between the discharge port 22 of the tub 20 and the pump device 80. The tub discharge pipe 63 may be provided to connect the discharge port 22 of the tub 20 and the pump device 80. The tub discharge pipe 63 may be provided to guide washing water discharged from the tub 20 to the pump device 80. The tub discharge pipe 63 may be referred to as the tub discharge flow path 63.

The washing machine 1 may include a connection pipe 60. The connection pipe 60 may be provided between the pump device 80 and the detergent supply device 50. The connection pipe 60 may be provided to connect the pump device 80 and the detergent supply device 50. The connection pipe 60 may be provided to extend from the pump device 80 to the detergent supply device 50. The connection pipe 60 may guide the washing water pumped from the pump device 80 to the filter 110. The connection pipe 60 may move the washing water pumped from the pump device 80 to the filter 110. The connection pipe 60 may be referred to as the connecting flow path 60.

FIG. 3 illustrates that the connection pipe 60 is provided as a single configuration, but the present disclosure is not limited thereto. The one or more connection pipes 60 may be provided. For example, the connection pipes 60 may be provided to correspond to the number of pumps of the pump device 80.

For example, the connection pipe 60 may include a first connection pipe 61 (see FIGS. 20 to 23). The first connection pipe 61 may be provided to connect the circulation pump 81 and the detergent supply device 50. The first connection pipe 61 may be provided to connect the circulation pump 81 and the filter 110. The first connection pipe 61 may extend from the circulation pump 81 toward the filter 110. The first connection pipe 61 may be provided to guide the washing water pumped from the circulation pump 81 to the filter 110. The washing water pumped from the circulation pump 81 may flow to the filter 110 through the first connection pipe 61. The first connection pipe 61 may be referred to as the circulation connection pipe 61. The first connection pipe 61 may be referred to as the circulation connection flow path 61.

For example, the connection pipe 60 may include a second connection pipe 62 (see FIGS. 20 to 23). The second connection pipe 62 may be provided to connect the drainage pump 82 and the detergent supply device 50. The second connection pipe 62 may be provided to connect the drainage pump 82 and the filter 110. The second connection pipe 62 may extend from the drainage pump 82 toward the filter 110. The second connection pipe 62 may be provided to guide the washing water pumped from the drainage pump 82 to the filter 110. The washing water pumped from the drainage pump 82 may flow to the filter 110 through the second connection pipe 62. The second connection pipe 62 may be referred to as the drain connection pipe 62. The second connection pipe 62 may be referred to as the drain connecting flow path 62.

For example, the first connection pipe 61 and the second connection pipe 62 may each extend from the pump device 80 to be joined before being connected to the detergent supply device 50. For example, the first connection pipe 61 and the second connection pipe 62 may each extend from the pump device 80 to be joined before being connected to the filter 110.

The washing machine 1 may include a discharge pipe 70. The discharge pipe 70 may be provided to allow washing water discharged from the detergent supply device 50 to flow. The discharge pipe 70 may be provided to allow washing water passed through the filter 110 to flow. The discharge pipe 70 may be provided to allow the filtered washing water to flow. The discharge pipe 70 may be provided to allow washing water from which foreign substances have been removed to flow. The discharge pipe 70 may be referred to as the discharge flow path 70.

The discharge pipe 70 may be provided to guide the washing water passed through the filter 110 to the outside of the tub 20 or housing 10. The discharge pipe 70 may be provided to circulate the washing water passed through the filter 110 to the tub 20 or to drain the washing water passed through the filter 110 to the outside of the housing 10.

For example, the discharge pipe 70 may include a circulation pipe 71. The circulation pipe 71 may be provided to connect the detergent supply device 50 and the tub 20. The circulation pipe 71 may be provided to connect the filter 110 and the tub 20. The circulation pipe 71 may be provided to communicate with the tub 20. The circulation pipe 71 may be provided to guide the washing water passed through the filter 110 to the tub 20. The circulation pipe 71 may be provided to deliver the washing water passed through the filter 110 to the tub 20. The circulation pipe 71 may be provided to circulate the washing water passed through the filter 110 to the tub 20. The circulation pipe 71 may be provided to guide the detergent received in the detergent supply device 50 to the tub 20. The circulation pipe 71 may extend from the detergent supply device 50 toward the tub 20.

The circulation pipe 71 may be referred to as the circulation flow path 71.

For example, the discharge pipe 70 may include a drain pipe 72. The drain pipe 72 may be provided to connect the detergent supply device 50 and the outside of the housing 10. The drain pipe 72 may be provided to connect the filter 110 and the outside of the housing 10. The drain pipe 72 may be provided to communicate with the outside of the housing 10. The drain pipe 72 may be provided to guide the washing water passed through the filter 110 to the outside of the housing 10. The drain pipe 72 may be provided to deliver the washing water passed through the filter 110 to the outside of the housing 10. The drain pipe 72 may be provided to drain the washing water passed through the filter 110 to the outside of the housing 10. The drain pipe 72 may extend from the detergent supply device 50 toward the outside of the housing 10.

The drain pipe 72 may be referred to as the drain flow path 72.

The discharge pipe 70 may include the circulation pipe 71 and/or the drain pipe 72. For example, the discharge pipe 70 may include only the circulation pipe 71. For example, the discharge pipe 70 may include only the drain pipe 72. For example, the discharge pipe 70 may include both the circulation pipe 71 and the drain pipe 72. That is, the discharge pipe 70 may be provided to be connected to at least one of the tub 20 and the outside of the housing 10.

Figure 4:
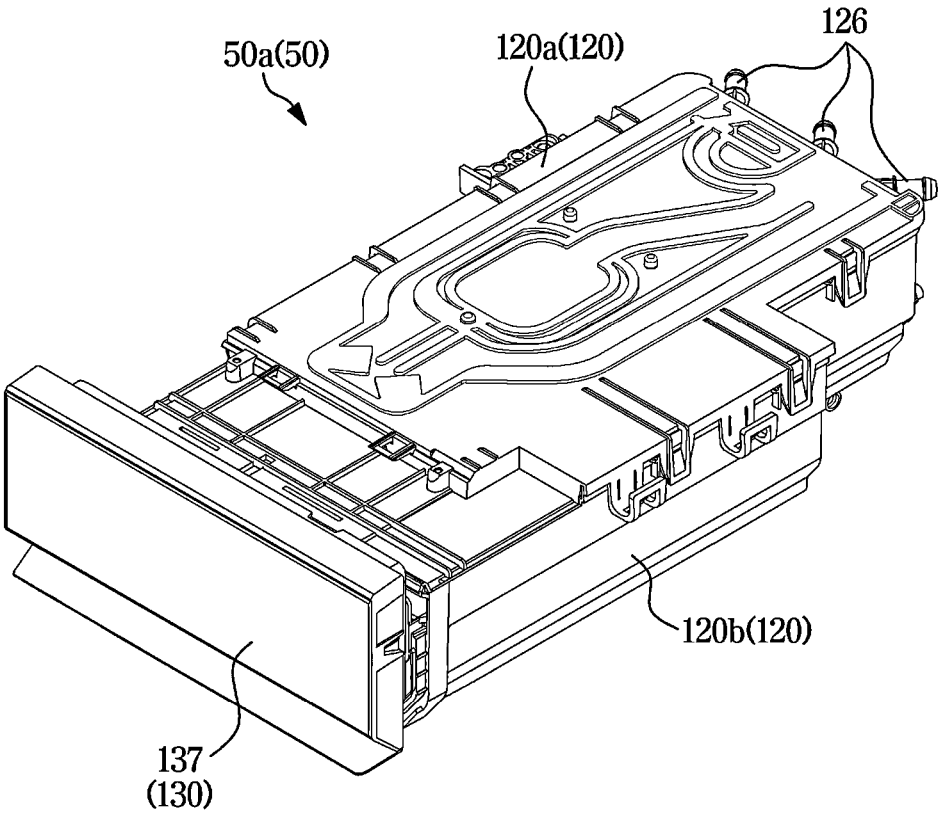
FIG. 4 is a perspective view of an example of the detergent supply device according to one embodiment.
Figure 5:
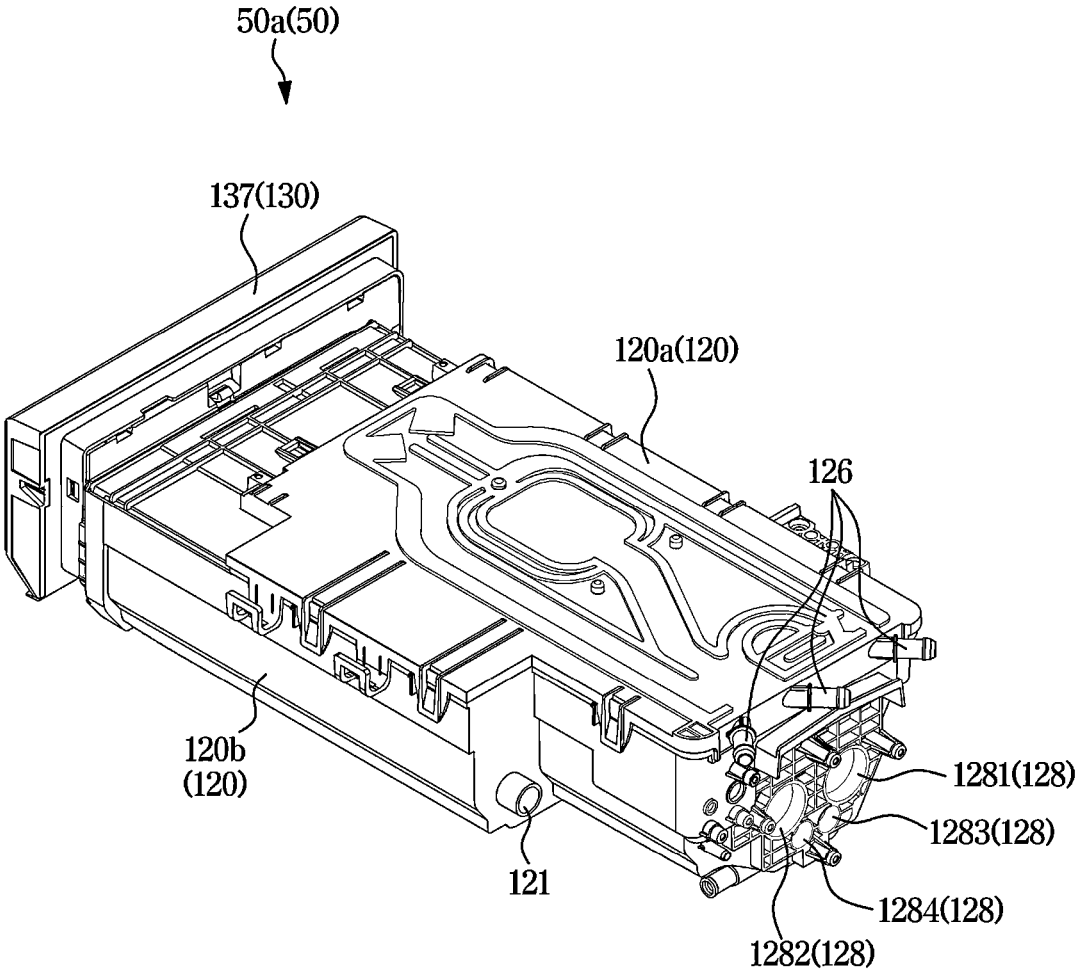
FIG. 5 is a rear perspective view of the detergent supply device illustrated in FIG. 4.
Figure 6:
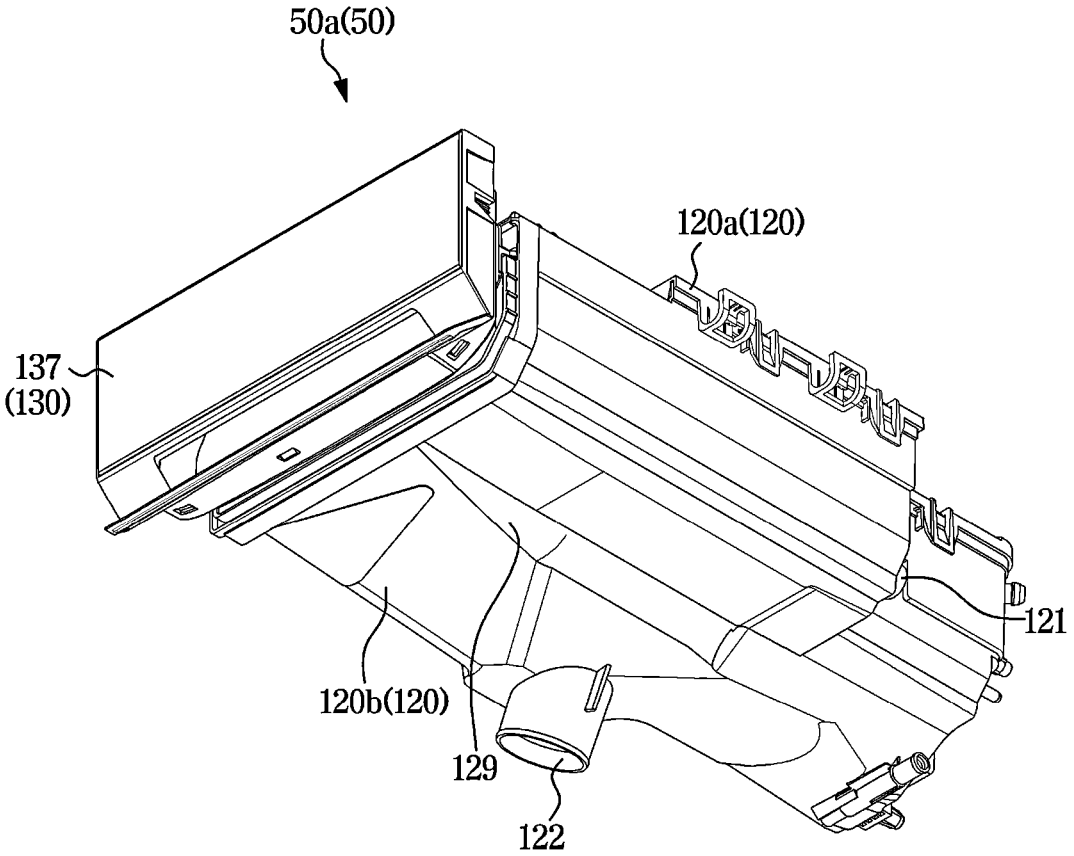
FIG. 6 is a bottom perspective view of the detergent supply device illustrated in FIG. 4.
Figure 7:
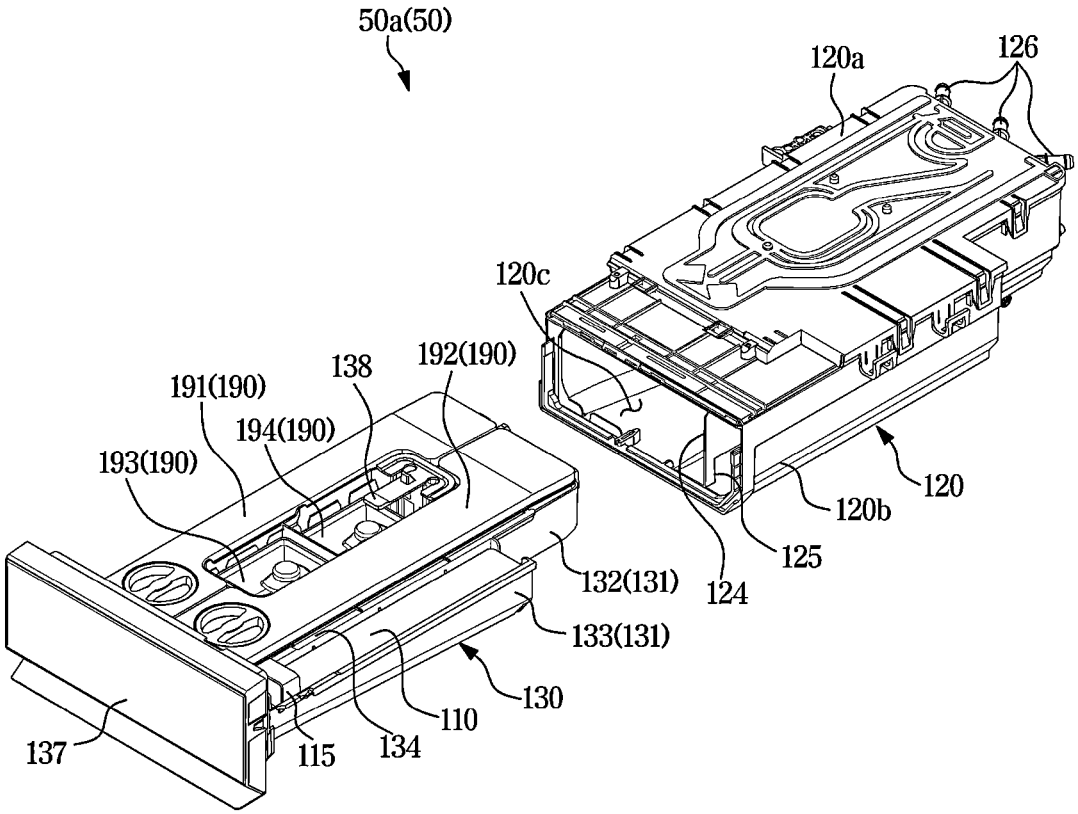
FIG. 7 is an exploded view of the detergent supply device illustrated in FIG. 4.
Figure 8:
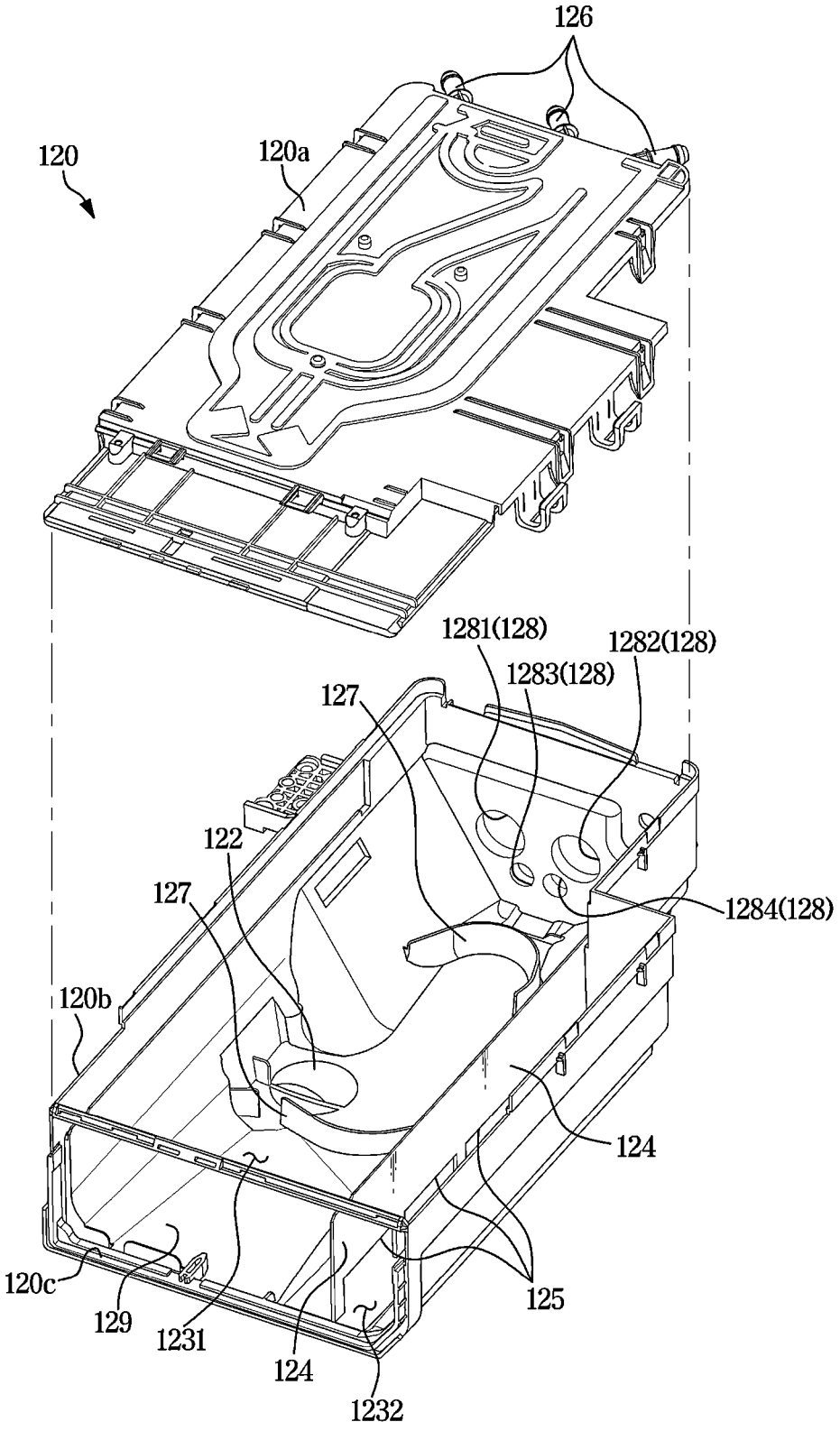
FIG. 8 is an exploded view of a drawer case illustrated in FIG. 7.
Figure 9:
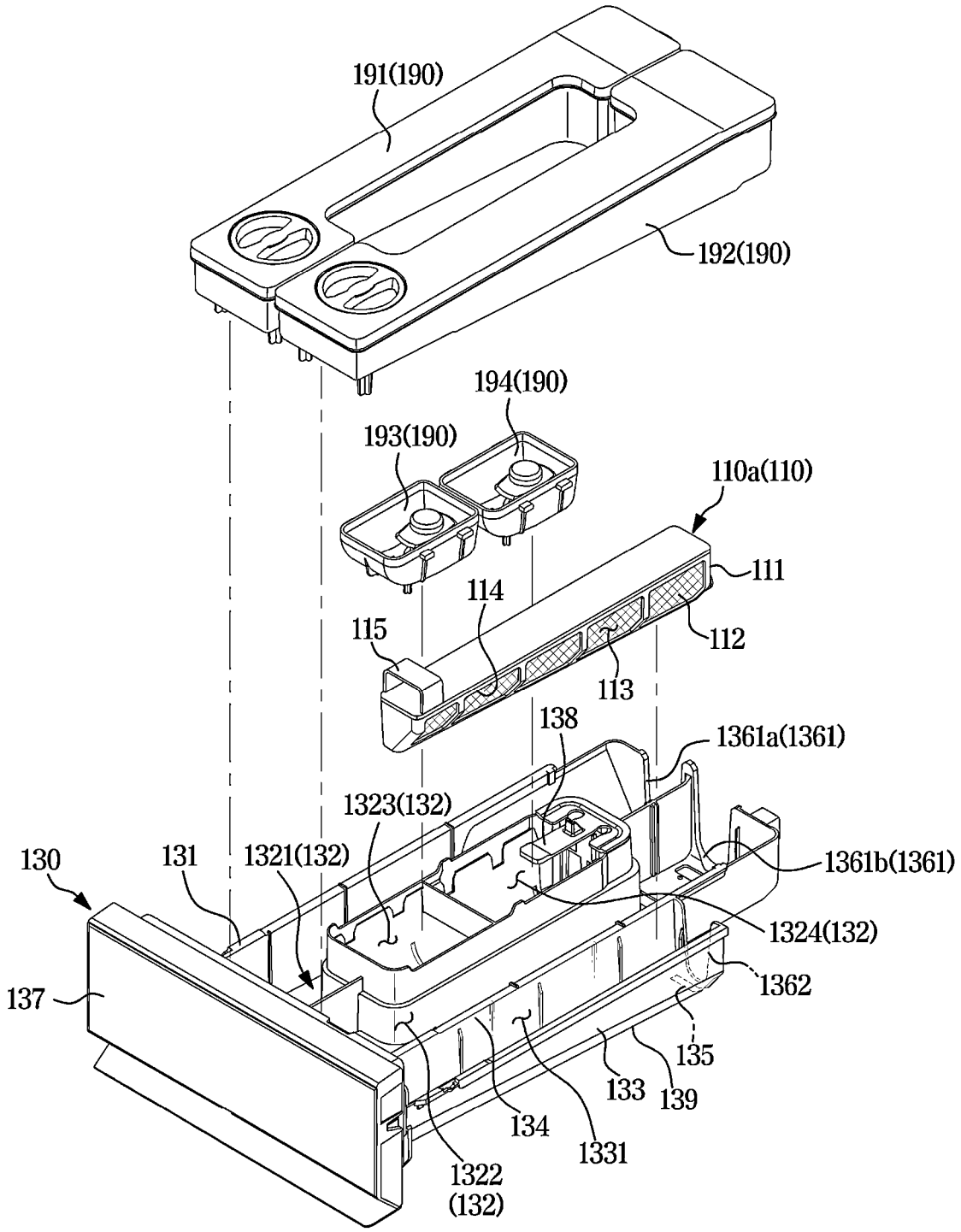
FIG. 9 is a view illustrating a drawer, a detergent box, and a filter illustrated in FIG. 7.
Figure 10:
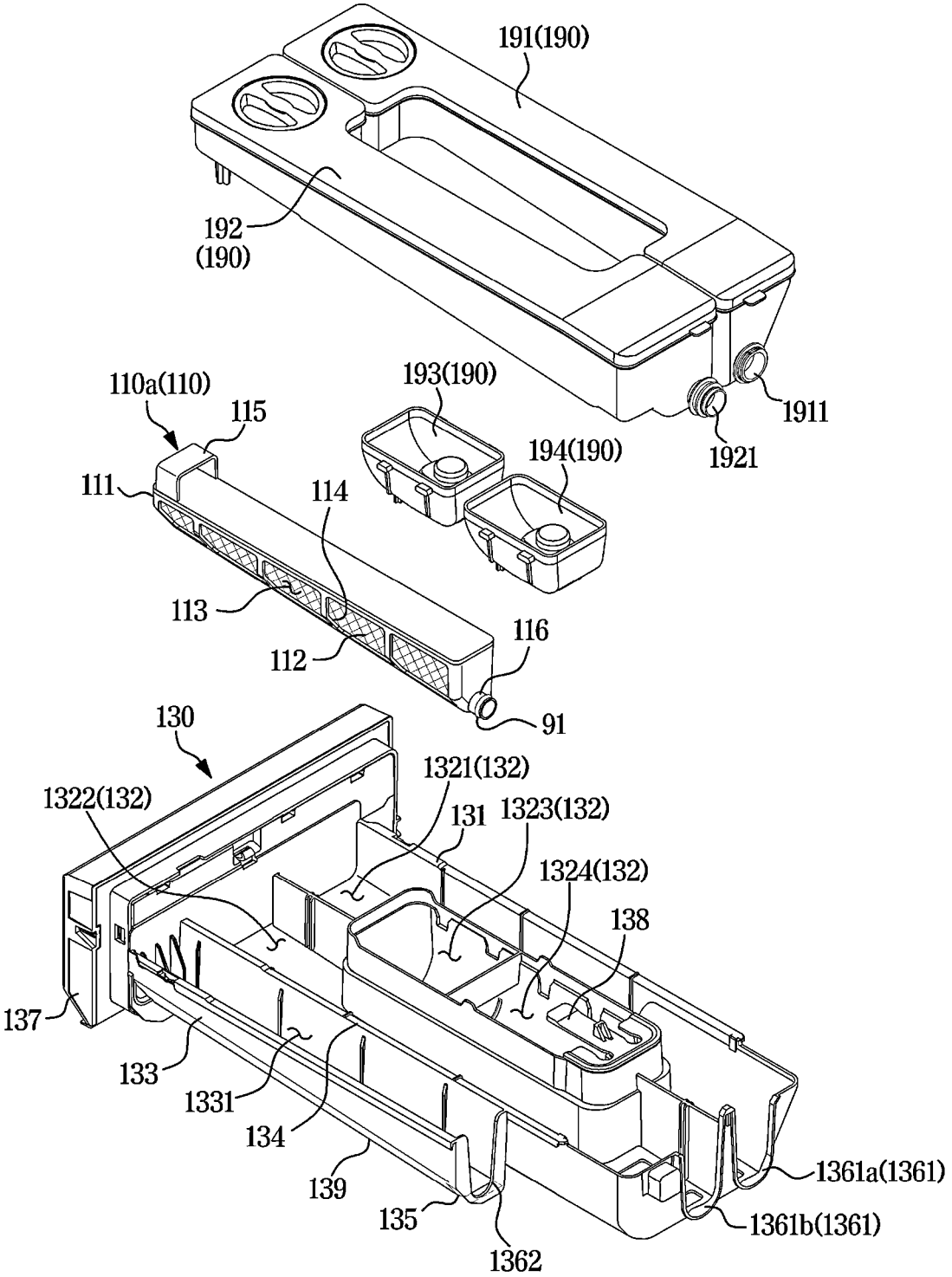
FIG. 10 is a view illustrating the drawer, the detergent box and the filter illustrated in FIG. 9 from the rear.
Figure 11:
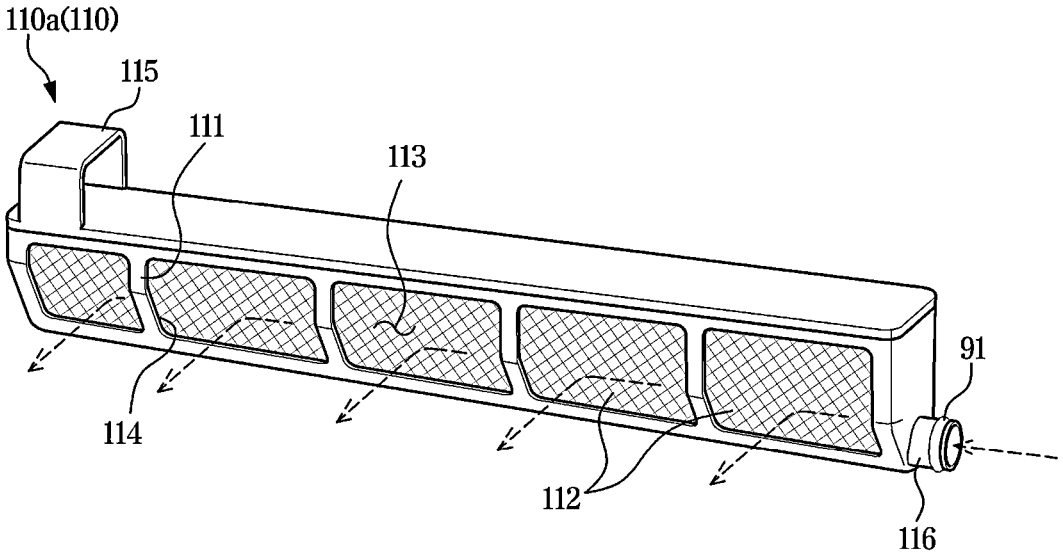
FIG. 11 is a perspective view of an example of the filter according to one embodiment.

FIG. 4 is a perspective view of an example of the detergent supply device according to one embodiment. FIG. 5 is a rear perspective view of the detergent supply device illustrated in FIG. 4. FIG. 6 is a bottom perspective view of the detergent supply device illustrated in FIG. 4. FIG. 7 is an exploded view of the detergent supply device illustrated in FIG. 4. FIG. 8 is an exploded view of a drawer case illustrated in FIG. 7. FIG. 9 is a view illustrating a drawer, a detergent box, and a filter illustrated in FIG. 7. FIG. 10 is a view illustrating the drawer, the detergent box and the filter illustrated in FIG. 9 from the rear. FIG. 11 is a perspective view of an example of the filter according to one embodiment.

An example (50*a*) of the detergent supply device 50 will be described below with reference to FIGS. 4 to 11.

A detergent supply device 50*a* may include the drawer case 120. The detergent supply device 50*a* may include the drawer 130. The detergent supply device 50*a* may include the filter 110.

Referring to FIGS. 4 to 7, at least a portion of the drawer 130 may be provided to be accommodatable in the drawer case 120. The at least a portion of the drawer 130 may be provided to be disposed in the drawer case 120. The at least a portion of the drawer 130 may be provided to be insertable into the drawer case 120.

The drawer 130 may be provided to be insertable into or withdrawable from the drawer case 120. The drawer 130 may be inserted into the drawer case 120 through the housing opening 17. The drawer 130 may be withdrawn from the drawer case 120 through the housing opening 17.

For example, the drawer 130 may be provided to move in a front-rear direction (X direction). For example, the drawer 130 may be provided to be slidably movable with respect to the drawer case 120.

The filter 110 may be provided to be insertable into or withdrawal from the drawer case 120 in a state of being mounted in the drawer 130. When the drawer 130 is withdrawn from the drawer case 120, the filter 110 mounted in the drawer 130 may be exposed to the outside of the housing 10. As the filter 110 is withdrawn to the outside of the housing 10, the user may clean the filter 110 or replace the filter 110 with a new filter.

The drawer case 120 may be provided inside the housing 10. The drawer case 120 may be fixed inside the housing 10. For example, the drawer case 120 may be disposed between the inner side of the housing 10 and the upper left portion of the tub 20 (see FIGS. 1 and 2). However, the present disclosure is not limited thereto, and it is sufficient as long as the drawer case 120 is positioned inside the housing 10 so as not to interfere with the tub 20.

For example, the drawer case 120 may include a first case 120*a* and a second case 120*b*. The first case 120*a* and the second case 120*b* may be detachably coupled to each other. The first case 120*a* may be provided to be coupled to an upper portion of the second case 120*b*. The first case 120*a* may be referred to as the upper case 120*a*. The second case 120*b* may be referred to as the lower case 120*b*. However, the present disclosure is not limited thereto, and the first case 120*a* and the second case 120*b* may be formed integrally.

The case opening 120*c* may be formed in the drawer case 120. The case opening 120*c* may be provided to correspond to the housing opening 17. The case opening 120*c* may be formed for insertion and/or withdrawal of the drawer 130. The case opening 120*c* may be provided to be open toward the front. For example, the case opening 120*c* may be formed on the second case 120*b*. However, the case opening is not limited thereto, and may be formed by combining the first case 120*a* and the second case 120*b*.

The drawer case 120 may include an inlet portion 121. The inlet portion 121 may be connected to the pump device 80. The inlet portion 121 may be connected to the pump device 80 through the connection pipe 60. The washing water pumped from the pump device 80 may be introduced into the inlet portion 121 of the drawer case 120 through the connection pipe 60. The inlet portion 121 may be provided to allow washing water to flow in toward the filter 110. The inlet portion 121 may be provided to correspond to a filter inlet port 116 of the filter 110, which will be described later.

The drawer case 120 may include an outlet portion 122. The outlet portion 122 may be provided to allow the detergent and/or washing water to flow out. The outlet portion 122 may be provided to allow the washing water passed through the filter 110 to flow out. The outlet portion 122 may be connected to the outside of the tub 20 and/or housing 10. The outlet portion 122 may be connected to the outside of the tub 20 and/or housing 10 through the discharge pipe 70. The outlet portion 122 may be provided to allow the washing water and/or detergent inside the detergent supply device 50 to flow out. The outlet portion 122 may be provided to allow the washing water passed through the filter 110 to flow out to the discharge pipe 70. The outlet portion 122 may be provided to allow the washing water passed through the filter 110 to flow out to the circulation pipe 71 or the drain pipe 72. The outlet portion 122 may be provided to allow the detergent received in the drawer 130 to flow out to the circulation pipe 71. The outlet portion 122 may be provided to correspond to a filter outlet port 117 of the filter 110, which will be described later. For example, the outlet portion 122 may be formed at a bottom of drawer case 120. For example, the outlet portion 122 may be positioned lower than the inlet portion 121.

The drawer case 120 may include a water supply port 126. The water supply port 126 may receive water from the external water supply source (not shown) through the water supply pipe 51. The water flowed into the water supply port 126 may flow into the tub 20 together with the detergent. For example, the water supply port 126 may be formed on the first case 120*a*. However, the water supply port 126 is not limited thereto and may be formed on the second case 120*b*.

The drawer case 120 may form accommodation spaces 1231 and 1232 provided to accommodate the drawer 130. The accommodation spaces 1231 and 1232 may be formed inside the drawer case 120. The accommodation spaces 1231 and 1232 may have a shape corresponding to a shape of the drawer 130. For example, the accommodation spaces 1231 and 1232 may extend substantially in the front-rear direction (X direction).

For example, the drawer case 120 may include the first accommodation space 1231 corresponding to a detergent receiving portion 132 of the drawer 130, which will be described later. The first accommodation space 1231 may accommodate the detergent receiving portion 132 of the drawer 130. The detergent receiving portion 132 of the drawer 130 may be disposed in the first accommodation space 1231.

For example, the drawer case 120 may include the second accommodation space 1232 corresponding to a filter mounting portion 133 of the drawer 130, which will be described later. The second accommodation space 1232 may include the filter mounting portion 133 of the drawer 130. The filter mounting portion 133 of the drawer 130 may be disposed in the second accommodation space 1232.

The drawer case 120 may include a wall part 124. The wall part 124 may be formed in the accommodation spaces 1231 and 1232. For example, the wall part 124 may be provided between the first accommodation space 1231 and the second accommodation space 1232. For example, the wall part 124 may be provided to separate the first accommodation space 1231 and the second accommodation space 1232.

The drawer case 120 may include a case communication portion 125. The case communication portion 125 may be formed on the wall part 124. For example, the case communication portion 125 may be formed through the wall part 124. The case communication portion 125 may be provided to communicate the first accommodation space 1231 and the second accommodation space 1232. The case communication portion 125 may be provided to allow washing water to flow. The case communication portion 125 may be provided to allow washing water to pass through. For example, the washing water passed through the filter 110 may flow from the first accommodation space 1231 to the second accommodation space 1232 through the case communication portion 125.

The drawer case 120 may include a guide wall 127. The guide wall 127 may be provided to guide the washing water inside the drawer case 120 to the outlet portion 122. The guide wall 127 may be formed at the bottom of the drawer case 120. For example, the guide wall 127 may protrude from the bottom of the drawer case 120. For example, the guide wall 127 may have a curved shape.

The drawer case 120 may include an inclined surface 129. The inclined surface 129 may be formed at the bottom of the drawer case 120. The inclined surface 129 may have a shape of being inclined downward toward the outlet portion 122. By this shape, washing water may flow along the inclined surface 129 to smoothly flow to the outlet portion 122. That is, washing water may flow along the inclined surface 129 to be smoothly discharged from the detergent supply device 50.

The drawer case 120 may include a detergent pump connection portion 128. The detergent pump connection portion 128 may be provided to be connected to the detergent pump 53. For example, the detergent received in the drawer 130 may flow to the detergent pump 53 through the detergent pump connection portion 128. For example, the detergent pumped by the detergent pump 53 may flow to the drawer case 120 through the detergent pump connection portion 128.

For example, the detergent pump connection portion 128 may include a first hole 1281. The first hole 1281 may be provided to allow the detergent received in a first detergent box 191, which will be described later, to flow toward the detergent pump 53.

For example, the detergent pump connection portion 128 may include a second hole 1282. The second hole 1282 may be provided to allow the detergent received in a second detergent box 192, which will be described later, to flow toward the detergent pump 53.

For example, the detergent pump connection portion 128 may include a third hole 1283. The third hole 1283 may be provided to allow the detergent pumped from the first detergent box 191 by the detergent pump 53 to flow toward the drawer case 120.

For example, the detergent pump connection portion 128 may include a fourth hole 1284. The fourth hole 1284 may be provided to allow the detergent pumped from the second detergent box 192 by the detergent pump 53 to flow toward the drawer case 120.

However, unlike that illustrated in the drawing, the detergent pump connection portion 128 may be omitted depending on the presence or absence of the detergent pump 53. In a case in which the detergent pump 53 is not provided, the detergent pump connection portion 128 may not be formed on the drawer case 120.

The drawer 130 may include a drawer body 131. The drawer body 131 may be provided to be insertable into the drawer case 120 or withdrawable from the drawer case 120. The drawer body 131 may receive the detergent. The drawer body 131 may accommodate the filter 110.

The drawer 130 may include a drawer handle 137. The drawer handle 137 may be provided to be capable of being grasped by the user. The user may insert the drawer 130 into the drawer case 120 in a state of grasping the drawer handle 137. The user may withdraw the drawer 130 from the drawer case 120 in the state of grasping the drawer handle 137. For example, the drawer handle 137 may be formed at the front of the drawer body 131. For example, the drawer handle 137 may not be accommodated in drawer case 120. For example, the drawer handle 137 may be provided to be exposed to the front outer side of the housing 10.

The drawer 130 may include the detergent receiving portion 132 capable of receiving the detergent. The detergent receiving portion 132 may be formed in the drawer body 131. The detergent receiving portion 132 may have a recessed shape. The detergent receiving portion 132 may directly receive the detergent or indirectly receive the detergent.

The one or more detergents receiving portion 132 may be provided.

For example, referring to FIGS. 9 and 10, the detergent receiving portion 132 may include a first detergent receiving portion 1321. For example, the first detergent box 191 may be detachably mounted in the first detergent receiving portion 1321. For example, the first detergent box 191 may be provided to receive a first detergent (e.g., liquid detergent, powder detergent, etc.) to be supplied to the tub 20 during a washing process. For example, the first detergent box 191 may be provided to be connected to the detergent pump 53. For example, the first detergent received in the first detergent box 191 may be pumped by the detergent pump 53 to be automatically supplied to the tub 20. The first detergent box 191 may be provided as an automatic detergent box. However, the first detergent box 191 is not limited thereto and may also be provided to receive a second detergent (e.g. fabric softener, rinse, etc.) to be supplied to the tub 20 during a rinsing process. The first detergent box 191 may also be provided not to be connected to the detergent pump 53. The first detergent box 191 may also be provided as a manual detergent box.

For example, referring to FIGS. 9 and 10, the detergent receiving portion 132 may include a second detergent receiving portion 1322. For example, the second detergent box 192 may be detachably mounted in the second detergent receiving portion 1322. For example, the second detergent box 192 may be provided to receive a second detergent. For example, the second detergent box 192 may be provided to be connected to the detergent pump 53. For example, the second detergent received in the second detergent box 192 may be pumped by the detergent pump 53 to be automatically supplied to the tub 20. The second detergent box 192 may be provided as an automatic detergent box. However, the second detergent box 192 is not limited thereto and may also be provided to receive the first detergent. The second detergent box 192 may also be provided not to be connected to the detergent pump 53. The second detergent box 192 may also be provided as a manual detergent box.

For example, referring to FIGS. 9 and 10, the detergent receiving portion 132 may include a third detergent receiving portion 1323. A third detergent box 193 may be detachably mounted in the third detergent receiving portion 1323. For example, the third detergent box 193 may be provided to receive the first detergent. For example, the third detergent box 193 may be provided not to be connected to the detergent pump 53. For example, the user may manually put the detergent into the third detergent box 193. For example, the third detergent box 193 may be provided as a manual detergent box. However, the third detergent box 193 is not limited thereto and may be provided to receive the second detergent. The third detergent box 193 may also be provided to be connected to the detergent pump 53. The third detergent box 193 may also be provided as an automatic detergent box.

For example, referring to FIGS. 9 and 10, the detergent receiving portion 132 may include a fourth detergent receiving portion 1324. A fourth detergent box 194 may be detachably mounted in the fourth detergent receiving portion 1324. For example, the fourth detergent box 194 may be provided to receive the second detergent. For example, the fourth detergent box 194 may be provided not to be connected to the detergent pump 53. For example, the user may manually put the detergent into the fourth detergent box 194. For example, the fourth detergent box 194 may be provided as a manual detergent box. However, the fourth detergent box 194 is not limited thereto and may be provided to receive the first detergent. The fourth detergent box 194 may also be provided to be connected to the detergent pump 53. The fourth detergent box 194 may also be provided as an automatic detergent box.

The drawings illustrate an example in which the detergent is received indirectly as the detergent receiving portion 132 accommodates the detergent box 190, but the present disclosure is not limited thereto. The detergent receiving portion 132 may also be provided to receive the detergent directly. In this case, the detergent supply device 50 may not include the detergent box 190.

The drawer 130 may include the filter mounting portion 133. The filter 110 may be detachably mounted in the filter mounting portion 133. The filter 110 may be accommodated in the filter mounting portion 133. The filter mounting portion 133 may form an accommodation space 1331 to accommodate the filter 110. For example, the accommodation space 1331 may be provided to have a recessed shape.

The drawer 130 may include a partition wall 134. The partition wall 134 may be provided between the detergent receiving portion 132 and the filter mounting portion 133. The partition wall 134 may be provided to partition the detergent receiving portion 132 and the filter mounting portion 133. The partition wall 134 may be provided to separate the detergent receiving portion 132 and the filter mounting portion 133. For example, washing water inside the filter mounting portion 133 may not flow to the detergent receiving portion 132 by the partition wall 134. For example, the washing water passed through the filter 110 may not flow to the detergent receiving portion 132 by the partition wall 134. Accordingly, the washing water passed through the filter 110 may be prevented from overflowing and penetrating into the detergent receiving portion 132.

The drawer 130 may include a drawer communication portion. The drawer communication portion may be formed on the filter mounting portion 133. For example, the drawer communication portion may be formed at a lower portion of the filter mounting portion 133. For example, the drawer communication portion may be formed at a bottom of the filter mounting portion 133. The drawer communication portion may be provided to communicate the filter mounting portion 133 and the drawer case 120. For example, the washing water passed through the filter 110 may flow from the filter mounting portion 133 to the drawer case 120 through the drawer communication portion. For example, the washing water passed through the drawer communication portion may flow between the drawer 130 and the drawer case 120 to be discharged through the outlet portion 122 of the drawer case 120.

Hereinafter, the drawer communication portion may be referred to as a first communication portion, and the case communication portion 125 may be referred to as the second communication portion 125. However, the first communication portion and the second communication portion 125 are not limited by the ordinal numbers "first" and "second." For example, the drawer communication portion and the case communication portion 125 may be referred to, conversely, as a second communication portion and the first communication portion 125, respectively.

The drawer 130 may include an inclined surface 139. The inclined surface 139 may be formed at the bottom of the filter mounting portion 133. The inclined surface 139 may have a shape of being inclined downward toward the first communication portion. By this shape, the washing water passed through the filter 110 may flow smoothly to the first communication portion along the inclined surface 139.

The drawer 130 may include a first support portion 1361. The first support portion 1361 may be provided to support the detergent box 190. For example, in a case in which the detergent box 190 is connected to the detergent pump 53, the first support portion 1361 may be provided to support detergent discharge portions 1911 and 1921 of the detergent box 190. For example, the first support portion 1361 may be formed on a rear surface of the drawer body 131. For example, the first support portion 1361 may be formed by cutting the drawer body 131.

For example, the first support portion 1361 may include a first-a support portion 1361*a*. The first-a support portion 1361*a* may be provided to support the first detergent discharge portion 1911 of the first detergent box 191. For example, the first support portion 1361 may include a first-b support portion 1361*b*. The first-b support portion 1361*b* may be provided to support the second detergent discharge portion 1921 of the second detergent box 192.

The drawer 130 may include a second support portion 1362. The second support portion 1362 may be provided to support the filter 110. For example, the second support portion 1362 may be provided to support the filter inlet port 116 and/or the filter outlet port 117 of the filter 110, which will be described later. For example, the second support portion 1362 may be formed on the rear surface of the drawer body 131. For example, the second support portion 1362 may be formed by cutting the drawer body 131.

However, the first support portion 1361 and the second support portion 1362 are not limited by the ordinal numbers "first" and "second." For example, the first support portion 1361 and the second support portion 1362 may be referred to, conversely, as a second support portion 1361 and the first support portion 1362, respectively.

The drawer 130 may include a button 138. The button 138 may be provided to separate the drawer 130 from the drawer case 120. For example, the button 138 may be exposed to the outside in a state in which the drawer 130 is withdrawn from the drawer case 120. For example, when the button 138 is pressed, the coupling between the drawer 130 and the drawer case 120 may be released. For example, when the button 138 is pressed, the coupling between the drawer 130 may be released from the drawer case 120. For example, the user may easily clean the drawer 130 by completely separating the drawer 130 from the drawer case 120.

An example 110*a* of the filter 110 will be described below with reference to FIGS. 9 to 11.

The detergent supply device 50 may include the filter 110. The filter 110 may receive washing water from the pump device 80. The filter 110 may be provided to receive washing water introduced from the pump device 80 through the connection pipe 60.

The filter 110 may be provided to filter the washing water introduced from the pump device 80. The filter 110 may be provided to collect foreign substances contained in the washing water introduced from the pump device 80. For example, the filter 110 may be provided to collect microplastics contained in the washing water introduced from the pump device 80. As the washing machine 1 includes the filter 110, foreign substances (e.g., microplastics, etc.) contained in washing water may be prevented from being discharged to the outside of the housing 10. For example, the filter 110 may include a fine filter.

For example, the filter 110 may include a filter frame 111 and a filter body 112.

The filter frame 111 may be provided to support the filter body 112 or to accommodate the filter body 112. For example, the filter frame 111 may be provided to form an exterior of the filter 110. The filter frame 111 may be referred to as the filter case 111. The filter frame 111 may be referred to as the filter housing 111.

The filter body 112 may be provided to collect foreign substances in washing water. Foreign substances contained in the washing water passing through the filter 110 may adhere to the filter body 112. For example, the filter body 112 may be provided in a mesh shape. For example, the filter body 112 may be made of non-woven fabric. The filter body 112 is not limited to the examples described above and may be provided in various types and/or shapes to collect foreign substances.

The filter frame 111 may include a filter body mounting portion 114 in which the filter body 112 is mounted. For example, the filter body mounting portion 114 may be provided as an opening, and the filter body 112 may be provided to fill the filter body mounting portion 114. However, the present disclosure is not limited thereto, and the filter body mounting portion 114 may be provided in a recessed shape inside the filter frame 111, and the filter body 112 may be provided to be seated in the filter body mounting portion 114.

The filter 110 may include a collection space 113. The filter 110 may form the collection space 113 therein. The collection space 113 may refer to an internal space formed by the filter frame 111 and/or the filter body 112. The collection space 113 may refer to a space surrounded by the filter frame 111 and/or the filter body 112.

The collection space 113 may be provided to receive foreign substances filtered out by the filter 110. The collection space 113 may be provided to collect foreign substances contained in washing water as the washing water introduced from the pump device 80 flows from the inside of the filter 110 to the outside of the filter 110. For example, the collection space 113 may be provided to collect foreign substances contained in washing water as the washing water passes through the filter body 112. For example, foreign substances may be collected on a surface of the filter body 112 facing the collection space 113. For example, foreign substances may be collected on an inner surface of the filter body 112.

For example, the filter 110 may include the filter inlet port 116. The filter inlet port 116 may receive the washing water introduced from the pump device 80. The filter inlet port 116 may be provided to communicate the collection space 113 and the connection pipe 60. The filter inlet port 116 may be provided to communicate the collection space 113 and the inlet portion 121 of the drawer case 120. The filter inlet port 116 may be provided to correspond to the inlet portion 121 of the drawer case 120.

For example, the filter inlet port 116 may be formed on the filter frame 111.

For example, the washing water pumped from the pump device 80 may pass through the connection pipe 60 and the inlet portion 121 of the drawer case 120 and then flow to the filter inlet port 116. The washing water introduced into the filter 110 through the filter inlet port 116 may flow to the outside of the filter 110 through the filter body 112. As washing water flows from the inside of the filter 110 to the outside, foreign substances in the washing water may not pass through the filter body 112 and may remain in the collection space 113.

For example, the filter inlet port 116 of the filter 110 may be provided to be docked with the inlet portion 121 of the drawer case 120 as the filter 110 is inserted into the drawer case 120. A sealing member 91 may be provided between the filter inlet port 116 and the inlet portion 121. The sealing member 91 may prevent leakage of washing water by sealing between the filter inlet port 116 and the inlet portion 121. For example, the sealing member 91 may be detachably coupled to the filter inlet port 116.

The filter inlet port 116 may be referred to as the filter inlet part 116. The filter inlet port 116 may be referred to as the filter port 116.

The filter 110 may include a filter handle 115. The filter handle 115 may be provided to be capable of being grasped by the user. For example, the user may mount the filter 110 in the filter mounting portion 133 in the state of grasping the filter handle 115. For example, the user may separate the filter 110 from the filter mounting portion 133 in the state of grasping the filter handle 115. For example, the filter 110 mounted in the drawer 130 may be exposed to the outside of housing 10 in the state in which the drawer 130 is withdrawn from the drawer case 120. In this case, the filter handle 115 of the filter 110 may also be exposed to the outside of the housing 10. For example, the filter handle 115 may be formed on an upper side of the filter frame 111. The user may easily replace and/or clean the filter 110 by grasping the filter handle 115.

Figure 12:
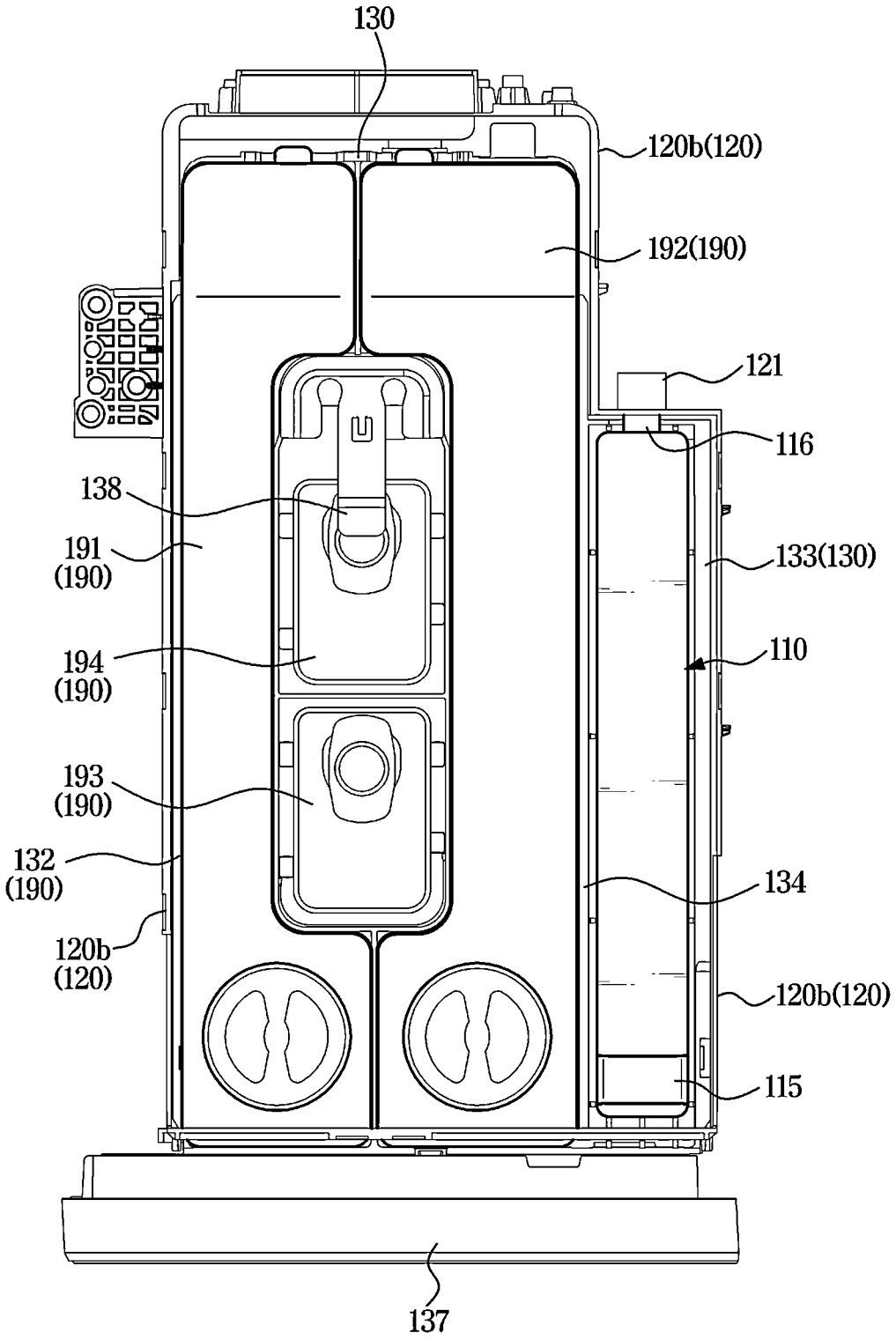
FIG. 12 is a plan view of an example of the detergent supply device according to one embodiment.
Figure 13:
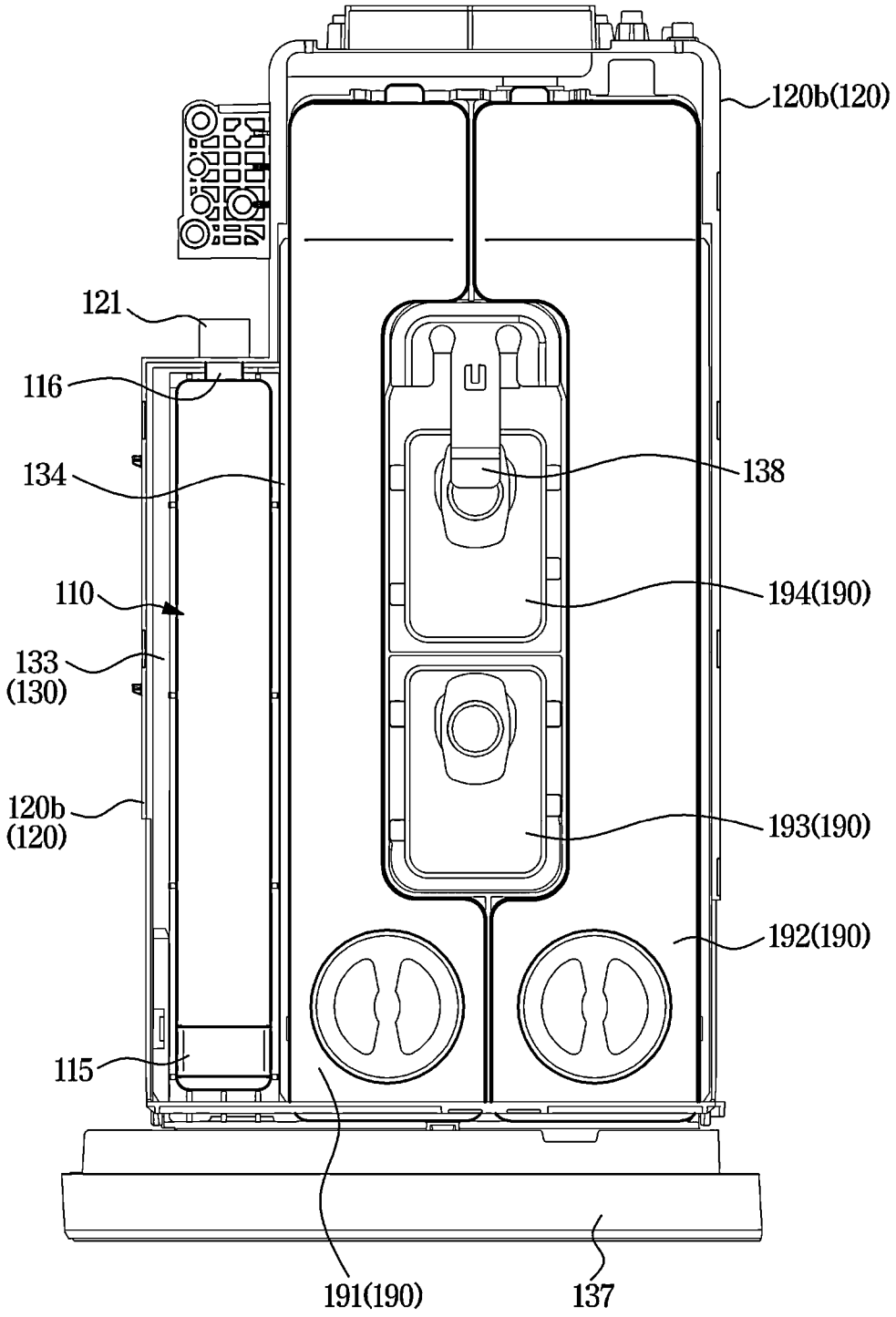
FIG. 13 is a plan view of an example of the detergent supply device according to one embodiment.
Figure 14:
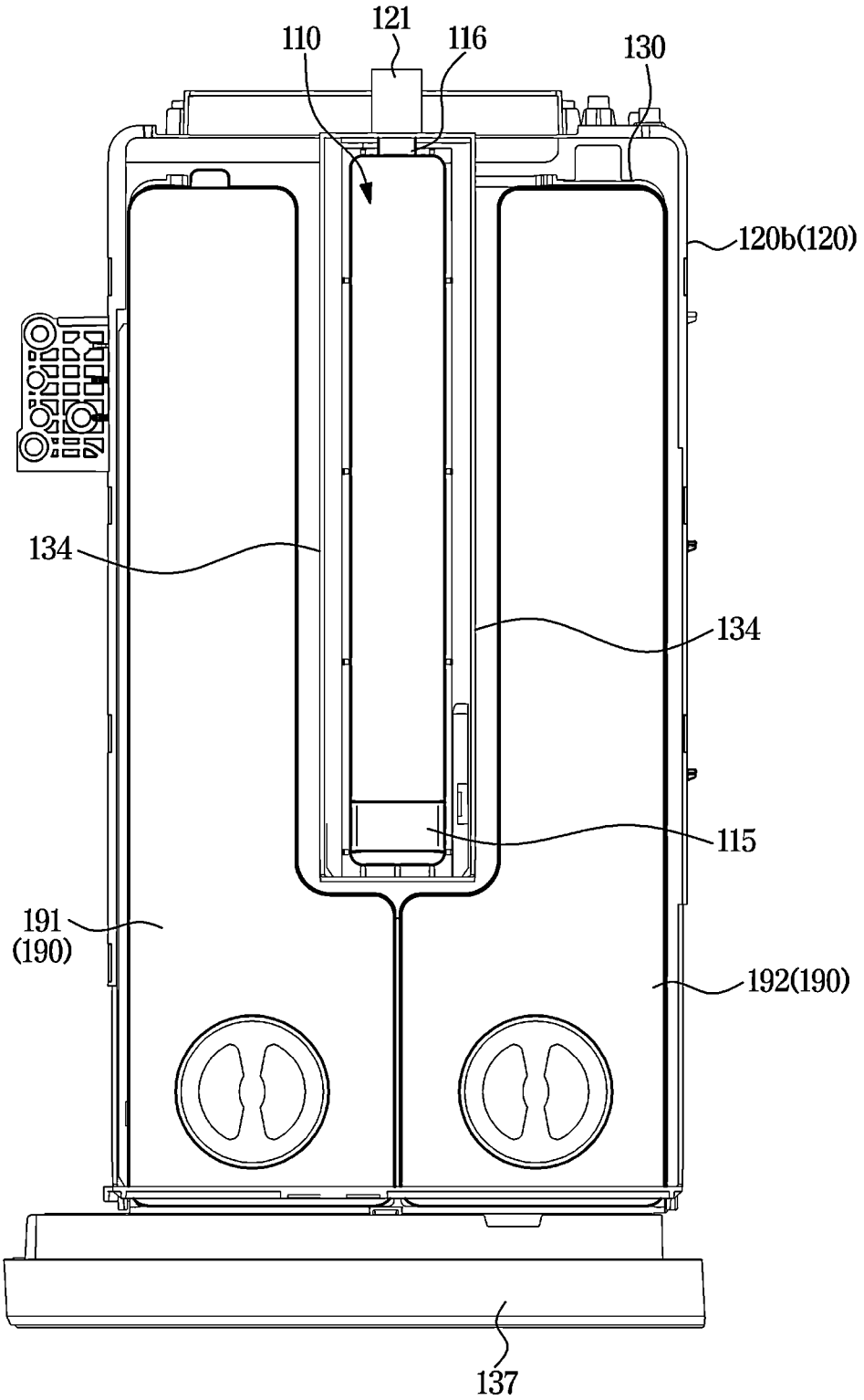
FIG. 14 is a plan view of an example of the detergent supply device according to one embodiment.

FIGS. 12 to 14 illustrate various arrangement examples of the filter 110 according to one embodiment. The same drawing numbers may represent parts or components performing substantially the same functions, and duplicate descriptions may be omitted.

For example, referring to FIGS. 12 to 14, the filter 110 may be provided to be arranged in a left-right direction (Y direction) with respect to a portion of the drawer 130 where the detergent is received. For example, the filter mounting portion 133 may be arranged parallel to the detergent receiving portion 132 in a direction substantially perpendicular to a direction into or from which the filter 110 is inserted or withdrawn.

For example, referring to FIG. 12, the filter 110 may be positioned on a side of the detergent box 190. The filter 110 may be positioned on the right side of the detergent box 190. The filter mounting portion 133 may be positioned on a side of the detergent receiving portion 132. The filter mounting portion 133 may be positioned on the right side of the detergent receiving portion 132. FIG. 12 illustrates that the detergent box 190 includes the first detergent box 191, the second detergent box 192, the third detergent box 193, and the fourth detergent box 194, but the present disclosure is not limited thereto. For example, the detergent box 190 may include at least one of the first detergent box 191, the second detergent box 192, the third detergent box 193, and the fourth detergent box 194. For example, the detergent box 190 may not be mounted in the drawer 130.

For example, referring to FIG. 13, the filter 110 may be positioned on a side of the detergent box 190. The filter 110 may be positioned on the left side of the detergent box 190. The filter mounting portion 133 may be positioned on a side of the detergent receiving portion 132. The filter mounting portion 133 may be positioned on the left side of the detergent receiving portion 132. FIG. 13 illustrates that the detergent box 190 includes the first detergent box 191, the second detergent box 192, the third detergent box 193, and the fourth detergent box 194, but the present disclosure is not limited thereto. For example, the detergent box 190 may include at least one of the first detergent box 191, the second detergent box 192, the third detergent box 193, and the fourth detergent box 194. For example, the detergent box 190 may not be mounted in the drawer 130.

For example, referring to FIG. 14, the filter 110 may mounted substantially in a central portion of the drawer 130.

For example, in a case in which a plurality of detergent boxes is provided in drawer 130, the filter 110 may be positioned between the plurality of detergent boxes. For example, the filter 110 may be positioned between the first detergent box 191 and the second detergent box 192. For example, the first detergent box 191 may receive the first detergent (e.g., liquid detergent, powder detergent, etc.), and the second detergent box 192 may receive the second detergent (e.g., fabric softener, rinse, etc.). For example, the first detergent box 191 may receive the second detergent, and the second detergent box 192 may receive the first detergent. For example, the first detergent box 191 and the second detergent box 192 may receive the first detergent. For example, the first detergent box 191 and the second detergent box 192 may receive the second detergent.

FIG. 14 illustrates that the detergent box 190 includes the first detergent box 191 and the second detergent box 192, but the present disclosure is not limited thereto. For example, the detergent box 190 may include at least one of the first detergent box 191, the second detergent box 192, the third detergent box 193, and the fourth detergent box 194. For example, the filter 110 may be positioned between the third detergent box 193 and the fourth detergent box 194. For example, the detergent box 190 may not be mounted in the drawer 130.

For example, in a case in which the filter is positioned at the rear of the detergent box, the filter 110 may be not exposed to the outside in the state in which the drawer is withdrawn from the drawer case. Accordingly, in order to withdraw the filter, the drawer needs to be completely removed from the drawer case. That is, the user may feel inconvenienced because the user needs to completely separate the drawer from the washing machine in order to clean and/or replace the filter. For example, in a case in which the detergent pump is connected to the rear of the detergent supply device, it may be difficult to position the filter at the rear of the drawer due to space constraints.

According to the present disclosure, the filter 110 may be positioned on a side of the detergent box 190. The filter 110 may be positioned on a side of the detergent receiving portion 132. Accordingly, the filter 110 may be exposed to the outside in the state in which the drawer 130 is withdrawn from the drawer case 120. Therefore, the user may easily take out the filter 110 from the drawer 130. That is, the user only needs to withdraw the drawer 130 from the drawer case 120 in order to clean and/or replace the filter 110. In other words, the user does not need to completely remove the drawer 130 from the drawer case 120 in order to clean and/or replace the filter 110. Additionally, a rear space of the drawer 130 may be secured. Thus, regardless of the presence or absence of the detergent pump 53, the filter 110 may be easily mounted in the drawer 130, or the filter 110 may be easily separated from the drawer 130. Ultimately, regardless of whether the detergent supply device 50 is an automatic detergent supply device, the filter 110 for filtering washing water may be applied to the detergent supply device 50.

FIGS. 15 to 23 illustrate cross-sections of various examples of the detergent supply device according to one embodiment. The same drawing numbers may represent parts or components performing substantially the same functions, and duplicate descriptions may be omitted.

Figure 15:
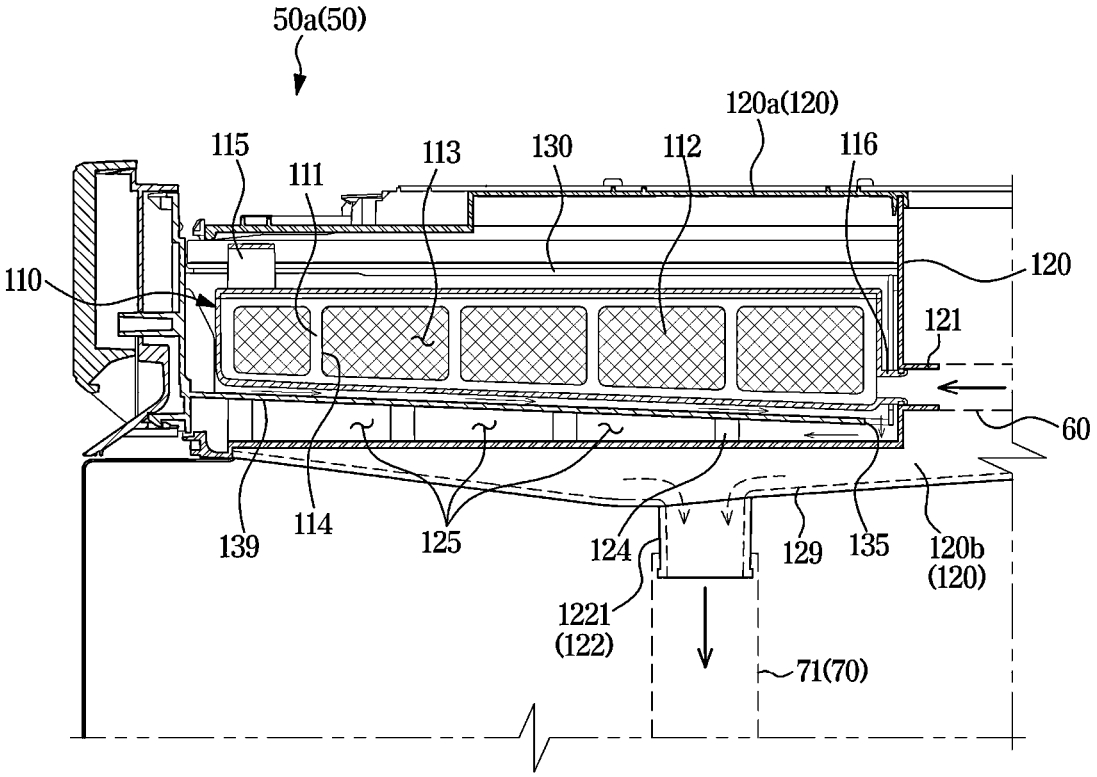
FIG. 15 is a cross-sectional view of an example of the detergent supply device according to one embodiment.

The example (50*a*) of the detergent supply device 50 will be described below with reference to FIG. 15. FIG. 15 illustrates an example in which the washing water passed through the filter 110 flows into the circulation pipe 71.

The detergent supply device 50*a* may include the drawer case 120, the drawer 130 provided to be accommodatable in the drawer case 120, and the filter 110 provided to be detachably mountable in drawer 130.

The drawer case 120 may include the inlet portion 121. The inlet portion 121 may be connected to the connection pipe 60. The inlet portion 121 may be provided to receive the washing water pumped from the pump device 80 through the connection pipe 60. For example, the connection pipe 60 may be provided as the first connection pipe 61.

The drawer case 120 may include the outlet portion 122. The outlet portion 122 may be connected to the discharge pipe 70. The outlet portion 122 may be provided to allow the washing water passed through the filter 110 to flow out to the discharge pipe 70. For example, the discharge pipe 70 may be provided as the circulation pipe 71.

The drawer 130 may include a first communication portion 135. The washing water passed through the filter 110 may flow from the filter mounting portion 133 to the drawer case 120 through the first communication portion 135. The drawer case 120 may include the second communication portion 125. The washing water flowed into the drawer case 120 through the first communication portion 135 may flow to the outlet portion 122 through the second communication portion 125.

The filter 110 may include the filter inlet port 116. The filter inlet port 116 may correspond to the inlet portion 121. The filter inlet port 116 may communicate with the inlet portion 121.

The washing water pumped by the pump device 80 may pass through the filter 110 and be guided to the tub 20. Washing water may flow to circulate through the tub 20, the pump device 80, and the filter 110. Washing water may flow to circulate through the tub 20, the pump device 80, and the filter 110.

The washing water pumped by the pump device 80 may flow to the detergent supply device 50*a* through the connection pipe 60. The washing water pumped by the pump device 80 may flow to the inlet portion 121 of the drawer case 120 through the connection pipe 60. The washing water passed through the inlet portion 121 of the drawer case 120 may flow toward the filter 110. The washing water passed through the inlet portion 121 of the drawer case 120 may flow to the inside of the filter 110 through the filter inlet port 116. The washing water inside the filter 110 may be filtered by the filter body 112 while flowing to the outside of the filter 110. While the washing water inside the filter 110 passes through the filter body 112 and then flows to the outside of the filter 110, foreign substances may be filtered out. The foreign substances may not pass through the filter body 112 and may be received in the collection space 113. The washing water passed through the filter 110 may flow to the first communication portion 135 along the inclined surface 139. The washing water passed through the filter 110 may flow from the inside of the drawer 130 to the inside of the drawer case 120 through the first communication portion 135. The washing water passed through the first communication portion 135 may flow between the drawer 130 and the drawer case 120. The washing water passed through the first communication portion 135 may flow along the inclined surface 129. The washing water flowed between the drawer 130 and the drawer case 120 may pass through the second communication portion 125 and then flow to the outlet portion 122 of the drawer case 120. The washing water flowed out through the outlet portion 122 of the drawer case 120 may flow into the circulation pipe 71. The circulation pipe 71 may guide the washing water to the tub 20. This flow of washing water may also be applied to examples, which will be described later.

An example (50*b*) of the detergent supply device 50 will be described below with reference to FIG. 16.

The example (50*b*) of the detergent supply device 50 will be described below with reference to FIG. 16. FIG. 16 illustrates an example in which the washing water passed through the filter 110 flows to the drain pipe 72.

A detergent supply device 50*b* may include the drawer case 120, the drawer 130 provided to be accommodatable in the drawer case 120, and the filter 110 provided to be detachably mountable in the drawer 130.

The drawer case 120 may include the inlet portion 121. The inlet portion 121 may be connected to the connection pipe 60. The inlet portion 121 may be provided to receive the washing water pumped from the pump device 80 through the connection pipe 60. For example, the connection pipe 60 may be provided as the second connection pipe 62.

The drawer case 120 may include the outlet portion 122. The outlet portion 122 may be connected to the discharge pipe 70. The outlet portion 122 may be provided to allow the washing water passed through the filter 110 to flow out to the discharge pipe 70.

The outlet portion 122 may include a first outlet port 1221 connected to the circulation pipe 71. The outlet portion 122 may include a second outlet port 1222 connected to the drain pipe 72.

The drawer 130 may include the first communication portion 135. The washing water passed through the filter 110 may flow from the filter mounting portion 133 to the drawer case 120 through the first communication portion 135. Compared to the example illustrated in FIG. 15, the drawer case 120 may not include the second communication portion 125.

The filter 110 may include the filter inlet port 116. The filter inlet port 116 may correspond to the inlet portion 121. The filter inlet port 116 may communicate with the inlet portion 121.

The washing water pumped by the pump device 80 may pass through the filter 110 and be guided to the outside of the housing 10. The washing water inside the tub 20 may be drained to the outside of the housing 10 after passing through the filter 110. The washing water inside the tub 20 may pass through the filter 110 and then be drained to the outside of the housing 10.

The washing water pumped by the pump device 80 may flow to the detergent supply device 50*b* through the connection pipe 60. The washing water pumped by the pump device 80 may flow to the inlet portion 121 of the drawer case 120 through the connection pipe 60. The washing water passed through the inlet portion 121 of the drawer case 120 may flow toward the filter 110. The washing water passed through the inlet portion 121 of the drawer case 120 may flow to the inside of the filter 110 through the filter inlet port 116. The washing water inside the filter 110 may be filtered by the filter body 112 while flowing to the outside of the filter 110. While the washing water inside the filter 110 passes through the filter body 112 and then flows to the outside of the filter 110, foreign substances may be filtered out. The foreign substances may not pass through the filter body 112 and may be received in the collection space 113. The washing water passed through the filter 110 may flow to the first communication portion 135 along the inclined surface 139. The washing water passed through the filter 110 may flow from the inside of the drawer 130 to the inside of the drawer case 120 through the first communication portion 135. The washing water passed through the first communication portion 135 may flow to the second outlet port 1222 of drawer case 120. The washing water flowed out through the second outlet port 1222 may flow to the drain pipe 72. The drain pipe 72 may guide the washing water to the outside of the housing 10. This flow of washing water may also be applied to examples, which will be described later.

Figure 16:
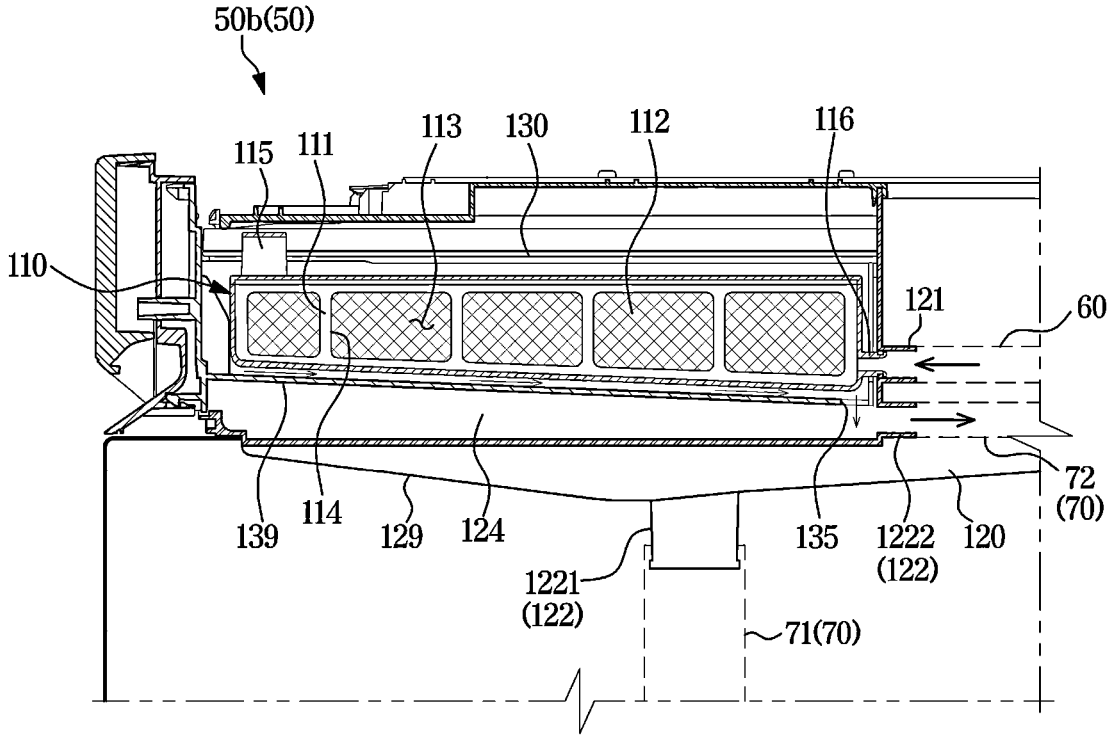
FIG. 16 is a cross-sectional view of an example of the detergent supply device according to one embodiment.

In the example illustrated in FIG. 16, the washing water passed through the first communication portion 135 may not flow to the first outlet port 1221 by the wall part 124. Accordingly, the first outlet port 1221 may not allow the washing water passed through the filter 110 to flow out. The first outlet port 1221 may allow the detergent received in the drawer 130 to flow out. The first outlet port 1221 may allow the washing water introduced through the water supply port 126 to flow out.

Figure 17:
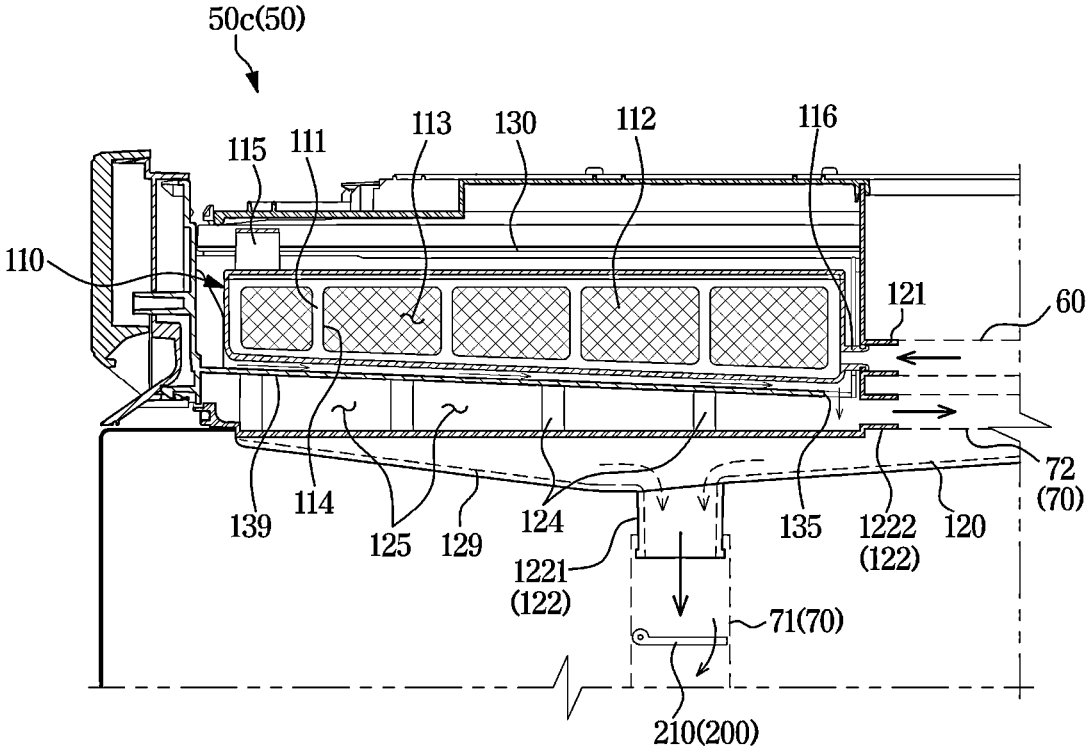
FIG. 17 is a cross-sectional view of an example of the detergent supply device according to one embodiment.

An example (50*c*) of the detergent supply device 50 will be described below with reference to FIG. 17. FIG. 17 illustrates an example in which the washing water passed through the filter 110 flows to the circulation pipe 71 or the drain pipe 72.

A detergent supply device 50*c* may include the drawer case 120, the drawer 130 provided to be accommodatable in the drawer case 120, and the filter 110 provided to be detachably mountable in the drawer 130.

The drawer case 120 may include the inlet portion 121. The inlet portion 121 may be connected to the connection pipe 60. The inlet portion 121 may be provided to receive the washing water pumped from the pump device 80 through the connection pipe 60. For example, the connection pipe 60 may be a pipe in which the first connection pipe 61 and the second connection pipe 62 are combined.

The drawer case 120 may include the outlet portion 122. The outlet portion 122 may be connected to the discharge pipe 70. The outlet portion 122 may be provided to allow the washing water passed through the filter 110 to flow out to the discharge pipe 70.

The outlet portion 122 may include the first outlet port 1221 connected to the circulation pipe 71. The outlet portion 122 may include the second outlet port 1222 connected to the drain pipe 72.

For example, the first outlet port 1221 may be positioned lower than the second outlet port 1222. For example, the second outlet port 1222 may be positioned higher than the first outlet port 1221. For example, the circulation pipe 71 may be positioned lower than the drain pipe 72. For example, the drain pipe 72 may be positioned higher than the circulation pipe 71. With this arrangement, the detergent supply device 50*c* and the tub 20 may be easily connected by the circulation pipe 71. Additionally, interference between the circulation pipe 71 and the drain pipe 72 may be minimized.

The drawer 130 may include the first communication portion 135. The washing water passed through the filter 110 may flow from the filter mounting portion 133 to the drawer case 120 through the first communication portion 135. The drawer case 120 may include the second communication portion 125. The washing water flowed to the drawer case 120 through the first communication portion 135 may flow to the outlet portion 122 through the second communication portion 125.

The filter 110 may include the filter inlet port 116. The filter inlet port 116 may correspond to the inlet portion 121. The filter inlet port 116 may communicate with the inlet portion 121.

The washing machine 1 may include a flow path switching device 200. The flow path switching device 200 may be provided in a case in which the filter 110 communicates with both the circulation pipe 71 and the drain pipe 72. The flow path switching device 200 may be provided to flow the washing water passed through the filter 110 to the circulation pipe 71 or to flow the washing water passed through the filter 110 to the drain pipe 72. For example, the flow path switching device 200 may be controlled by a controller 330, which will be described later.

For example, the flow path switching device 200 may include a first valve 210.

The first valve 210 may be provided to open and close the circulation pipe 71. The first valve 210 may be provided to regulate a flow rate of washing water flowing through the circulation pipe 71. The first valve 210 may be installed on the circulation pipe 71. For example, the first valve 210 may open and close the circulation pipe 71 by rotating. The first valve 210 may be referred to as the circulation valve 210.

The first valve 210 may be controlled by the controller 330.

For example, the controller 330 may close the first valve 210 in a drainage process. For example, the controller 330 may open the first valve 210 based on completion of the drainage process. For example, the controller 330 may open the first valve 210 in the washing process and/or the rinsing process. For example, the controller 330 may open the first valve 210 based on an operation of the circulation pump 81. For example, the controller 330 may close the first valve 210 based on an operation of the drainage pump 82.

When the first valve 210 is opened, the washing water passed through the filter 110 may flow to the tub 20 through the circulation pipe 71. When the first valve 210 is opened, the washing water passed through the filter 110 may naturally flow toward the first outlet port 1221 because the first outlet port 1221 is positioned lower than the second outlet port 1222. The washing water flowed out from the first outlet port 1221 may be guided to the tub 20 by the circulation pipe 71.

When the first valve 210 is closed, the washing water passed through the filter 110 may flow to the outside of the housing 10. When the first valve 210 is closed, the washing water may not flow into the circulation pipe 71. Accordingly, the washing water passed through the filter 110 may flow naturally toward the second outlet port 1222. The washing water flowed out from the second outlet port 1222 may be guided to the outside of the housing 10 by the drain pipe 72.

Figure 18:
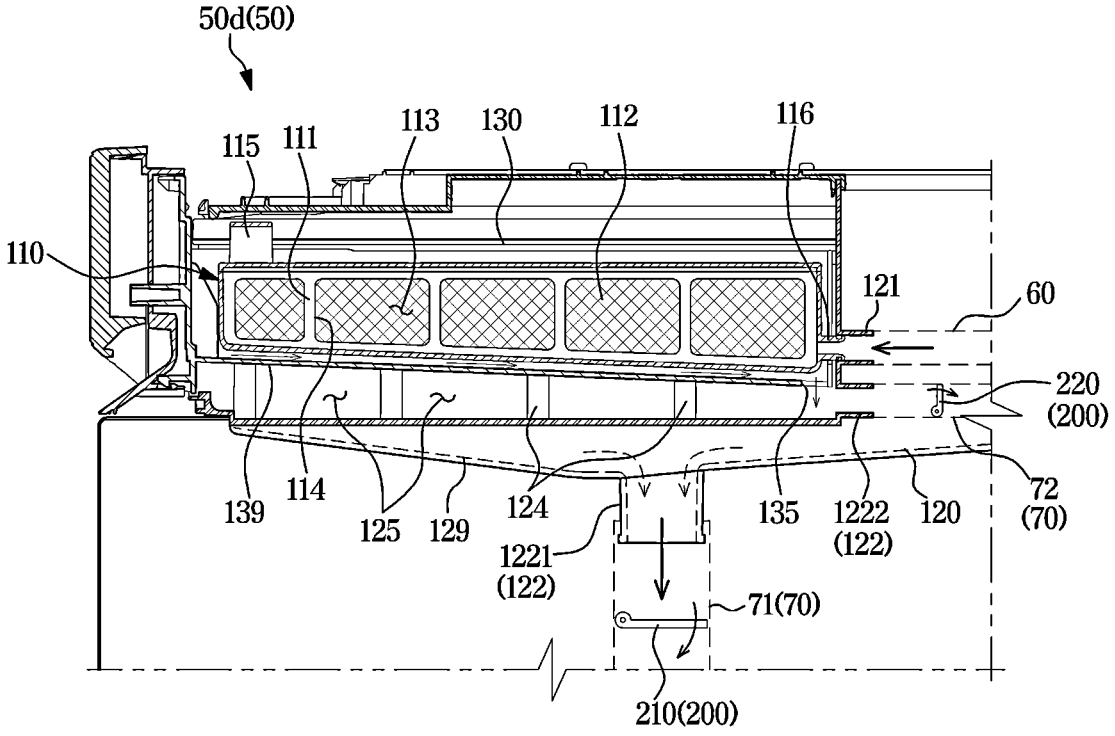
FIG. 18 is a cross-sectional view of an example of the detergent supply device according to one embodiment.

An example (50*d*) of the detergent supply device 50 will be described below with reference to FIG. 18. FIG. 18 illustrates an example in which the washing water passed through the filter 110 flows to the circulation pipe 71 or the drain pipe 72. Compared to FIG. 17, a second valve 220 may be additionally provided. Descriptions that overlap with those of FIG. 17 will be omitted.

The second valve 220 may be provided to open and close the drain pipe 72. The second valve 220 may be provided to regulate a flow rate of washing water flowing through the drain pipe 72. The second valve 220 may be installed on the drain pipe 72. For example, the second valve 220 may be provided to open and close the drain pipe 72 by rotating. The second valve 220 may be referred to as the drain valve 220.

The first valve 210 and the second valve 220 may be provided to be selectively opened. For example, the first valve 210 may be opened and the second valve 220 may be closed. For example, the first valve 210 may be closed and the second valve 220 may be opened.

The second valve 220 may be controlled by the controller 330.

For example, the controller 330 may close the first valve 210 and open the second valve 220 in the drainage process. For example, the controller 330 may open the first valve 210 and close the second valve 220 based on the completion of the drainage process. For example, the controller 330 may open the first valve 210 and close the second valve 220 in the washing process and/or the rinsing process. For example, the controller 330 may open the first valve 210 and close the second valve 220 based on the operation of the circulation pump 81. For example, the controller 330 may close the first valve 210 and open the second valve 220 based on the operation of the drainage pump 82.

When the first valve 210 is opened and the second valve 220 is closed, the washing water passed through the filter 110 may flow to the tub 20 through the circulation pipe 71.

When the first valve 210 is closed and the second valve 220 is opened, the washing water passed through the filter 110 may flow to the outside of the housing 10 through the drain pipe 72.

However, the present disclosure is not limited to the examples illustrated in FIGS. 17 and 18. The second outlet port 1222 may be positioned lower than the first outlet port 1221. The drain pipe 72 may be positioned lower than the circulation pipe 71. In this case, the flow path switching device 200 may include the second valve 220 instead of the first valve 210, or may include both the first valve 210 and the second valve 220.

Figure 19:
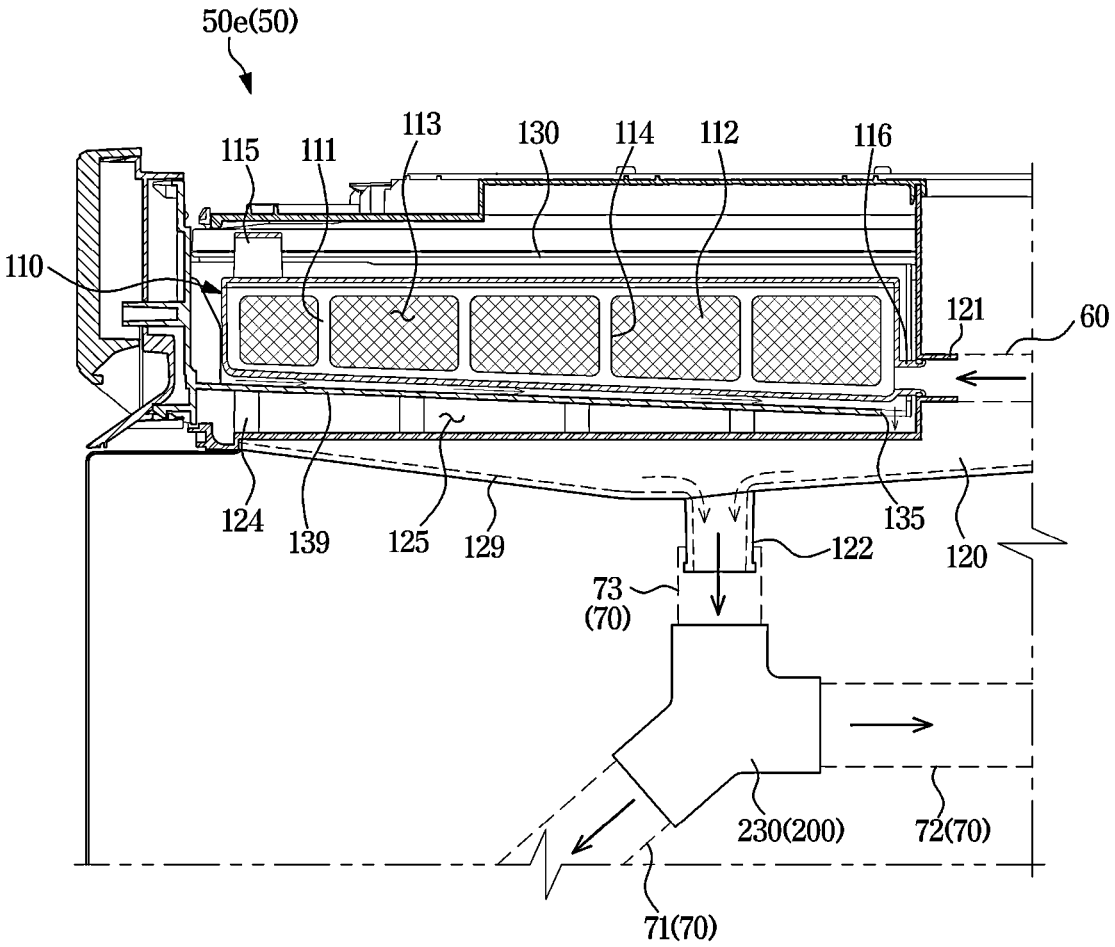
FIG. 19 is a cross-sectional view of an example of the detergent supply device according to one embodiment.

An example (50*e*) of the detergent supply device 50 will be described below with reference to FIG. 19. FIG. 19 illustrates an example in which the washing water passed through the filter 110 flows to the circulation pipe 71 or the drain pipe 72.

A detergent supply device 50*e* may include the drawer case 120, the drawer 130 provided to be accommodatable in the drawer case 120, and the filter 110 provided to be detachably mountable in the drawer 130.

The drawer case 120 may include the inlet portion 121. The inlet portion 121 may be connected to the connection pipe 60. The inlet portion 121 may be provided to receive the washing water pumped from the pump device 80 through the connection pipe 60. For example, the connection pipe 60 may be a pipe in which the first connection pipe 61 and the second connection pipe 62 are combined.

The drawer case 120 may include the outlet portion 122. The outlet portion 122 may be connected to the discharge pipe 70. The outlet portion 122 may be provided to allow the washing water passed through the filter 110 to flow out to the discharge pipe 70.

The discharge pipe 70 may include a main pipe 73 extending from the outlet portion 122. The discharge pipe 70 may include the circulation pipe 71 and the drain pipe 72. The circulation pipe 71 and the drain pipe 72 may be provided to be branched from the main pipe 73. For example, it may also be understood that the main pipe 73 and the circulation pipe 71 are provided integrally and the drain pipe 72 is branched from the circulation pipe 71. For example, it may also be understood that the main pipe 73 and the drain pipe 72 are provided integrally and the circulation pipe 71 is branched from the drain pipe 72.

The flow path switching device 200 may include a third valve 230 provided at a branch point of the circulation pipe 71 and the drain pipe 72. The third valve 230 may selectively open the circulation pipe 71 and the drain pipe 72. The third valve 230 may open any one of the circulation pipe 71 and the drain pipe 72. For example, the third valve 230 may be provided as a Y-type switching valve.

The third valve 230 may be controlled by the controller 330.

For example, the controller 330 may control the third valve 230 to close the circulation pipe 71 and open the drain pipe 72 in the drainage process. For example, the controller 330 may control the third valve 230 to open the circulation pipe 71 and close the drain pipe 72 based on the completion of the drainage process. For example, the controller 330 may control the third valve 230 to open the circulation pipe 71 and close the drain pipe 72 during the washing process and/or the rinsing process. For example, the controller 330 may control the third valve 230 to open the circulation pipe 71 and close the drain pipe 72 based on the operation of the circulation pump 81. For example, the controller 330 may control the third valve 230 to close the circulation pipe 71 and open the drain pipe 72 based on the operation of the drainage pump 82.

When the circulation pipe 71 is opened and the drain pipe 72 is closed, the washing water passed through the filter 110 may flow to the tub 20 through the circulation pipe 71.

When the circulation pipe 71 is closed and the drain pipe 72 is opened, the washing water passed through the filter 110 may flow to the outside of the housing 10 through the drain pipe 72.

Figure 20:
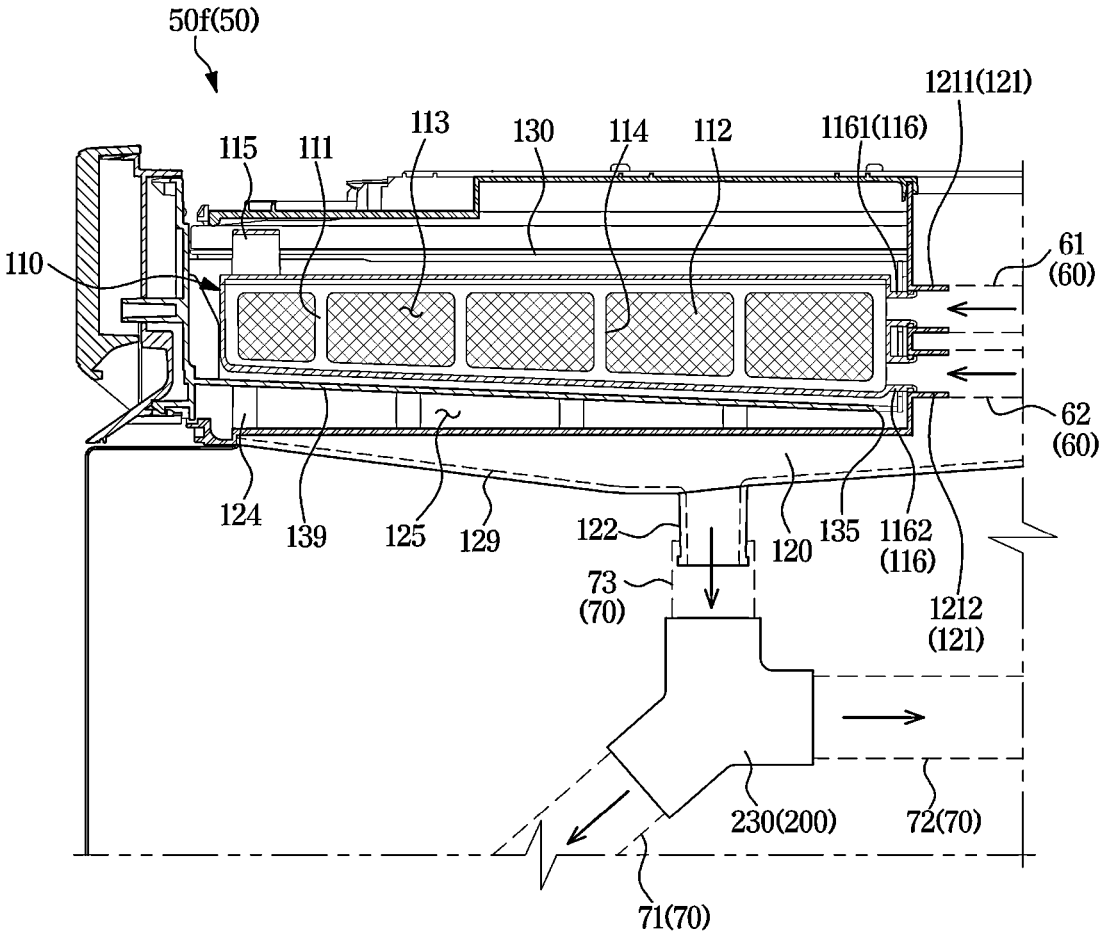
FIG. 20 is a cross-sectional view of an example of the detergent supply device according to one embodiment.

An example (50*f*) of the detergent supply device 50 will be described below with reference to FIG. 20. FIG. 20 illustrates an example in which the washing water passed through the filter 110 flows to the circulation pipe 71 or the drain pipe 72. Descriptions that overlap with those of FIG. 19 will be omitted.

Compared to FIG. 19, the connection pipe 60 may include the first connection pipe 61 and the second connection pipe 62. The first connection pipe 61 may guide the washing water pumped from the circulation pump 81 to a detergent supply device 50*f*. The second connection pipe 62 may guide the washing water pumped from the drainage pump 82 to the detergent supply device 50*f*.

Compared to FIG. 19, the inlet portion 121 may include a first inlet port 1211 connected to the first connection pipe 61 and a second inlet port 1212 connected to the second connection pipe 62. The first inlet port 1211 may receive washing water from the first connection pipe 61. The second inlet port 1212 may receive washing water from the second connection pipe 62.

FIG. 20 illustrates that the first inlet port 1211 and the second inlet port 1212 are spaced apart in an up-down direction (Z direction), but the present disclosure is not limited thereto. The first inlet port 1211 and the second inlet port 1212 may be provided to be positioned at the same height. The first inlet port 1211 and the second inlet port 1212 may be spaced apart in the left-right direction (Y direction). Likewise, the first connection pipe 61 and the second connection pipe 62 may be provided to be positioned at the same height. The first connection pipe 61 and the second connection pipe 62 may be spaced apart in the left-right direction (Y direction).

Compared to FIG. 19, the filter inlet port 116 may include a first filter inlet port 1161 corresponding to the first inlet port 1211, and a second filter inlet port 1162 corresponding to the second inlet port 1212. As the drawer 130 is inserted into the drawer case 120, the first filter inlet port 1161 may be docked to the first inlet port 1211. As the drawer 130 is inserted into the drawer case 120, the second filter inlet port 1162 may be docked to the second inlet port 1212.

Figure 21:
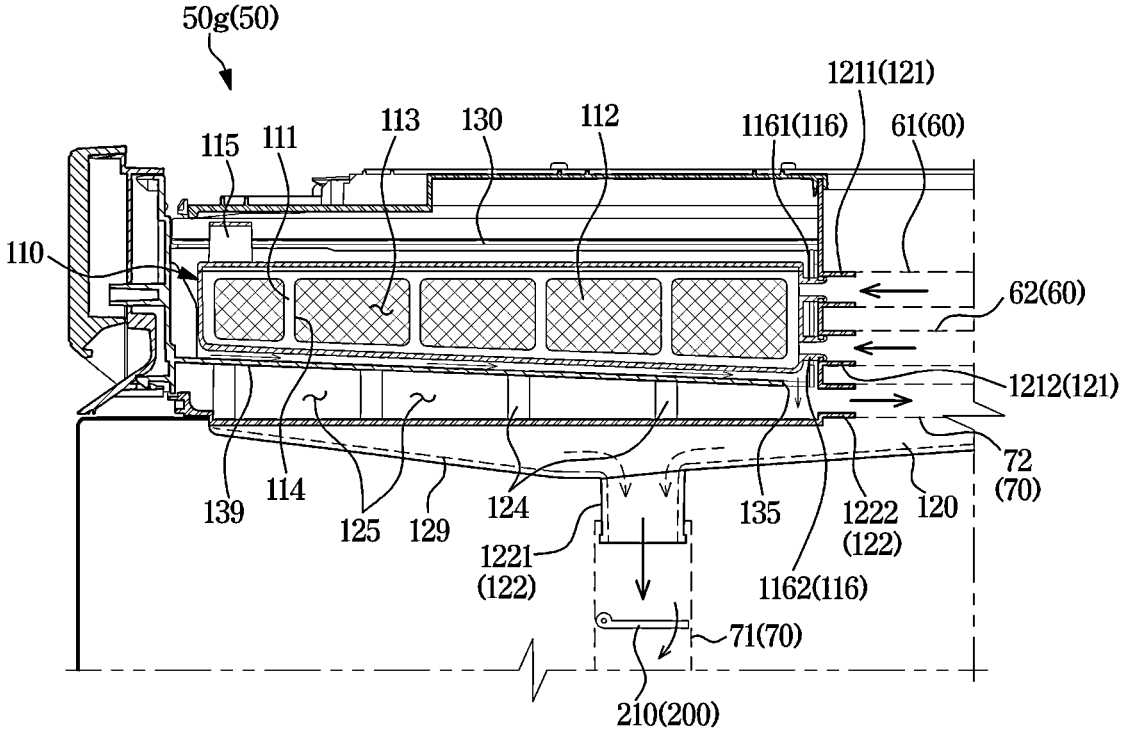
FIG. 21 is a cross-sectional view of an example of the detergent supply device according to one embodiment.

An example (50*g*) of the detergent supply device 50 will be described below with reference to FIG. 21. FIG. 21 illustrates an example in which the washing water passed through the filter 110 flows to the circulation pipe 71 or the drain pipe 72.

A detergent supply device 50*g* may include the drawer case 120, the drawer 130 provided to be accommodatable in the drawer case 120, and the filter 110 provided to be detachably mountable in the drawer 130.

The drawer case 120 may include the inlet portion 121. The inlet portion 121 may include the first inlet port 1211 connected to the first connection pipe 61 and the second inlet port 1212 connected to the second connection pipe 62. The first inlet port 1211 may receive washing water from the first connection pipe 61. The second inlet port 1212 may receive washing water from the second connection pipe 62.

The drawer case 120 may include the outlet portion 122. The outlet portion 122 may be connected to the discharge pipe 70. The outlet portion 122 may be provided to allow the washing water passed through the filter 110 to flow out to the discharge pipe 70. The outlet portion 122 may include the first outlet port 1221 connected to the circulation pipe 71. The outlet portion 122 may include the second outlet port 1222 connected to the drain pipe 72.

The washing water pumped by the circulation pump 81 may be guided to the first inlet port 1211 by the first connection pipe 61. The washing water flowed through the first inlet port 1211 may pass through the filter 110 and then flow into the circulation pipe 71.

The washing water pumped by the drainage pump 82 may be guided to the second inlet port 1212 by the second connection pipe 62. The washing water introduced through the second inlet port 1212 may pass through the filter 110 and then flow to the drain pipe 72.

The flow path switching device 200 may include a first valve 210. The first valve 210 may be provided to open and close the circulation pipe 71. The first valve 210 may be controlled by the controller 330. When the first valve 210 is opened, the washing water passed through the filter 110 may flow to the tub 20 through the circulation pipe 71. When the first valve 210 is closed, the washing water passed through the filter 110 may flow to the outside of the housing 10 through the drain pipe 72. Because the first valve 210 has been described above, a detailed description thereof will be omitted.

Figure 22:
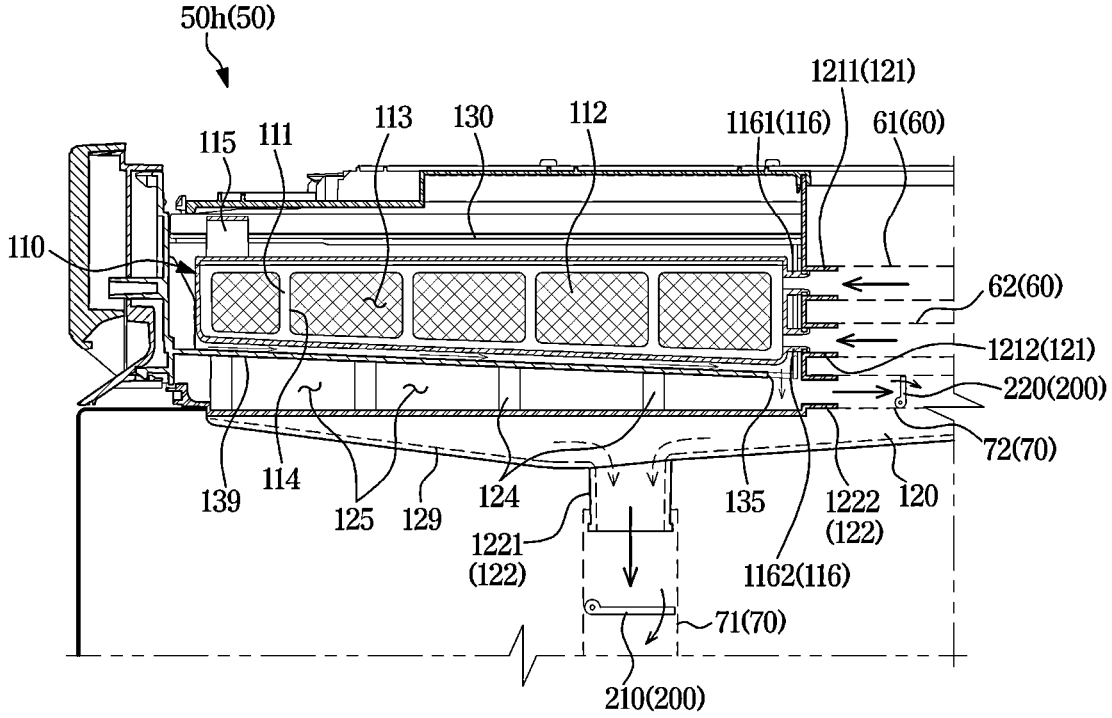
FIG. 22 is a cross-sectional view of an example of the detergent supply device according to one embodiment.

An example (50*h*) of the detergent supply device 50 will be described below with reference to FIG. 22. FIG. 22 illustrates an example in which the washing water passed through the filter 110 flows to the circulation pipe 71 or the drain pipe 72. Compared to FIG. 21, the second valve 220 may be additionally provided. Descriptions that overlap with those of FIG. 21 will be omitted.

The flow path switching device 200 may include the first valve 210 and the second valve 220. The second valve 220 may be provided to open and close the drain pipe 72. The second valve 220 may be controlled by the controller 330. When the first valve 210 is opened and the second valve 220 is closed, the washing water passed through the filter 110 may flow to the tub 20 through the circulation pipe 71. When the first valve 210 is closed and the second valve 220 is opened, the washing water passed through the filter 110 may flow to the outside of the housing 10 through the drain pipe 72.

Figure 23:
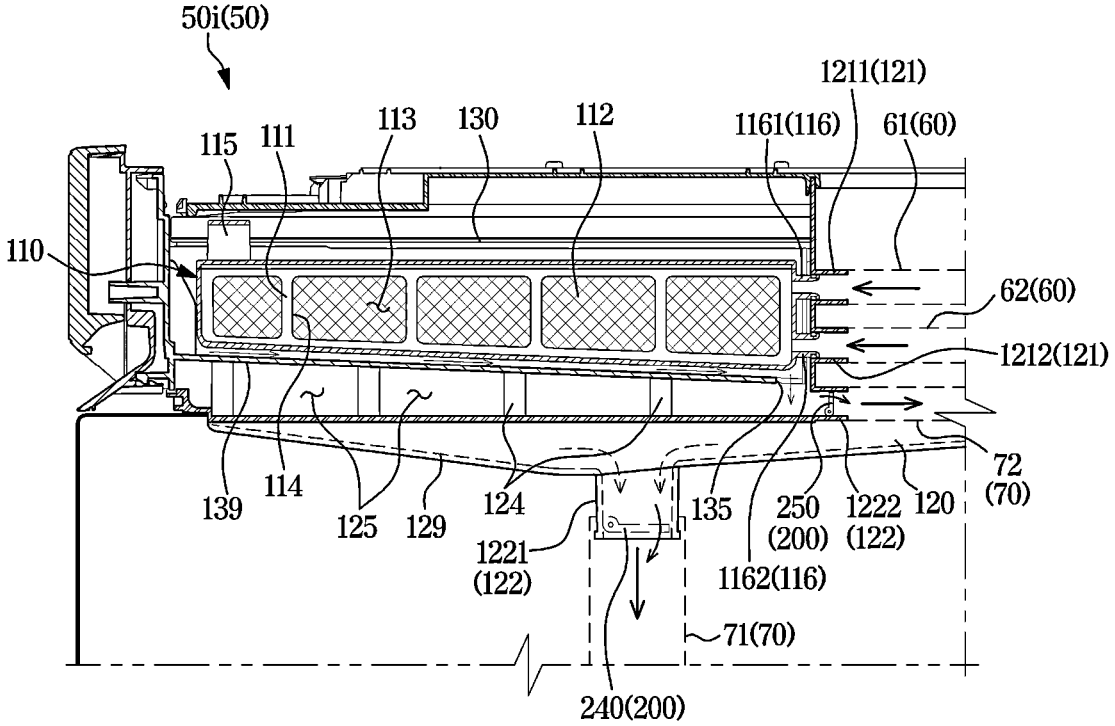
FIG. 23 is a cross-sectional view of an example of the detergent supply device according to one embodiment.

An example (50*i*) of the detergent supply device 50 will be described below with reference to FIG. 23. FIG. 23 illustrates an example in which the washing water passed through the filter 110 flows to the circulation pipe 71 or the drain pipe 72. Compared to FIG. 22, instead of the first valve 210 and the second valve 220, a fourth valve 240 may be additionally provided. Compared to FIG. 22, instead of the first valve 210 and the second valve 220, a fifth valve 250 may be additionally provided.

The flow path switching device 200 may include the fourth valve 240. The fourth valve 240 may be installed in a detergent supply device 50*i*. The fourth valve 240 may be provided to open and close the first outlet port 1221. The fourth valve 240 may open and close the first outlet port 1221 by rotating.

The flow path switching device 200 may include the fifth valve 250. The fifth valve 250 may be installed in the detergent supply device 50*i*. The fifth valve 250 may be provided to open and close the second outlet port 1222. The fifth valve 250 may open and close the second outlet port 1222 by rotating.

The fourth valve 240 and the fifth valve 250 may be provided to be selectively opened. For example, the fourth valve 240 may be opened and the fifth valve 250 may be closed. For example, the fourth valve 240 may be closed and the fifth valve 250 may be opened.

The fourth valve 240 may be controlled by the controller 330.

The fifth valve 250 may be controlled by the controller 330.

For example, the controller 330 may close the fourth valve 240 and open the fifth valve 250 in the drainage process. For example, the controller 330 may open the fourth valve 240 and close the fifth valve 250 based on the completion of the drainage process. For example, the controller 330 may open the fourth valve 240 and close the fifth valve 250 in the washing process and/or the rinsing process. For example, the controller 330 may open the fourth valve 240 and close the fifth valve 250 based on the operation of the circulation pump 81. For example, the controller 330 may close the fourth valve 240 and open the fifth valve 250 based on the operation of the drainage pump 82.

When the fourth valve 240 is opened and the fifth valve 250 is closed, the washing water passed through the filter 110 may flow to the tub 20 through the circulation pipe 71.

When the fourth valve 240 is closed and the fifth valve 250 is opened, the washing water passed through the filter 110 may flow to the outside of the housing 10 through the drain pipe 72.

Unlike that illustrated in FIG. 23, at least one of the fourth valve 240 and the fifth valve 250 may be omitted. For example, when washing water naturally flows toward the first outlet port 1221 as the first outlet port 1221 is positioned lower than the second outlet port 1222, the flow path switching device 200 may include only the fourth valve 240. For example, when washing water naturally flows toward the second outlet port 1222 as the second outlet port 1222 is positioned lower than the first outlet port 1221, the flow path switching device 200 may include only the fifth valve 250.

Figure 24:
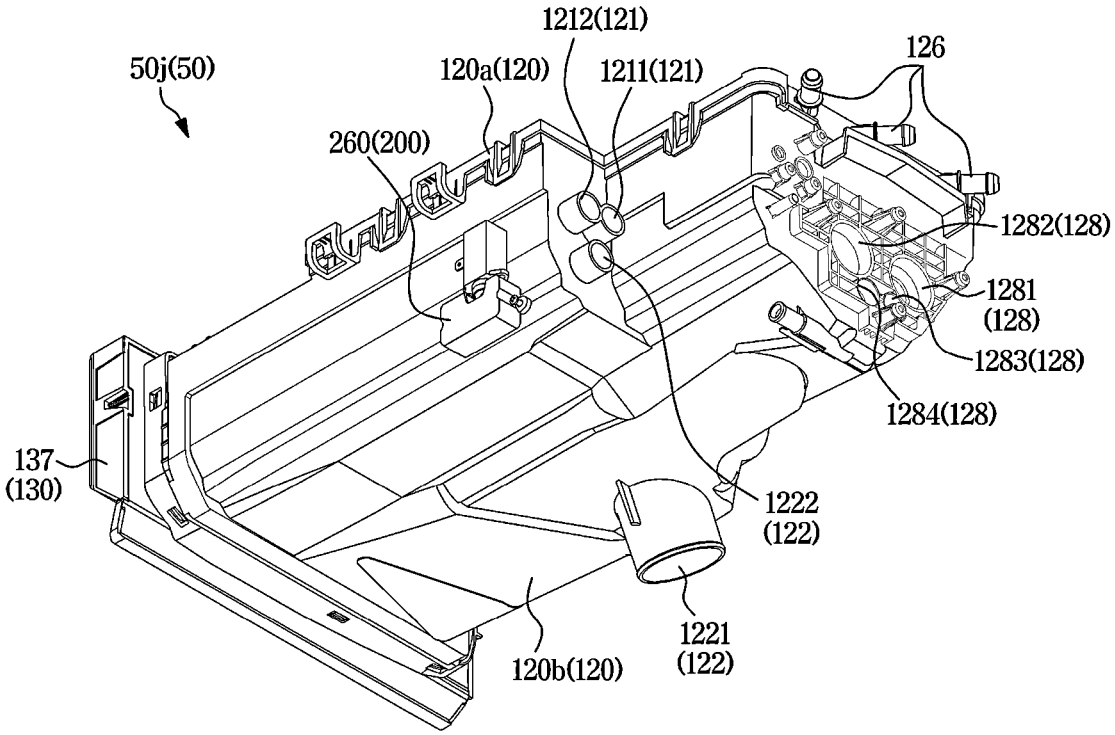
FIG. 24 is a perspective view of an example of the detergent supply device according to one embodiment.
Figure 25:
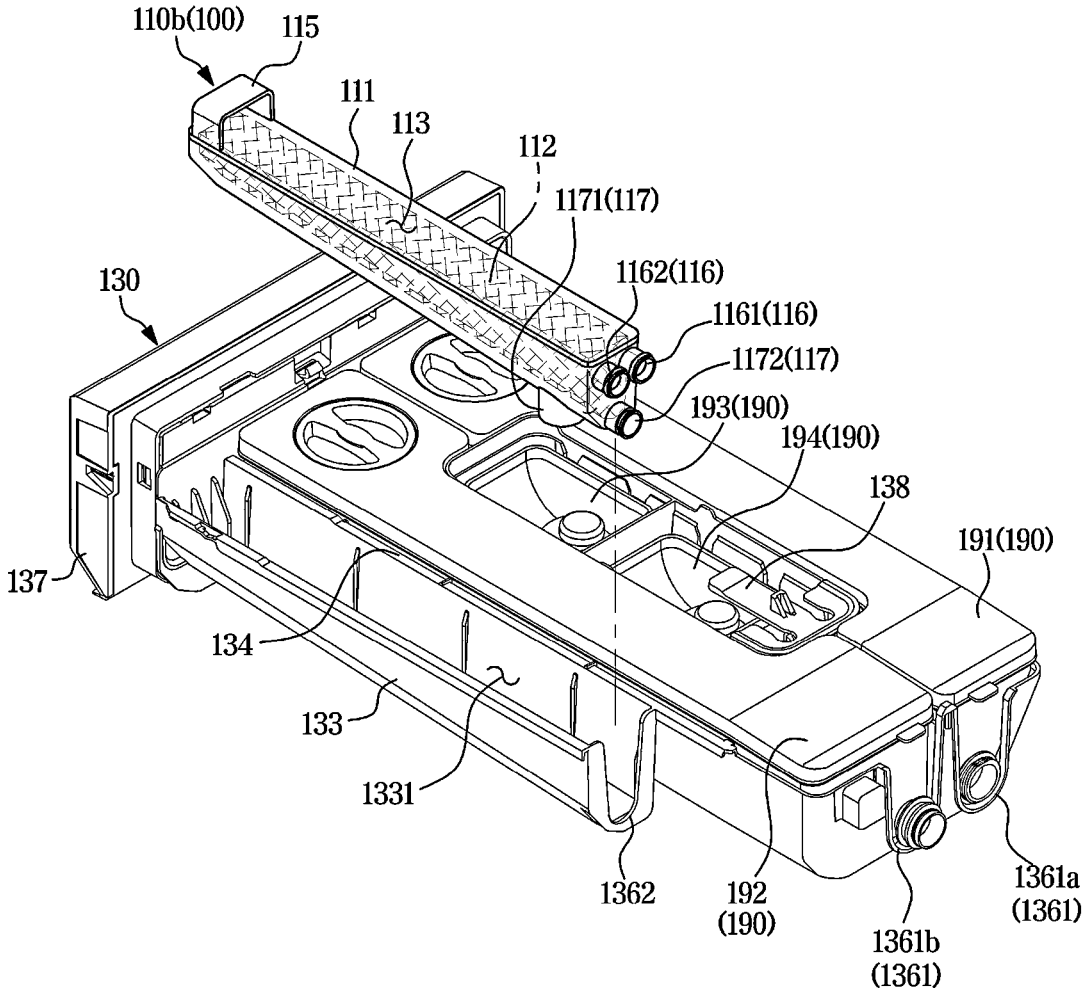
FIG. 25 is a view illustrating the drawer, the detergent box, and the filter illustrated in FIG. 24.
Figure 26:
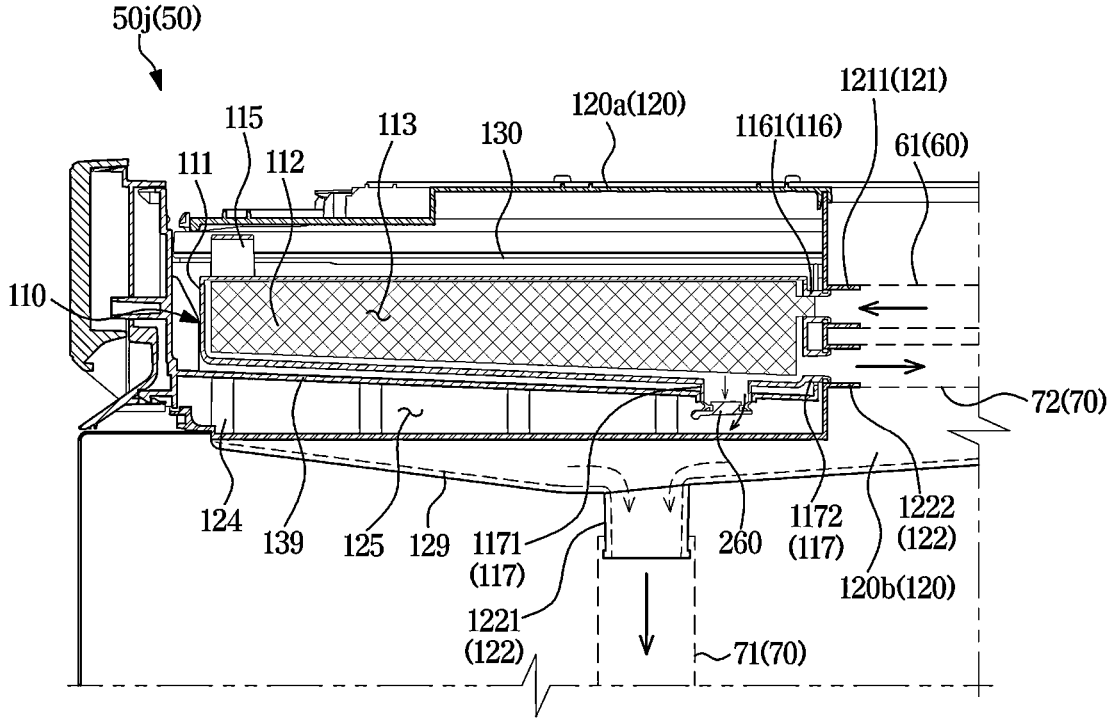
FIG. 26 is a cross-sectional view of an example of the detergent supply device illustrated in FIG. 24.

FIG. 24 is a perspective view of an example of the detergent supply device according to one embodiment. FIG. 25 is a view illustrating the drawer, the detergent box, and the filter illustrated in FIG. 24. FIG. 26 is a cross-sectional view of an example of the detergent supply device illustrated in FIG. 24.

An example (50*j*) of the detergent supply device 50 will be described below with reference to FIGS. 24 to 26. FIG. 26 illustrates an example in which the washing water passed through the filter 110 flows to the circulation pipe 71 or the drain pipe 72. The same drawing numbers may represent parts or components performing substantially the same functions, and duplicate descriptions may be omitted.

A detergent supply device 50*j* may include the drawer case 120, the drawer 130 provided to be accommodatable in the drawer case 120, and the filter 110 provided to be detachably mountable in the drawer 130.

The drawer 130 may be provided to be insertable into or withdrawable from the drawer case 120. The filter 110 may be provided to be insertable into or withdrawal from the drawer case 120 in the state of being mounted in the drawer 130.

The drawer case 120 may include the inlet portion 121. The inlet portion 121 may be connected to the pump device 80. The inlet portion 121 may be connected to the pump device 80 through the connection pipe 60.

For example, the inlet portion 121 may include the first inlet port 1211 connected to the first connection pipe 61. The inlet portion 121 may include the second inlet port 1212 connected to the second connection pipe 62. FIG. 26 illustrates that the inlet portion 121 includes the first inlet port 1211 and the second inlet port 1212, but the inlet portion 121 is not limited thereto and may be provided as a single configuration.

The drawer case 120 may include the outlet portion 122. The outlet portion 122 may be provided to allow the washing water and/or the detergent to flow out. The outlet portion 122 may be provided to allow the washing water passed through the filter 110 to flow out. The outlet portion 122 may be connected to the outside of the tub 20 and/or housing 10. The outlet portion 122 may be connected to the outside of the tub 20 and/or housing 10 through the discharge pipe 70. The outlet portion 122 may be provided to allow the washing water passed through the filter 110 to flow out to the discharge pipe 70. The outlet portion 122 may be provided to allow the washing water passed through the filter 110 to flow out to the circulation pipe 71 or the drain pipe 72. The outlet portion 122 may be provided to allow the detergent received in the drawer 130 to flow out to the circulation pipe 71.

For example, the outlet portion 122 may include the first outlet port 1221 connected to the circulation pipe 71 and the second outlet port 1222 connected to the drain pipe 72. The washing water flowed out from the first outlet port 1221 may flow to the tub 20 through the circulation pipe 71. The washing water flowed out from the second outlet port 1222 may flow to the outside of the housing 10 through the drain pipe 72.

An example (110*b*) of the filter 110 will be described below with reference to FIG. 25.

The filter 110 may be provided to filter the washing water introduced from the pump device 80. The filter 110 may be provided to collect foreign substances contained in the washing water introduced from the pump device 80. For example, the filter 110 may be provided to collect microplastics contained in the washing water introduced from the pump device 80. As the washing machine 1 includes the filter 110, foreign substances (e.g., microplastics, etc.) contained in washing water may be prevented from being discharged to the outside of the housing 10. For example, the filter 110 may include a fine filter.

The filter 110 may include the filter frame 111 and the filter body 112 accommodated in the filter frame 111.

The filter frame 111 may be provided to form the exterior of the filter 110. The filter frame 111 may be referred to as the filter case 111. The filter frame 111 may be referred to as the filter housing 111.

The filter body 112 may be provided to collect foreign substances in washing water. Foreign substances contained in the washing water passing through the filter 110 may adhere to the filter body 112. For example, the filter body 112 may be provided in a mesh shape. For example, the filter body 112 may be made of non-woven fabric. The filter body 112 is not limited to the examples described above and may be provided in various types and/or shapes to collect foreign substances.

The filter 110 may include the collection space 113. The filter 110 may form the collection space 113 therein. For example, referring to FIG. 25, the collection space 113 may refer to an internal space formed by the filter body 112. The collection space 113 may refer to a space surrounded by the filter body 112.

The collection space 113 may be provided to receive foreign substances filtered out by the filter 110. The collection space 113 may be provided to collect foreign substances contained in washing water as the washing water introduced from the pump device 80 flows from the inside of the filter body 112 to the outside of the filter body 112. For example, the collection space 113 may be provided to collect foreign substances contained in washing water as the washing water passes through the filter body 112. Foreign substances may be collected on the inner surface of the filter body 112.

The filter 110 may include the filter inlet port 116. The filter inlet port 116 may receive the washing water introduced from the pump device 80. The filter inlet port 116 may be provided to communicate the collection space 113 and the connection pipe 60. The filter inlet port 116 may be provided to communicate the collection space 113 and the inlet portion 121 of the drawer case 120. The filter inlet port 116 may be provided to correspond to the inlet portion 121 of the drawer case 120. The washing water pumped from the pump device 80 may pass through the connection pipe 60 and the inlet portion 121 of the drawer case 120 and then flow to the filter inlet port 116.

For example, the filter inlet port 116 of the filter 110 may be provided to be docked with the inlet portion 121 of the drawer case 120 as the filter 110 is inserted into the drawer case 120.

For example, the filter inlet port 116 may include the first filter inlet port 1161 corresponding to the first inlet port 1211 of the drawer case 120. As the drawer 130 is inserted into the drawer case 120, the first filter inlet port 1161 may be docked to the first inlet port 1211.

For example, the filter inlet port 116 may include the second filter inlet port 1162 corresponding to the second inlet port 1212 of the drawer case 120. As the drawer 130 is inserted into the drawer case 120, the second filter inlet port 1162 may be docked to the second inlet port 1212.

The filter inlet port 116 may be referred to as the filter inlet portion 116. The filter inlet port 116 may be referred to as the filter port 116.

For example, the filter inlet port 116 may be formed on the filter frame 111.

The filter 110 may include the filter outlet port 117. The filter outlet port 117 may be provided to allow filtered washing water to flow out. The filter outlet port 117 may be provided to allow the washing water passed through the filter body 112 to flow out. The filter outlet port 117 may be provided to communicate the collection space 113 and the discharge pipe 70. The filter outlet port 117 may be provided to communicate the collection space 113 and the outlet portion 122 of the drawer case 120. The washing water passed through the filter body 112 may pass through the filter outlet port 117 and then flow to the discharge pipe 70.

For example, the filter outlet port 117 may include a first filter outlet port 1171 corresponding to the first outlet port 1221 of the drawer case 120. The first filter outlet port 1171 may be provided to be capable of communicating with the first outlet port 1221 as the drawer 130 is inserted into the drawer case 120.

For example, the filter outlet port 117 may include a second filter outlet port 1172 corresponding to a second outlet port 1222 of the drawer case 120. As the drawer 130 is inserted into the drawer case 120, the second filter outlet port 1172 may be docked to the second outlet port 1222.

The filter outlet port 117 may be referred to as the filter outlet portion 117. The filter outlet port 117 may be referred to as the filter port 117.

For example, the filter outlet port 117 may be formed on the filter frame 111.

The filter 110 may include the filter handle 115. The filter handle 115 may be provided to be capable of being grasped by the user. For example, the user may mount the filter 110 in the filter mounting portion 133 in the state of grasping the filter handle 115. For example, the user may separate the filter 110 from the filter mounting portion 133 in the state of grasping the filter handle 115. For example, the filter 110 mounted in the drawer 130 may be exposed to the outside of housing 10 in the state in which the drawer 130 is withdrawn from the drawer case 120. In this case, the filter handle 115 of the filter 110 may also be exposed to the outside of the housing 10. For example, the filter handle 115 may be formed on the upper side of the filter frame 111. The user may easily replace and/or clean the filter 110 by grasping the filter handle 115.

For example, the washing water pumped from the pump device 80 may pass through the connection pipe 60 and the inlet portion 121 of the drawer case 120 and then flow to the filter inlet port 116. The washing water flowed into the filter 110 through the filter inlet port 116 may flow to the outside of the filter 110 through the filter body 112. As washing water flows from the inside of the filter 110 to the outside, foreign substances in the washing water may not pass through the filter body 112 and may remain in the collection space 113.

For example, the flow path switching device 200 may include a sixth valve 260. The sixth valve 260 may be provided to open and close the first filter outlet port 1171. The sixth valve 260 may open and close the first filter outlet port 1171 by rotating.

The sixth valve 260 may be controlled by the controller 330.

For example, the controller 330 may close the sixth valve 260 in the drainage process. For example, the controller 330 may open the sixth valve 260 based on completion of the drainage process. For example, the controller 330 may open the sixth valve 260 in the washing process and/or the rinsing process. For example, the controller 330 may open the sixth valve 260 based on the operation of the circulation pump 81. For example, the controller 330 may close the sixth valve 260 based on the operation of the drainage pump 82.

When the sixth valve 260 is opened, the washing water passed through the filter 110 may flow to the tub 20 through the circulation pipe 71. For example, when the sixth valve 260 is opened, the washing water passed through the filter 110 may naturally flow toward the first filter outlet port 1171 because the first filter outlet port 1171 is positioned lower than the second filter outlet port 1172. The washing water flowed out from the first filter outlet port 1171 may flow to the first outlet port 1221.

When the sixth valve 260 is closed, the washing water passed through the filter 110 may flow to the outside of the housing 10. For example, when the sixth valve 260 is closed, the washing water may not flow out through the first filter outlet port 1171. Accordingly, the washing water passed through the filter 110 may flow naturally toward the second filter outlet port 1172. The washing water flowed out from the second filter outlet port 1172 may flow to the second outlet port 1222.

Figure 27:
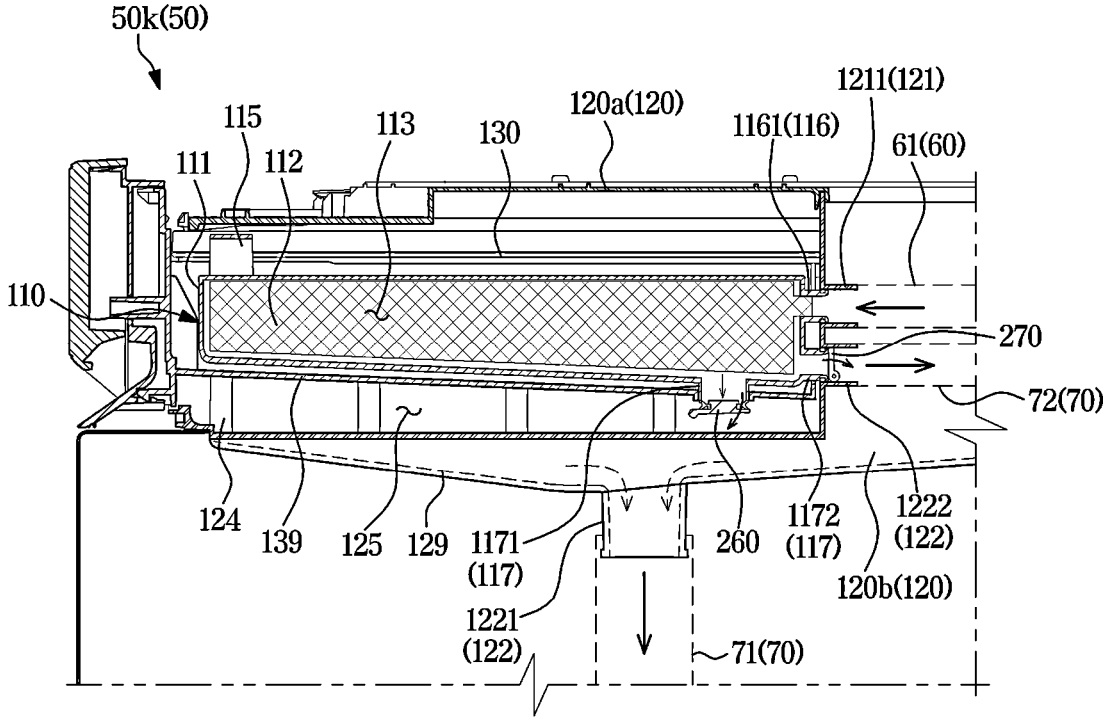
FIG. 27 is a cross-sectional view of an example of the detergent supply device according to one embodiment.

An example (50*k*) of the detergent supply device 50 will be described below with reference to FIG. 27. FIG. 27 illustrates an example in which the washing water passed through the filter 110 flows to the circulation pipe 71 or the drain pipe 72. Compared to FIG. 26, a seventh valve 270 may be additionally provided. Descriptions that overlap with those of FIG. 26 will be omitted.

The flow path switching device 200 may include the seventh valve 270. The seventh valve 270 may be provided to open and close the second filter outlet port 1172. The seventh valve 270 may open and close the second filter outlet port 1172 by rotating.

The sixth valve 260 and the seventh valve 270 may be provided to be selectively opened. For example, the sixth valve 260 may be opened and the seventh valve 270 may be closed. For example, the sixth valve 260 may be closed and the seventh valve 270 may be opened.

The seventh valve 270 may be controlled by the controller 330.

For example, the controller 330 may close the sixth valve 260 and open the seventh valve 270 in the drainage process. For example, the controller 330 may open the sixth valve 260 and close the seventh valve 270 based on the completion of the drainage process. For example, the controller 330 may open the sixth valve 260 and close the seventh valve 270 in the washing process and/or the rinsing process. For example, the controller 330 may open the sixth valve 260 and close the seventh valve 270 based on the operation of the circulation pump 81. For example, the controller 330 may close the sixth valve 260 and open the seventh valve 270 based on the operation of the drainage pump 82.

When the sixth valve 260 is opened and the seventh valve 270 is closed, the washing water passed through the filter 110 may flow to the tub 20 through the circulation pipe 71.

When the sixth valve 260 is closed and the seventh valve 270 is opened, the washing water passed through the filter 110 may flow to the outside of the housing 10 through the drain pipe 72.

Unlike that illustrated in FIG. 27, the second filter outlet port 1172 may be positioned lower than the first filter outlet port 1171, and the flow path switching device 200 may include only the seventh valve 270 for opening and closing the second filter outlet port 1172.

Figure 28:
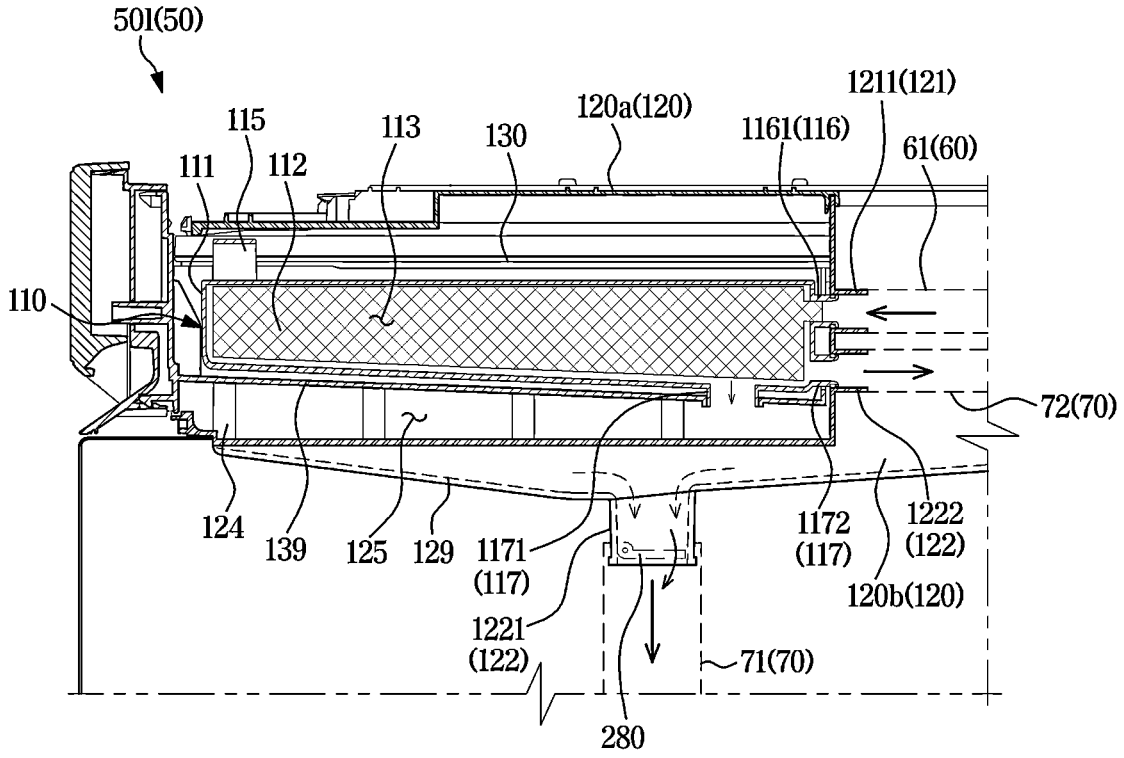
FIG. 28 is a cross-sectional view of an example of the detergent supply device according to one embodiment.

An example (50*l*) of the detergent supply device 50 will be described below with reference to FIG. 28. FIG. 28 illustrates an example in which the washing water passed through the filter 110 flows to the circulation pipe 71 or the drain pipe 72. The same drawing numbers may represent parts or components performing substantially the same functions, and duplicate descriptions may be omitted.

The filter 110 may include the filter inlet port 116. The filter inlet port 116 may receive the washing water introduced from the pump device 80.

For example, the filter inlet port 116 may include the first filter inlet port 1161 corresponding to the first inlet port 1211 of the drawer case 120.

For example, the filter inlet port 116 may include the second filter inlet port 1162 corresponding to the second inlet port 1212 of the drawer case 120.

The filter 110 may include the filter outlet port 117. The filter outlet port 117 may be provided to flow out the filtered washing water.

For example, the filter outlet port 117 may include the first filter outlet port 1171 corresponding to the first outlet port 1221 of the drawer case 120.

For example, the filter outlet port 117 may include the second filter outlet port 1172 corresponding to the second outlet port 1222 of the drawer case 120.

For example, the flow path switching device 200 may include an eighth valve 280. The eighth valve 280 may be provided to open and close the first outlet port 1221. The eighth valve 280 may open and close the first outlet port 1221 by rotating.

The eighth valve 280 may be controlled by the controller 330.

For example, the controller 330 may close the eighth valve 280 in the drainage process. For example, the controller 330 may open the eighth valve 280 based on the completion of the drainage process. For example, the controller 330 may open the eighth valve 280 in the washing process and/or the rinsing process. For example, the controller 330 may open the eighth valve 280 based on the operation of the circulation pump 81. For example, the controller 330 may close the eighth valve 280 based on the operation of the drainage pump 82.

When the eighth valve 280 is opened, the washing water passed through the filter 110 may flow to the tub 20 through the circulation pipe 71. For example, when the eighth valve 280 is opened, the washing water passed through the filter 110 may naturally flow toward the first filter outlet port 1171 because the first filter outlet port 1171 is positioned lower than the second filter outlet port 1172. The washing water flowed out from the first filter outlet port 1171 may flow to the first outlet port 1221.

When the eighth valve 280 is closed, the washing water passed through the filter 110 may flow to the outside of the housing 10. For example, when the eighth valve 280 is closed, the washing water passed through the filter 110 may flow to the second filter outlet port 1172. The washing water flowed out from the second filter outlet port 1172 may flow to the second outlet port 1222.

Figure 29:
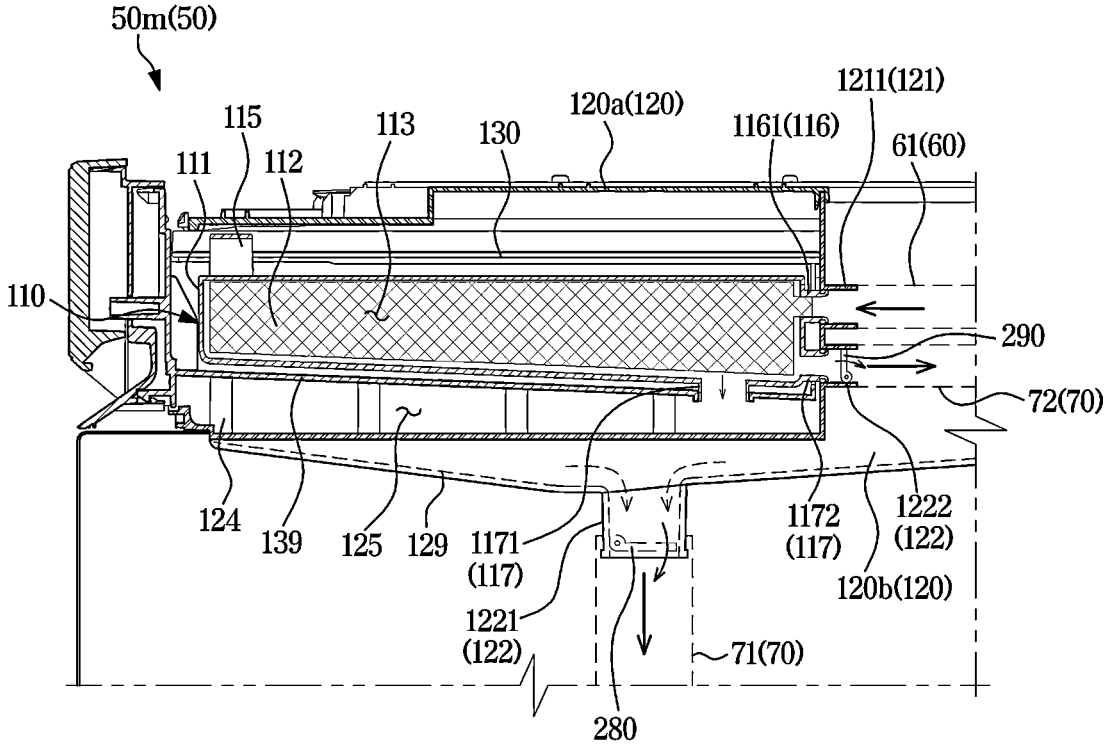
FIG. 29 is a cross-sectional view of an example of the detergent supply device according to one embodiment.

An example (50*m*) of the detergent supply device 50 will be described below with reference to FIG. 29. FIG. 29 illustrates an example in which the washing water passed through the filter 110 flows to the circulation pipe 71 or the drain pipe 72. Compared to FIG. 28, a ninth valve 290 may be additionally provided. Descriptions that overlap with those of FIG. 28 will be omitted.

The flow path switching device 200 may include the ninth valve 290. The ninth valve 290 may be provided to open and close the second outlet port 1222. The ninth valve 290 may open and close the second outlet port 1222 by rotating.

The eighth valve 280 and the ninth valve 290 may be provided to be selectively opened. For example, the eighth valve 280 may be opened and the ninth valve 290 may be closed. For example, the eighth valve 280 may be closed and the ninth valve 290 may be opened.

The ninth valve 290 may be controlled by the controller 330.

For example, the controller 330 may close the eighth valve 280 and open the ninth valve 290 in the drainage process. For example, the controller 330 may open the eighth valve 280 and close the ninth valve 290 based on the completion of the drain process. For example, the controller 330 may open the eighth valve 280 and close the ninth valve 290 in the washing process and/or the rinsing process. For example, the controller 330 may open the eighth valve 280 and close the ninth valve 290 based on the operation of the circulation pump 81. For example, the controller 330 may close the eighth valve 280 and open the ninth valve 290 based on the operation of the drainage pump 82.

When the eighth valve 280 is opened and the ninth valve 290 is closed, the washing water passed through the filter 110 may flow to the tub 20 through the circulation pipe 71.

When the eighth valve 280 is closed and the ninth valve 290 is opened, the washing water passed through the filter 110 may flow to the outside of the housing 10 through the drain pipe 72.

Unlike that illustrated in FIG. 29, the second outlet port 1222 may be positioned lower than the first outlet port 1221, and the flow path switching device 200 may include only the ninth valve 290 for opening and closing the second outlet port 1222.

Figure 30:
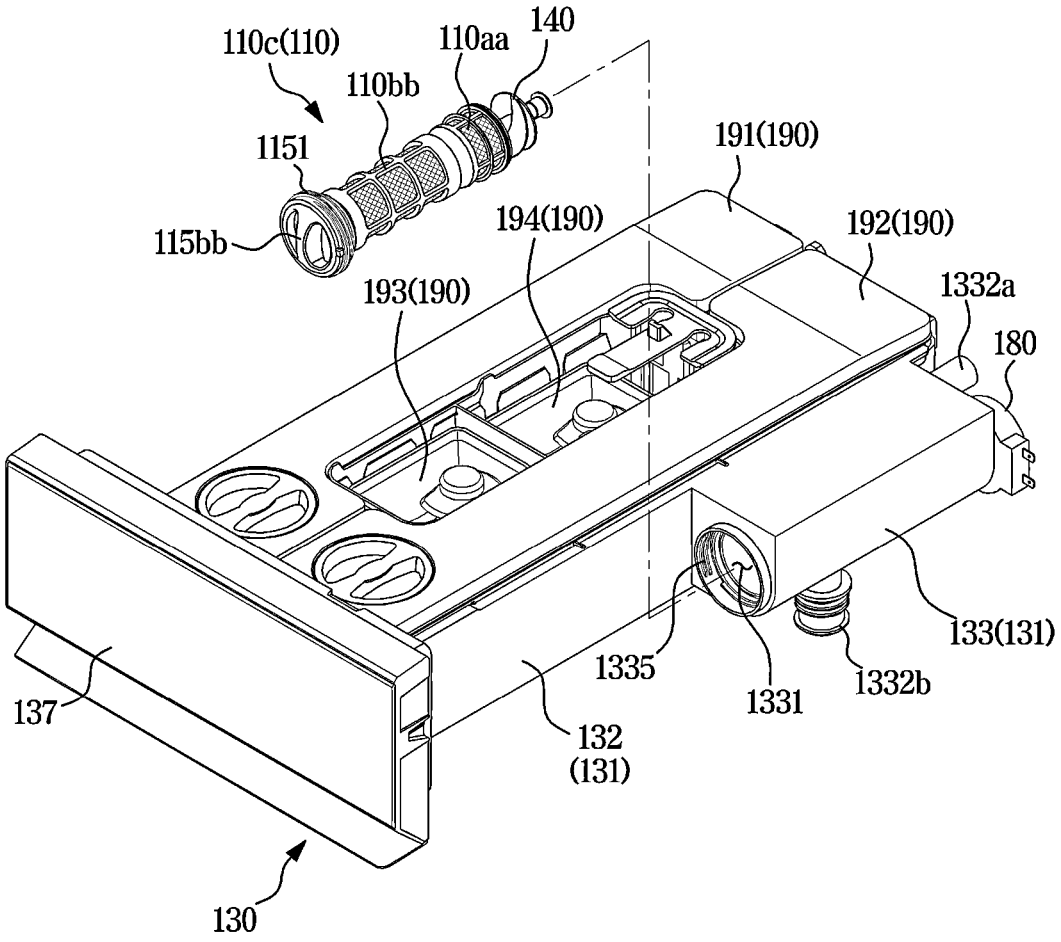
FIG. 30 is a drawing illustrating an example of the drawer, the detergent box, and the filter according to one embodiment.
Figure 31:
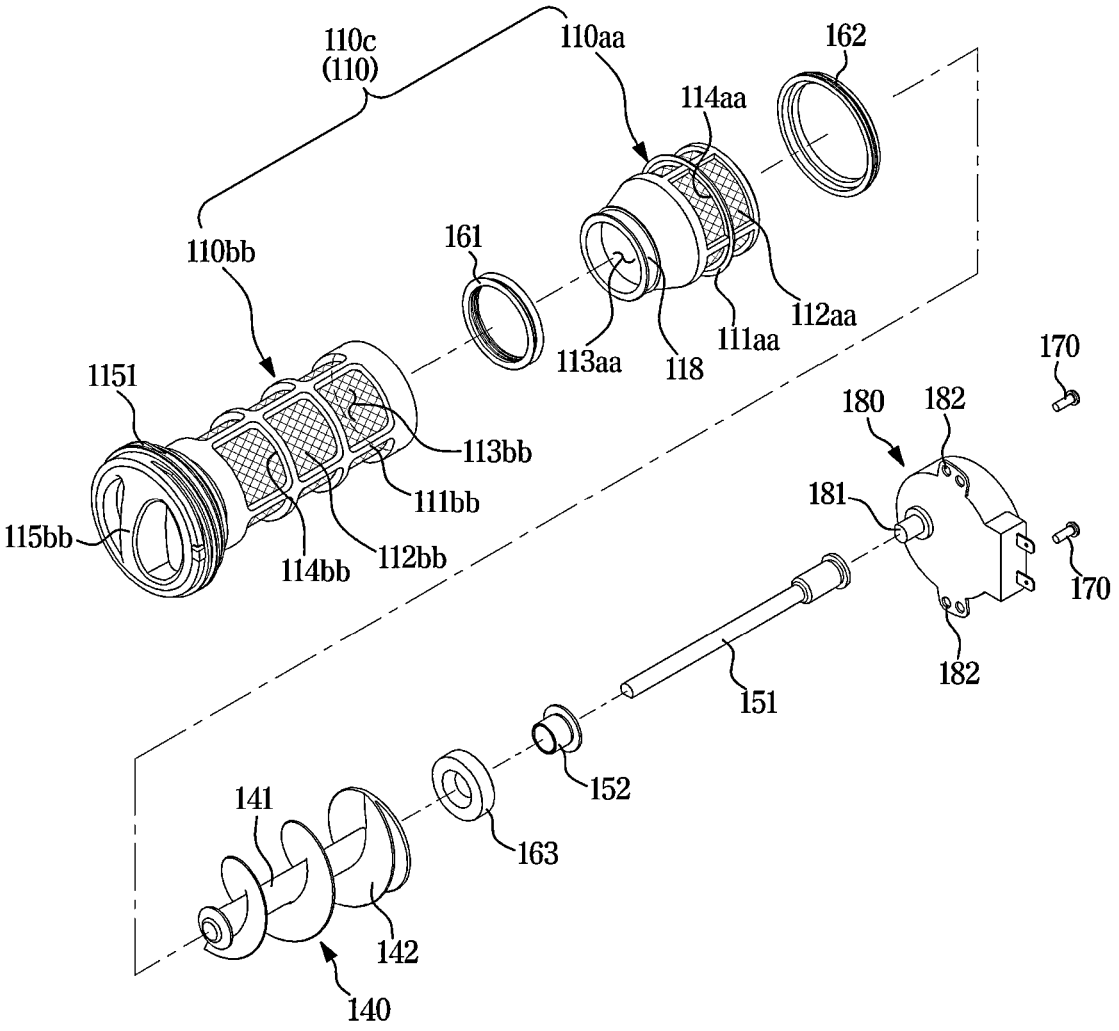
FIG. 31 is an exploded view of the filter illustrated in FIG. 30.

FIG. 30 is a drawing illustrating an example of the drawer, the detergent box, and the filter according to one embodiment. FIG. 31 is an exploded view of the filter illustrated in FIG. 30.

An example (110*c*) of the filter 110 and the filter mounting portion 133 of the drawer 130 will be described below with reference to FIGS. 30 and 31. An example of the connection of the pipes 60 and 70, an example of the flow path switching device 200, an example of the flow of washing water, etc., which are described with reference to FIGS. 15 to 23 and FIGS. 26 to 29, may also be applied to a filter 110*c* illustrated in FIGS. 30 and 31 and the drawer 130. The same drawing numbers may represent parts or components performing substantially the same functions, and duplicate descriptions may be omitted.

The drawer 130 may include the filter mounting portion 133. The filter 110 may be detachably mounted in the filter mounting portion 133. The filter 110 may be accommodated in the filter mounting portion 133. The filter mounting portion 133 may form the accommodation space 1331 to accommodate the filter 110. For example, the accommodation space 1331 may be provided to have a shape of being open to the front.

The filter mounting portion 133 may be provided on a side of the detergent box 190. FIG. 30 illustrates that the filter mounting portion 133 is positioned on the right side of the detergent box 190, but the present disclosure is not limited thereto. For example, the filter mounting portion 133 may be positioned to the left side of the detergent box 190. For example, the filter mounting portion 133 may be provided between a plurality of the detergent boxes 190. For example, the filter mounting portion 133 may be disposed between the first detergent box 191 and the second detergent box 192.

The filter mounting portion 133 may include a drawer inlet port 1332*a* communicating with the inlet portion 121 of the drawer case 120. Washing water may pass through the inlet portion 121 and then flow to the drawer inlet port 1332*a*.

The filter mounting portion 133 may include a drawer outlet port 1332*b* communicating with the outlet portion 122 of the drawer case 120. Washing water may pass through the drawer outlet port 1332*b* and then flow to the outlet portion 122.

The filter 110 may be provided to be insertable into the filter mounting portion 133 or withdrawable from the filter mounting portion 133.

The filter 110 may include a first filter part 110*aa* and a second filter part 110*bb*. The first filter part 110*aa* may be disposed adjacent to the drawer inlet port 1332*a*. The second filter part 110*bb* may be disposed adjacent to the drawer outlet port 1332*b*. For example, the first filter part 110*aa* may be disposed at the rear of the second filter part 110*bb*.

The first filter part 110*aa* and the second filter part 110*bb* may be detachably combined. For example, the second filter part 110*bb* may be docked to the first filter part 110*aa* while being inserted into the filter mounting portion 133. For example, the second filter part 110*bb* may be separated from the first filter part 110*aa* and withdrawn from the filter mounting portion 133. The user may take out the second filter part 110*bb* from the filter mounting portion 133 and remove foreign substances collected in the second filter part 110*bb*.

The first filter part 110*aa* may be provided to filter washing water flowed through the drawer inlet port 1332*a*. For example, the first filter part 110*aa* may primarily filter washing water flowed into the filter 110.

The first filter part 110*aa* may include a first filter frame 111*aa*. The first filter part 110*aa* may include a first filter body 112*aa* provided to be supported on the first filter frame 111*aa*.

For example, the first filter frame 111*aa* may include a first filter body mounting portion 114*aa* in which the first filter body 112*aa* is mounted. For example, the first filter body mounting portion 114*aa* may be provided as an opening, and the first filter body 112*aa* may be provided to fill the first filter body mounting portion 114*aa*. However, the present disclosure is not limited thereto, and it is sufficient as long as the first filter frame 111*aa* and the first filter body 112*aa* are provided in a shape of allowing washing water to flow in and out.

The first filter part 110*aa* may include a first collection space 113*aa*. The first filter part 110*aa* may form the first collection space 113*aa* therein. The first collection space 113*aa* may be provided to receive foreign substances filtered out by the first filter part 110*aa*. The first collection space 113*aa* may be provided to collect foreign substances contained in washing water as the washing water introduced from the pump device 80 passes through the first filter body 112*aa*. For example, foreign substances may be collected on a surface facing the first collection space 113*aa* of the first filter body 112*aa*. For example, foreign substances may be collected on an inner surface of the first filter body 112*aa*.

The second filter part 110*bb* may be provided to filter the washing water passed through the first filter part 110*aa*. For example, the second filter part 110*bb* may secondarily filter the washing water passed through the first filter part 110*aa*. The second filter part 110*bb* may be provided to collect foreign substances removed from the first filter part 110*aa*.

The second filter part 110*bb* may include a second filter frame 111*bb*. The second filter part 110*bb* may include a second filter body 112*bb* provided to be supported on the second filter frame 111*bb*.

For example, the second filter frame 111*bb* may include a second filter body mounting portion 114*bb* in which the second filter body 112*bb* is mounted. For example, the second filter body mounting portion 114*bb* may be provided as an opening, and the second filter body 112*bb* may be provided to fill the second filter body mounting portion 114*bb*. However, the present disclosure is not limited thereto, and it is sufficient as long as the second filter frame 111*bb* and the second filter body 112*bb* are provided in a shape of allowing washing water to flow in and out.

The second filter part 110*bb* may include a second collection space 113*bb*. The second filter part 110*bb* may form the second collection space 113*bb* therein. The second collection space 113*bb* may be provided to receive foreign substances filtered out by the second filter part 110*bb*. The second collection space 113*bb* may be provided to collect foreign substances contained in washing water as the washing water passes through the second filter body 112*bb*. For example, foreign substances may be collected on a surface facing the second collection space 113*bb* of the second filter body 112*bb*. For example, foreign substances may be collected on an inner surface of the second filter body 112*bb*.

Unlike that illustrated in FIG. 31, the first filter part 110*aa* and the second filter part 110*bb* may be provided as the single filter 110.

Unlike that illustrated in FIG. 31, the filter 110 may be provided to include three or more filter parts. For example, a plurality of the filter parts may be arranged sequentially along a flow direction of washing water. For example, the plurality of filter parts may be arranged side by side along the front-rear direction.

The filter 110 may include a filter handle 115*bb*. The filter handle 115*bb* may be provided in front of the second filter part 110*bb*. The filter handle 115*bb* may be provided to be capable of being grasped by the user. For example, the user may insert the filter 110 into the filter mounting portion 133 in a state of grasping the filter handle 115*bb*. For example, the user may withdraw the filter 110 from the filter mounting portion 133 in the state of grasping the filter handle 115*bb*.

The filter handle 115*bb* may include a first coupling portion 1151. The first coupling portion 1151 may be detachably coupled to a second coupling portion 1335 formed on the filter mounting portion 133. For example, the first coupling portion 1151 may be provided to be rotatable with respect to the second coupling portion 1335. For example, the first coupling portion 1151 may include screw threads. For example, the second coupling portion 1335 may include screw threads. For example, when the filter handle 115*bb* rotates in a first direction by a predetermined range, the filter handle 115*bb* may be located in a detachable state with respect to the filter mounting portion 133. For example, when the filter handle 115*bb* rotates in a second direction by a predetermined range, the filter handle 115*bb* may be located in a fixed state with respect to the filter mounting portion 133. For example, the second direction may be an opposite direction of the first direction.

The filter 110 may include a blade 140. The blade 140 may be disposed adjacent to the filter 110. At least a portion of the blades 140 may be disposed inside the filter 110. At least a portion of the blade 140 may be disposed inside the first filter part 110*aa*.

For example, the blade 140 may include a blade shaft 141. The blade shaft 141 may form a center of rotation. The blade shaft 141 may receive a rotational force from a motor 180.

For example, the blade 140 may include a blade vane 142 formed on an outer surface of the blade shaft 141. For example, the blade vane 142 may include a helical shape.

The blade 140 may be provided to transfer foreign substances collected by the filter 110 to one side of the inside of the filter 110. The blade 140 may be provided to be capable of rotating while coming into contact with an inner surface of the filter 110. The blade vane 142 may be provided to be capable of rotating while coming into contact with the inner surface of the filter 110.

The blade 140 may be provided to scrape off foreign substances collected on the inner surface of the filter 110 as the blade 140 rotates. The blade 140 may be provided to scrape off foreign substances attached to the inner surface of the filter body 112 as the blade 140 rotates. Accordingly, the foreign substances attached to the inner surface of the filter body 112 may be removed from the filter body 112. The removed foreign substances may move to one side of the inside of the filter 110 by rotation of the blade vane 142.

For example, the blade 140 may be provided to transfer the foreign substances collected in the first filter part 110*aa* to the second filter part 110*bb*. For example, the blade 140 may be provided to be capable of rotating while coming into contact with an inner surface of the first filter part 110*aa*. The blade vane 142 may be provided to be capable of rotating while coming into contact with the inner surface of the first filter part 110*aa*. The blade 140 may be provided to scrape off foreign substances collected on an inner surface of the first filter body 112*aa* of the first filter part 110*aa* as the blade 140 rotates. Accordingly, the foreign substances attached to the inner surface of the first filter body 112*aa* may be removed from the first filter body 112*aa*. The removed foreign substances may move toward the second filter part 110*bb* by the rotation of the blade vane 142. For example, the foreign substances may be transferred forward by the rotation of the blade 140.

The filter 110 may include the motor 180. The motor 180 may be provided to drive the blade 140. The motor 180 may be provided to rotate the blade 140. The motor 180 may generate a rotational force.

The motor 180 may be controlled to drive by the controller 330.

For example, the controller 330 may be provided to supply a driving current to the motor 180. For example, the controller 330 may be provided to supply the driving current to the motor 180 based on the operation of the pump device 80. For example, the controller 330 may be provided to supply the driving current to the motor 180 based on the operation of the circulation pump 81 and/or the drainage pump 82. For example, the controller 330 may be provided to control a user interface 310 by comparing a value of the driving current supplied to the motor 180 with a preset value. For example, the controller 330 may be provided to stop operation of the motor 180 by comparing the value of the driving current supplied to the motor 180 with the preset value. A detailed explanation of this will be given later.

The motor 180 may include a coupling portion 182. For example, the coupling portion 182 of the motor 180 may be fixed to the drawer 130 by a fastening member 170. For example, the fastening member 170 may be a screw.

The filter 110 may include a connection member 151. The connection member 151 may be provided to connect the motor 180 and the blade 140. The connection member 151 may be provided to transmit the rotational force generated by the motor 180 to the blade 140. The connection member 151 may be coupled to a motor shaft 181 of the motor 180. The connection member 151 may be provided to rotate in conjunction with the motor 180. The connection member 151 may be coupled to the blade shaft 141. The blade 140 may be provided to rotate in conjunction with the connection member 151.

For example, the connection member 151 may have a shape of extending in the front-rear direction (X direction). For example, the connection member 151 may have a shaft shape. The connection member 151 may be referred to as the connection shaft 151. For example, the connection member 151 may be inserted into the blade shaft 141.

The filter 110 may include a bearing 152. The bearing 152 may be provided to support a load of the connection member 151. The bearing 152 may be provided to rotatably support the connection member 151. The bearing 152 may be provided to reduce frictional resistance when the connection member 151 rotates. Accordingly, the connection member 151 may rotate smoothly by the bearing 152.

The filter 110 may include a first sealing member 161. The first sealing member 161 may be arranged to seal between the first filter part 110*aa* and the second filter part 110*bb*. For example, the first sealing member 161 may be disposed between an outer surface of the first filter part 110*aa* and an inner surface of the second filter part 110*bb*. For example, the first sealing member 161 may be provided to be mounted in a groove 118 formed on the first filter part 110*aa*.

The filter 110 may include a second sealing member 162. The second sealing member 162 may be provided to seal between the first filter part 110*aa* and the filter mounting portion 133 of the drawer 130.

The filter 110 may include a third sealing member 163. The third sealing member 163 may be provided to seal between the connection member 151 and the filter mounting portion 133 of the drawer 130.

Figure 32:
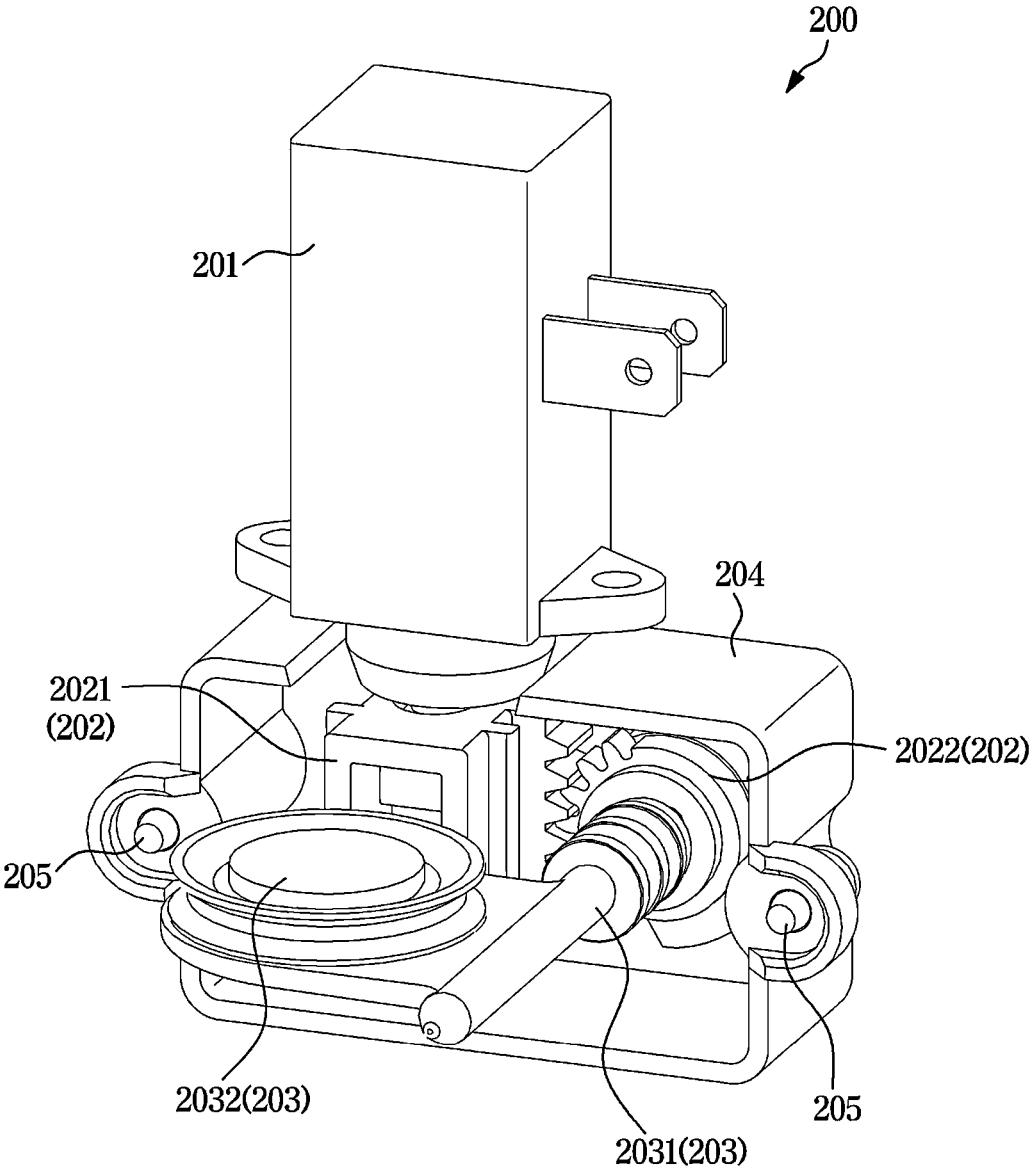
FIG. 32 is a perspective view of an example of a flow path switching device according to one embodiment.
Figure 33:
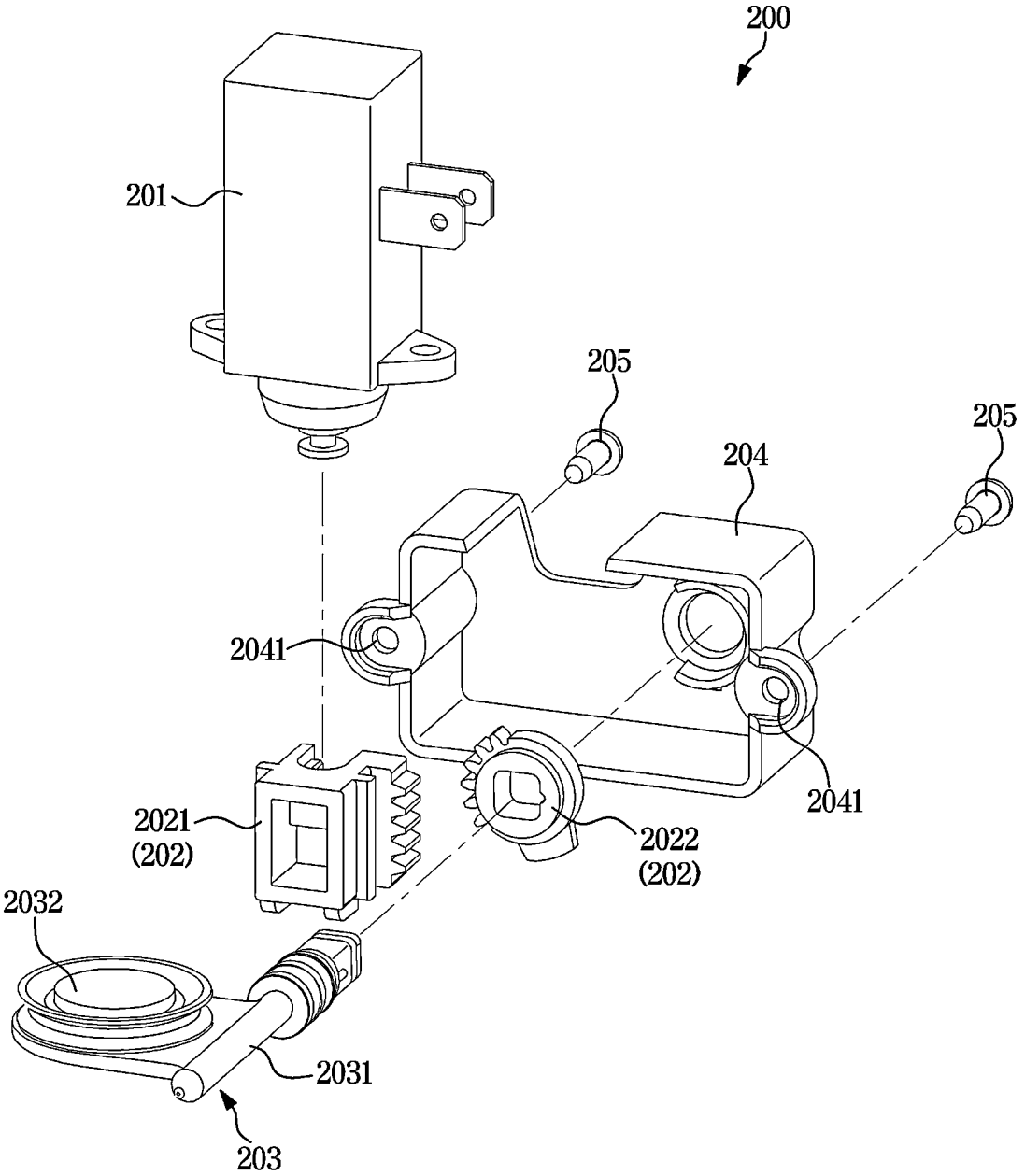
FIG. 33 is an exploded view of the flow path switching device illustrated in FIG. 32.

FIG. 32 is a perspective view of an example of a flow path switching device according to one embodiment. FIG. 33 is an exploded view of the flow path switching device illustrated in FIG. 32. An example of the flow path switching device 200 illustrated in FIGS. 32 and 33 may be an example of the valves 210, 220, 230, 240, 250, 260, 270, 280, and 290. However, this is merely an example, and the flow path switching device 200 may have various shapes and/or configurations.

The flow path switching device 200 may include an actuator 201. For example, the actuator 201 may be provided to be capable of moving in a straight line. The actuator 201 may receive the driving current from the controller 330.

The flow path switching device 200 may include a gear unit 202. The gear unit 202 may be provided to move in conjunction with the actuator 201.

For example, the gear unit 202 may include a first gear 2021. The first gear 2021 may be connected to one end of the actuator 201. For example, the first gear 2021 may be provided to move in a straight line as the actuator 201 moves in the straight line.

For example, the gear unit 202 may include a second gear 2022. The second gear 2022 may be provided to engage with the first gear 2021. For example, the second gear 2022 may be provided to rotate as the first gear 2021 moves in the straight line.

The flow path switching device 200 may include an opening/closing part 203. The opening/closing part 203 may be provided to open and close at least one of the discharge pipe 70, the filter outlet port 117, and the outlet portion 122.

For example, the opening/closing part 203 may include a gear connection portion 2031 connected to the second gear 2022. The gear connection portion 2031 may receive a rotational force from the second gear 2022. The gear connection portion 2031 may be provided to be rotatable. For example, the gear connection portion 2031 may have a shaft shape.

For example, the opening/closing part 203 may include an opening/closing plate 2032 extending from the gear connection portion 2031. The opening/closing plate 2032 may be provided to be rotatable. The opening/closing plate 2032 may be provided to rotate about the gear connection portion 2031. For example, the opening/closing plate 2032 may be installed in at least one of the discharge pipe 70, the filter outlet port 117, and the outlet portion 122. For example, the opening/closing plate 2032 may be provided to correspond to a size of a portion to be opened and closed. For example, the opening/closing plate 2032 may be provided to correspond to at least one of the discharge pipe 70, the filter outlet port 117, and the outlet portion 122.

The flow path switching device 200 may include a valve housing 204. The valve housing 204 may accommodate at least a portion of the actuator 201. The valve housing 204 may accommodate at least a portion of the gear unit 202. The valve housing 204 can accommodate at least portion of the opening/closing part 203.

For example, the valve housing 204 may include a housing coupling portion 2041. For example, a portion where the flow path switching device 200 is installed and the housing coupling portion 2041 may be fastened by a fastening member 205. However, the present disclosure is not limited thereto, and the flow path switching device 200 may be installed by various known methods.

FIG. 34 is a control block diagram of the washing machine according to one embodiment.

Referring to FIG. 34, the washing machine 1 according to one embodiment may include the user interface 310, the driving motor 40 provided to drive the drum 30, a water supply part 320, the pump device 80, the flow path switching device 200, and the motor 180 provided to drive the blade 140.

The user interface 310 may interact with the user.

For example, the user interface 310 may include the control panel 14.

The control panel 14 may include the inputter 14*a* provided to receive an operation command from the user and the display 14*b* provided to display operation information of the washing machine 1. The control panel 14 may provide a user interface for interaction between the user and the washing machine 1.

The inputter 14*a* may provide an electrical output signal corresponding to a user input to the controller 330. The inputter 14*a* may include, for example, a power button, an operation button, a course selection dial (or course selection button), and a washing/rinsing/dewatering setting button. The input button may include, for example, a tact switch, a push switch, a slide switch, a toggle switch, a micro switch, or a touch switch.

The display 14*b* may receive a signal from the controller 330 and display information corresponding to the received signal. The display 14*b* may include a screen to display a washing course selected by rotating the course selection dial (or pressing the course selection button) and an operating time of the washing machine 1, and an indicator to display washing setting/rinsing setting/dewatering setting selected by the setting button. The display 14*b* may include, for example, a liquid crystal display (LCD) panel, a light emitting diode (LED) panel, etc.

Although not shown in the drawing, the user interface 310 may include various additional components for interaction with the user in addition to the control panel 14.

For example, the user interface 310 may include visual indicators provided separately from the control panel 14.

The separately provided visual indicators may be provided near the filter handles 115 and 115*bb*. According to various embodiments, the visual indicators may be provided on surfaces of the filter handles 115 and 115*bb*.

As another example, the user interface 310 may include a speaker to provide auditory feedback.

The controller 330 may include at least one memory 332 and at least one processor 331 in order to perform the operations described above and operations to be described later.

In one embodiment, the controller 330 may include the at least one memory 332 to store data in the form of an algorithm and/or program for controlling the operations of components in the washing machine 1, and the at least one processor 331 to perform the operations described above and operations to be described later using data stored in the at least one memory 332. The memory 332 and the processor 331 may be implemented as separate chips. The processor 331 may include one or more processor chips or may include one or more processing cores. The memory 332 may include one or more memory chips or may include one or more memory blocks. The memory 332 and the processor 331 may also be implemented as a single chip.

The controller 330 may process a user input received through the inputter 14*a*, and may control various components of the washing machine 1 (e.g., the driving motor 40, user interface 310, water supply part 320, pump device 80, flow path switching device 200, motor 180) based on processing the user input.

As an example, the controller 330 may control various components of the washing machine 1 to perform a washing cycle, including a water supply process, the washing process, the rinsing process, and/or the dewatering process, based on the user input entered into the control panel 14.

The driving motor 40 may rotate the drum 30. To this end, although not shown in the drawing, the controller 330 may control a driving circuit to supply the driving current to the driving motor 40.

The driving circuit may supply the driving current to the driving motor 40 in response to the driving signal from the controller 330.

In one embodiment, the driving circuit may include a rectifier circuit to rectify alternating current power of an external power source, a direct current link circuit to remove ripples from the rectified power and output direct current power, an inverter circuit to convert the direct current power into sinusoidal driving power and output the driving current to the driving motor 40, a current sensor to measure the driving current supplied to the driving motor 40, and a gate driver to turn on/off a switching element included in the inverter circuit based on the driving signal of the controller 330.

The controller 330 may measure a load of the driving motor 40 based on a current value measured from the current sensor of the driving circuit.

The water supply part 320 may provide water supplied from the external water supply source to the inside of the tub 20.

To this end, the water supply part 320 may include the at least one water supply valve 52.

The at least one water supply valve 52 may include a water supply valve to supply water supplied from the external water supply source to the detergent supply device 50 and/or a water supply valve to supply water supplied from the external water supply source directly to the tub 20.

The controller 330 may control the water supply part 320 to supply water supplied from the external water supply source to the tub 20 through the detergent supply device 50, or to supply water supplied from the external water supply source directly to the tub 20.

The pump device 80 may include the at least one pump 81 and/or 82.

According to various embodiments, the pump device 80 may include the circulation pump 81 and the drainage pump 82.

The washing water pumped from the circulation pump 81 may flow to the filter 110 through the circulation connection pipe 61, and the washing water pumped from the drainage pump 82 may flow to the filter 110 through the drain connection pipe 62.

According to various embodiments, the pump device 80 may include the single pump 81 or 82.

The washing water pumped from the single pump 81 or 82 may flow to the filter 110 through the single connection pipe 60.

The controller 330 may operate the pump device 80 to flow washing water to the filter 110.

The flow path switching device 200 may allow water flowed into the filter 110 through the connection pipe 60 (61 and 62) to flow into the circulation pipe 71 or the drain pipe 72.

The water flowed into the circulation pipe 71 may reflow into the tub 20, and the water flowed into the drain pipe 72 may be discharged to the outside of the housing 10.

The flow path switching device 200 may include at least one valve.

According to various embodiments, the flow path switching device 200 may include only the first valve 210 for opening and closing the circulation pipe 71.

In a case in which the flow path switching device 200 includes only the first valve 210 for opening and closing the circulation pipe 71, most of the water flowed into the filter 110 may be introduced into the circulation pipe 71 as the first valve 210 opens the circulation pipe 71, and the water flowed into the filter 110 may be introduced into the drain pipe 72 as the first valve 210 closes the circulation pipe 71.

According to various embodiments, the flow path switching device 200 may include the first valve 210 for opening and closing the circulation pipe 71 and the second valve 220 for opening and closing the drain pipe 72.

In a case in which the flow path switching device 200 includes the first valve 210 and the second valve 220, the water flowed into the filter 110 may be introduced into the circulation pipe 71 as the first valve 210 opens the circulation pipe 71 and the second valve 220 closes the drain pipe 72, and the water flowed into the filter 110 may be introduced into the drain pipe 72 as the first valve 210 closes the circulation pipe 71 the second valve 220 opens the drain pipe 72.

According to various embodiments, the flow path switching device 200 may include only the third valve 230 provided at a branch point of the circulation pipe 71 and the drain pipe 72.

The third valve 230 may selectively open the circulation pipe 71 and the drain pipe 72.

In a case in which the flow path switching device 200 includes the third valve 230, the water flowed into the filter 110 may be introduced into the circulation pipe 71 as the third valve 230 opens the circulation pipe 71, and the water flowed into the filter 110 may be introduced into the drain pipe 72 as the third valve 230 opens the drain pipe 72.

According to various embodiments, the flow path switching device 200 may include only the fourth valve 240 for opening and closing the first outlet port 1221.

In a case in which the flow path switching device 200 includes only the fourth valve 240, most of the water flowed into the filter 110 may be introduced into the circulation pipe 71 as the fourth valve 240 opens the first outlet port 1221, and the water flowed into the filter 110 may be introduced into the drain pipe 72 as the fourth valve 240 closes the first outlet port 1221.

According to various embodiments, the flow path switching device 200 may include the fourth valve 240 and the fifth valve 250. The fourth valve 240 may open and close the first outlet port 1221. The fifth valve 250 may open and close the second outlet port 1222.

For example, in a case in which the flow path switching device 200 includes the fourth valve 240 and the fifth valve 250, the water flowed into the filter 110 may be introduced into the circulation pipe 71 as the fourth valve 240 opens the first outlet port 1221 and the fifth valve 250 closes the second outlet port 1222, and the water flowed into the filter 110 may be introduced into the drain pipe 72 as the fourth valve 240 closes the first outlet port 1221 and the fifth valve 250 opens the second outlet port 1222.

According to various embodiments, the flow path switching device 200 may include only the sixth valve 260 for opening and closing the first filter outlet port 1171.

In a case in which the flow path switching device 200 includes only the sixth valve 260, most of the water flowed into the filter 110 may be introduced into the circulation pipe 71 as the sixth valve 260 opens the first filter outlet port 1171, and the water flowed into the filter 110 may be introduced into the drain pipe 72 as the sixth valve 260 closes the first filter outlet port 1171.

According to various embodiments, the flow path switching device 200 may include the sixth valve 260 and the seventh valve 270. The sixth valve 260 may open and close the first filter outlet port 1171. The seventh valve 270 may open and close the second filter outlet port 1172.

In a case in which the flow path switching device 200 includes the sixth valve 260 and the seventh valve 270, the water flowed into the filter 110 may be introduced into the circulation pipe 71 as the sixth valve 260 opens the first filter outlet port 1171 and the seventh valve 270 closes the second filter outlet port 1172, and the water flowed into the filter 110 may be introduced into the drain pipe 72 as the sixth valve 260 closes the first filter outlet port 1171 and the seventh valve 270 opens the second filter outlet port 1172.

According to various embodiments, the flow path switching device 200 may include only the eighth valve 280 for opening and closing the first outlet port 1221.

In a case in which the flow path switching device 200 includes only the eighth valve 280, most of the water flowed into the filter 110 may be introduced into the circulation pipe 71 as the eighth valve 280 opens the first outlet port 1221, and the water flowed into the filter 110 may be introduced into the drain pipe 72 as the eighth valve 280 closes the first outlet port 1221.

According to various embodiments, the flow path switching device 200 may include the eighth valve 280 and the ninth valve 290. The eighth valve 280 may open and close the first outlet port 1221. The ninth valve 290 may open and close the second outlet port 1222.

In a case in which the flow path switching device 200 includes the eighth valve 280 and the ninth valve 290, the water flowed into the filter 110 may be introduced into the circulation pipe 71 as the eighth valve 280 opens the first outlet port 1221 and the ninth valve 290 closes the second outlet port 1222, and the water flowed into the filter 110 may be introduced into the drain pipe 72 as the eighth valve 280 closes the first outlet port 1221 and the ninth valve 290 opens the second outlet port 1222.

However, the example of the flow path switching device 200 is not limited to the above embodiment, and a configuration capable of selectively flowing the water introduced into filter 110 to the circulation pipe 71 or the drain pipe 72 may be adopted as an example of the flow path switching device 200.

The controller 330 may control the flow path switching device 200 to selectively allow the water flowed into the filter 110 to flow into the circulation pipe 71 or the drain pipe 72.

The motor 180 may drive the blade 140. To this end, although not shown in the drawing, the controller 330 may control a driving circuit applying the driving current to the motor 180.

The driving circuit may supply the driving current to the motor 180 in response to the driving signal from the controller 330. A configuration of the driving circuit connected to the motor 180 may be the same as or different from that of the driving circuit connected to the driving motor 40.

For example, the driving circuit connected to the motor 180 may include components for driving a DC motor differently from the driving circuit connected to the driving motor 40.

The controller 330 may measure a load of the motor 180 based on a current value measured from the current sensor of the driving circuit.

Figure 35:
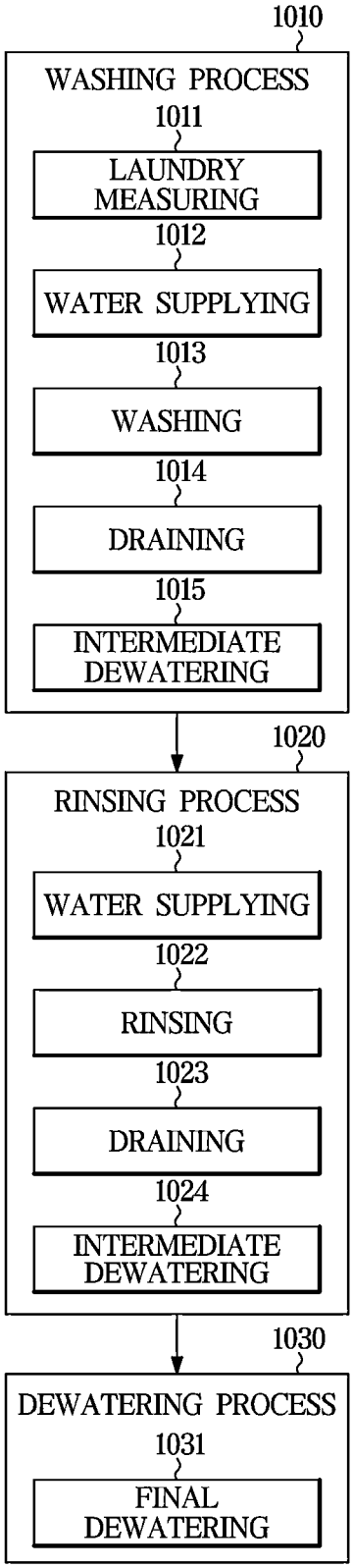
FIG. 35 illustrates an example of a washing cycle according to one embodiment.

FIG. 35 illustrates an example of a washing cycle according to one embodiment.

Referring to FIG. 35, the washing machine 1 may sequentially perform a washing process (1010), a rinsing process (1020), and a dewatering process (1030) according to the user input through the inputter 14*a*.

Laundry may be washed through the washing process (1010). Specifically, foreign substances attached to the laundry may be removed by a chemical action of the detergent and/or a mechanical action such as dropping.

The washing process (1010) may include laundry measuring (1011) for measuring an amount of laundry, water supplying (1012) for supplying water to the tub 20, washing (1013) for washing laundry by rotating the drum 30 at a low speed, draining (1014) for discharging water received in the tub 20, and intermediate dewatering (1015) for removing water from laundry by rotating the drum 30 at a high speed.

For the laundry measuring (1011), the controller 330 may control the driving circuit so that the driving motor 40 is repeatedly turned on and off, and may measure a load (weight of laundry) inside the drum 30 based on a counter electromotive force value generated when the driving motor 40 is turned off.

For the water supplying (1012), the controller 330 may control the water supply valve 52 to provide water supplied from the external water supply source into the tub 20.

For the washing (1013), the controller 330 may control the driving circuit to rotate the driving motor 40 in a forward direction (e.g., clockwise) or reverse direction (e.g., counterclockwise). By the rotation of the drum 30, the laundry drops from an upper side to a lower side of the drum 30, and the laundry may be washed by dropping.

During the washing (1013), a circulation operation may be performed to pass the water inside the tub 20 through the filter 110 and then introduce into the tub 20. More efficient washing may be achieved through the circulation operation in which water with foreign substances removed is introduced into the tub 20.

In one embodiment, for the circulation operation, the controller 330 may operate the pump device 80 and control the flow path switching device 200 to open the circulation pipe 71.

In one embodiment, for the circulation operation, the controller 330 may operate the pump device 80 and control the flow path switching device 200 to open the circulation pipe 71 and close the drain pipe 72.

According to various embodiments, in a case in which the pump device 80 includes both the circulation pump 81 and the drainage pump 82, the controller 330 may operate the circulation pump 81 for the circulation operation.

According to various embodiments, in a case in which the pump device 80 includes only one of the pumps 81 and 82, the controller 330 may operate one of the pumps 81 and 82 for the circulation operation.

The controller 330 may stop the operation of the circulation pump 81 based on completion of the circulation operation. In the case in which the pump device 80 includes only one of the pumps 81 and 82, the controller 330 may stop the operation of one of the pumps 81 and 82.

Additionally, the controller 330 may control the flow path switching device 200 to close the circulation pipe 71 based on the completion of the circulation operation.

For the draining (1014), the controller 330 may operate the pump device 80 and control the flow path switching device 200 to open the drain pipe 72.

According to various embodiments, in the case in which the pump device 80 includes both the circulation pump 81 and the drainage pump 82, for the draining (1014), the controller 330 may operate the drainage pump 82.

According to various embodiments, in the case in which the pump device 80 includes only one of the pumps 81 and 82, for the draining (1014), the controller 330 may operate one of the pumps 81 and 82.

The controller 330 may stop the operation of the drainage pump 82 based on the completion of the draining (1014). In the case in which the pump device 80 includes only one of the pumps 81 and 82, the controller 330 may stop the operation of one of the pumps 81 and 82.

For the intermediate dewatering (1015), the controller 330 may control the driving circuit to rotate the driving motor 40 at a high speed. By rotating the drum 30 at a high speed, water may be separated from the laundry received in the drum 30 and then discharged to the outside of the washing machine 1.

During the intermediate dewatering (1015), the rotational speed of the drum 30 may be gradually increased. For example, the controller 330 may control the driving circuit to rotate the driving motor 40 at a first rotational speed, and may control the driving motor 40 to increase the rotational speed of the driving motor 40 to a second rotational speed based on a change in the driving current of the driving motor 40 while the driving motor 40 rotates at the first rotational speed. While the driving motor 40 rotates at the second rotational speed, the controller 330 may control the driving motor 40 to increase the rotational speed of the driving motor 40 to a third rotational speed, or control the driving motor 40 to decrease the rotational speed of the driving motor 40 to the first rotational speed, based on a change in the driving current of the driving motor 40.

By the rinsing process (1020), the laundry may be rinsed. Specifically, the detergent or foreign substances remaining in the laundry may be washed away by water.

The rinsing process (1020) may include water supplying (1021) for supplying water to the tub 20, rinsing (1022) for rinsing laundry by driving the drum 30, draining (1023) for discharging water received in the tub 20, and intermediate dewatering (1024) for removing water from laundry by driving the drum 30.

The water supplying (1021), draining (1023), and intermediate dewatering (1024) of the rinsing process (1020) may be the same as the water supplying (1012), draining (1014), and intermediate dewatering (1015) of the washing process (1010), respectively. During the rinsing process (1020), the water supplying (1021), rinsing (1022), draining (1023), and intermediate dewatering (1024) may be performed once or multiple times.

During the rinsing (1022), the controller 330 may perform the circulation operation. Because the method of performing the circulation operation has been described above, the description of this will be omitted.

According to the present disclosure, by performing the circulation operation during the rinsing (1022), foreign substances in water received in the tub 20 may be efficiently removed, and rinsing efficiency may be improved.

Through the dewatering process (1030), laundry may be dewatering. Specifically, water may be separated from the laundry by the high-speed rotation of the drum 30, and the separated water may be discharged to the outside of the washing machine 1.

The dewatering process (1030) may include a final dewatering (1031) for separating water from the laundry by rotating the drum 30 at a high speed. Due to the final dewatering (1031), the final intermediate dewatering (1024) of the rinsing process (1020) may be omitted.

For the final dewatering (1031), the controller 330 may control the driving circuit to rotate the driving motor 40 at a high speed. By the high-speed rotation of the drum 30, water may be separated from the laundry accommodated in the drum 30 and discharged to the outside of the washing machine 1. The rotational speed of the driving motor 40 may be gradually increased.

Because the operation of the washing machine 1 is completed by the final dewatering (1031), an execution time of the final dewatering (1031) may be longer than an execution time of the intermediate dewatering (1015 and 1024).

According to various embodiments, a draining operation may be executed during the dewatering process (1030). For example, the controller 330 may operate the drainage pump 82 during the dewatering process (1030), and may control the flow path switching device 200 to close the circulation pipe 71 and open the drain pipe 72.

As described above, the washing machine 1 may execute the washing process (1010), the rinsing process (1020), and the dewatering process (1030) in order to wash laundry. In particular, during the intermediate dewatering (1015 and 1024) and the final dewatering (1031), the washing machine 1 may gradually increase the rotational speed of the driving motor 40 rotating the drum 30, and may increase or decrease the rotational speed of the driving motor 40 based on the change in the driving current of the driving motor 40.

Figure 36:
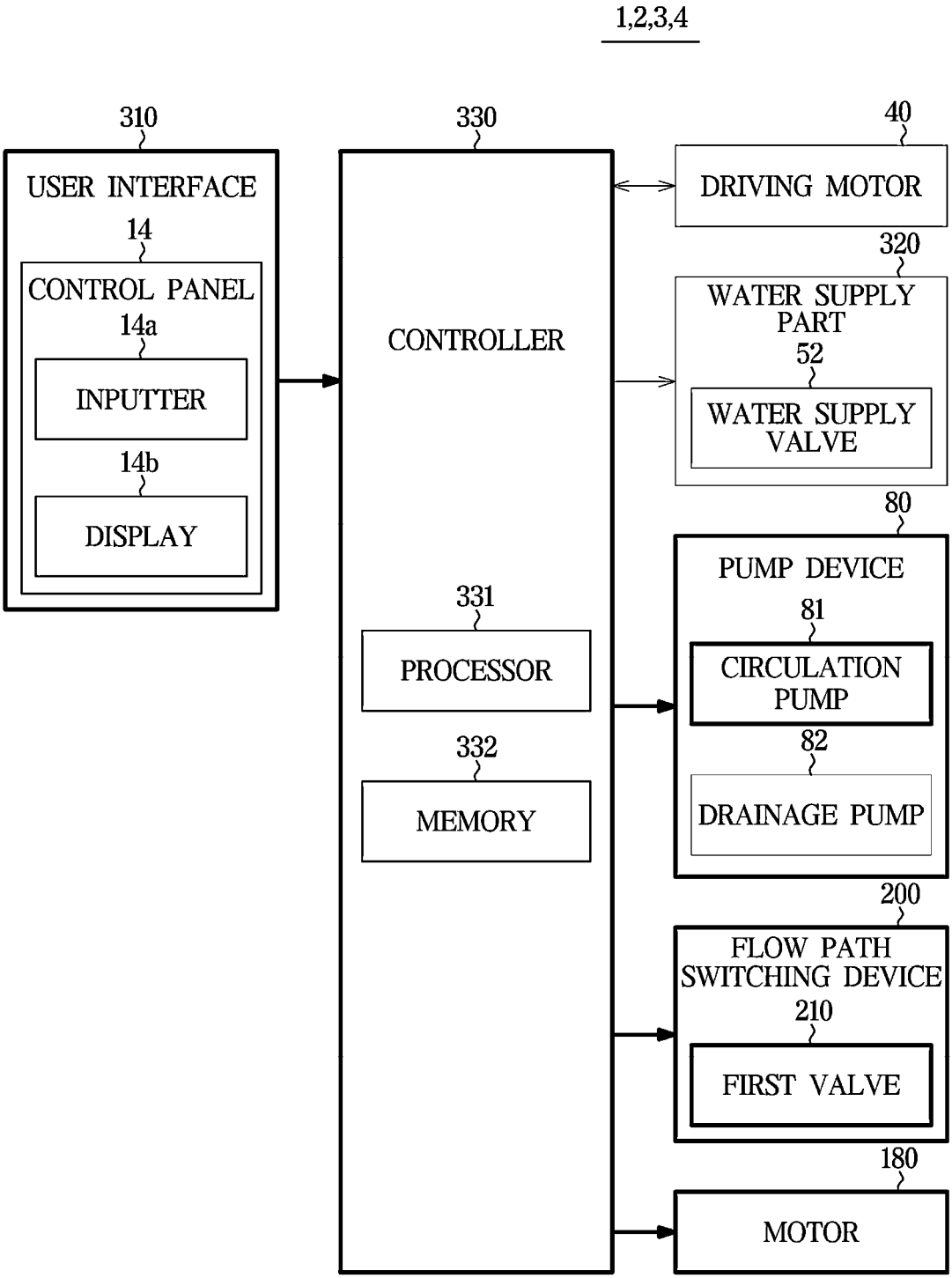
FIG. 36 illustrates an example of a control block diagram and a signal flow of the washing machine according to one embodiment.
Figure 37:
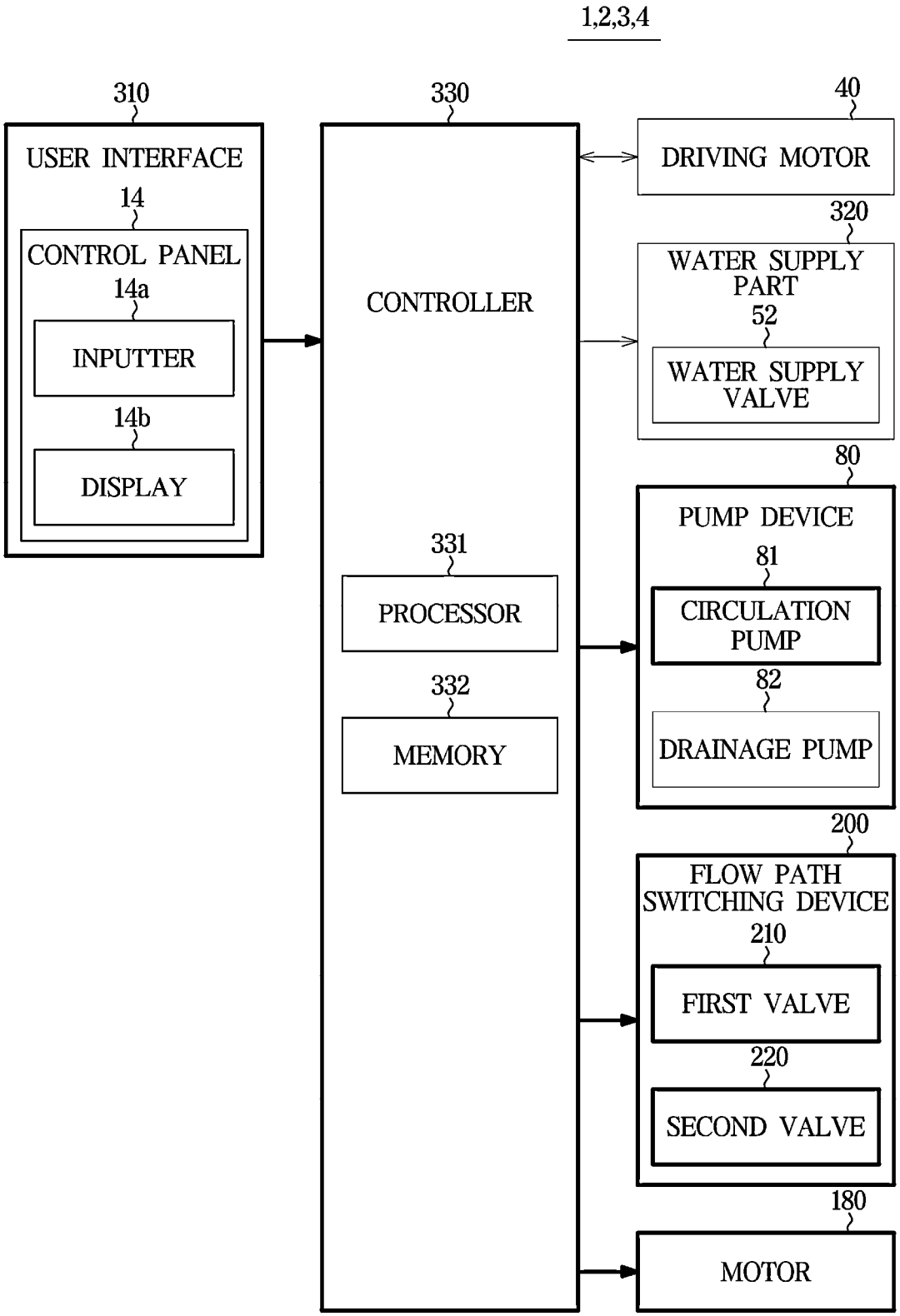
FIG. 37 illustrates an example of a control block diagram and a signal flow of the washing machine according to one embodiment.
Figure 38:
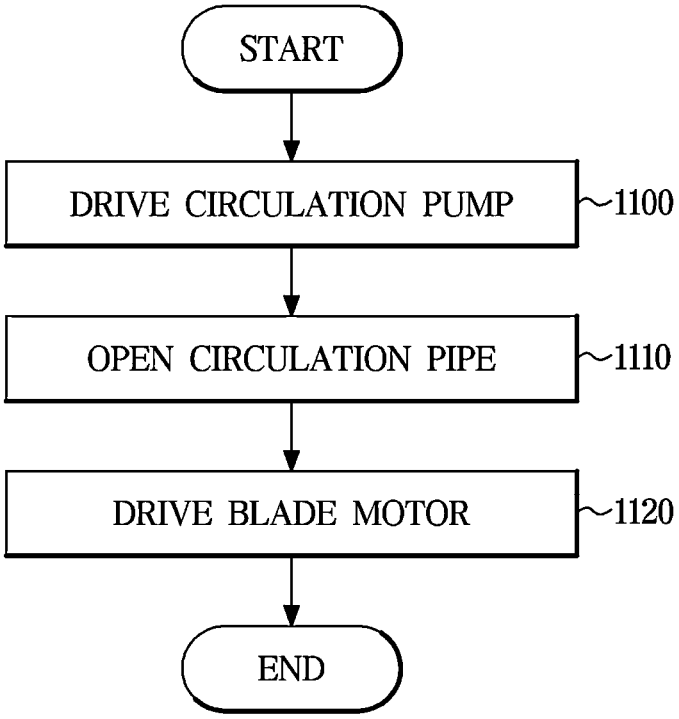
FIG. 38 is a flowchart illustrating a control method of the washing machine according to one embodiment when a driving condition of a circulation pump is satisfied.

FIG. 36 illustrates an example of a control block diagram and a signal flow of the washing machine according to one embodiment. FIG. 37 illustrates an example of a control block diagram and a signal flow of the washing machine according to one embodiment. FIG. 38 is a flowchart illustrating a control method of the washing machine according to one embodiment when a driving condition of a circulation pump is satisfied.

Referring to FIGS. 36 and 37, the controller 330 may control various components based on signals corresponding to user inputs received from the user interface 310.

The pump device 80 may include the circulation pump 81 and the drainage pump 82.

The controller 330 may output a control signal for driving the circulation pump 81 for the circulation operation. The circulation pump 81 may operate based on the control signal of the controller 330.

The controller 330 may output a control signal for driving the drainage pump 82 for the draining operation. The drainage pump 82 may operate based on the control signal of the controller 330.

The controller 330 may output a control signal for driving the motor 180 in order to rotate the blade 140. The motor 180 may operate based on the control signal of the controller 330.

Referring to FIG. 36, the flow path switching device 200 may include the first valve 210.

The controller 330 may output a control signal for opening or closing the first valve 210. The first valve 210 may be opened or closed based on the control signal of the controller 330.

Referring to FIG. 37, the flow path switching device 200 may include the first valve 210 and the second valve 220.

The controller 330 may output a control signal for opening or closing the first valve 210 and the second valve 220. The first valve 210 and the second valve 220 may be opened or closed based on the control signal of the controller 330.

According to various embodiments, the controller 330 may operate the circulation pump 81 and control the first valve 210 to open the circulation pipe 71.

Also, the controller 330 may operate the circulation pump 81, control the first valve 210 to open the circulation pipe 71, and control the second valve 220 to close the drain pipe 72.

According to various embodiments, the controller 330 may operate the circulation pump 81 and drive the motor 180.

The circulation operation may be executed in the washing process (1010) and/or the rinsing process (1020).

Referring to FIG. 38, for the circulation operation, the controller 330 may drive the circulation pump 81 (1100).

The controller 330 may control the flow path switching device 200 to open the circulation pipe 71 based on the operation of the circulation pump 81 (1110).

According to various embodiments, the operation of opening the circulation pipe 71 (1110) may further include closing the drain pipe 72.

That is, the controller 330 may control the flow path switching device 200 to open the circulation pipe 71 and close the drain pipe 72 based on the operation of the circulation pump 81.

In one embodiment, the controller 330 may drive the motor 180 based on the operation of the circulation pump 81 (1120). The blade 140 may rotate by receiving a driving current from the motor 180.

That is, when water is introduced into a filter 110 by the circulation pump 81, the blade 140 may transfer foreign substances collected by the filter 110 to one side of the inside of the filter 110.

According to the present disclosure, the lifespan of the filter 110 may be improved by quickly transferring the foreign substances collected by the filter 110 during the circulation operation to one side of the inside of the filter 110.

Figure 39:
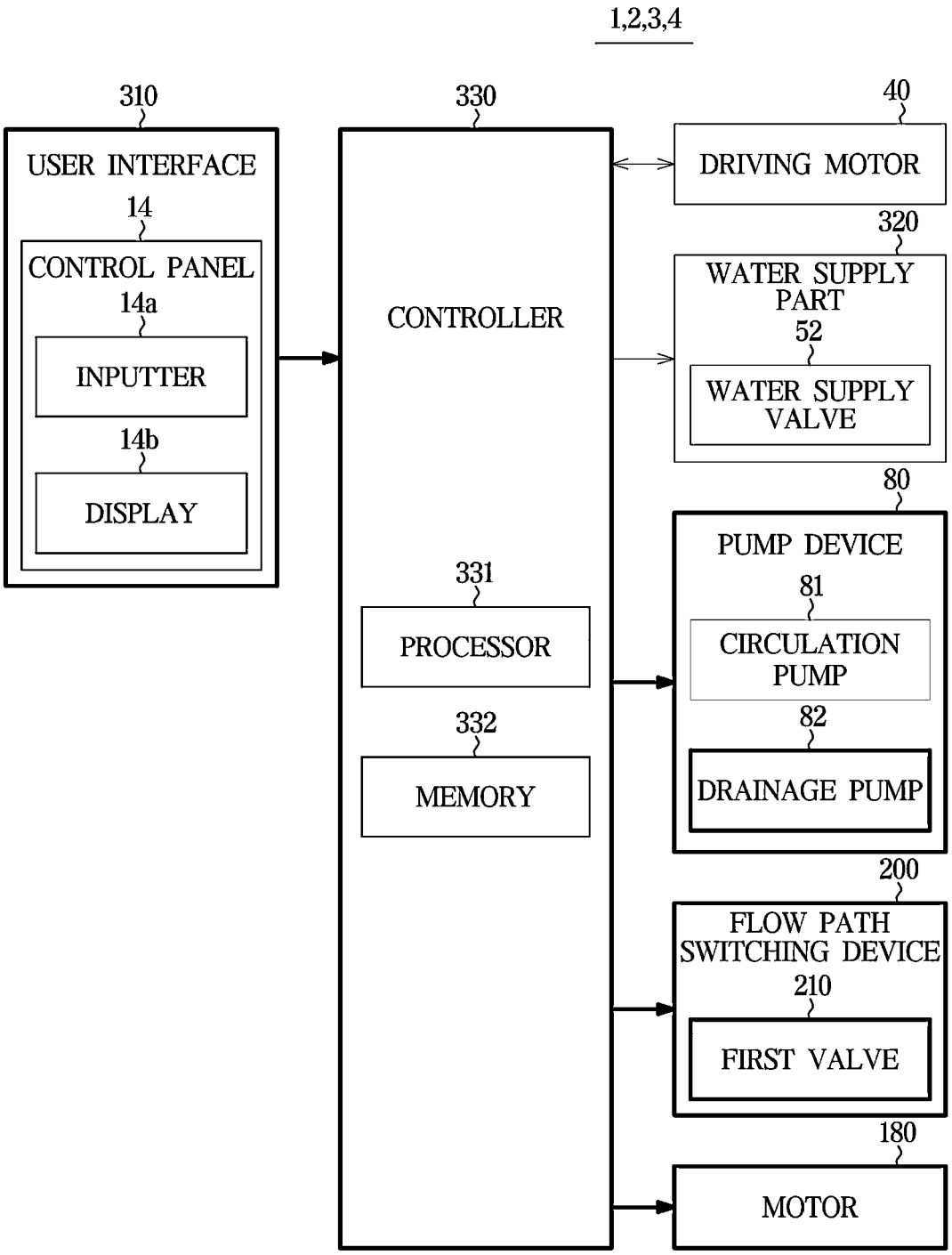
FIG. 39 illustrates an example of a control block diagram and a signal flow of the washing machine according to one embodiment.
Figure 40:
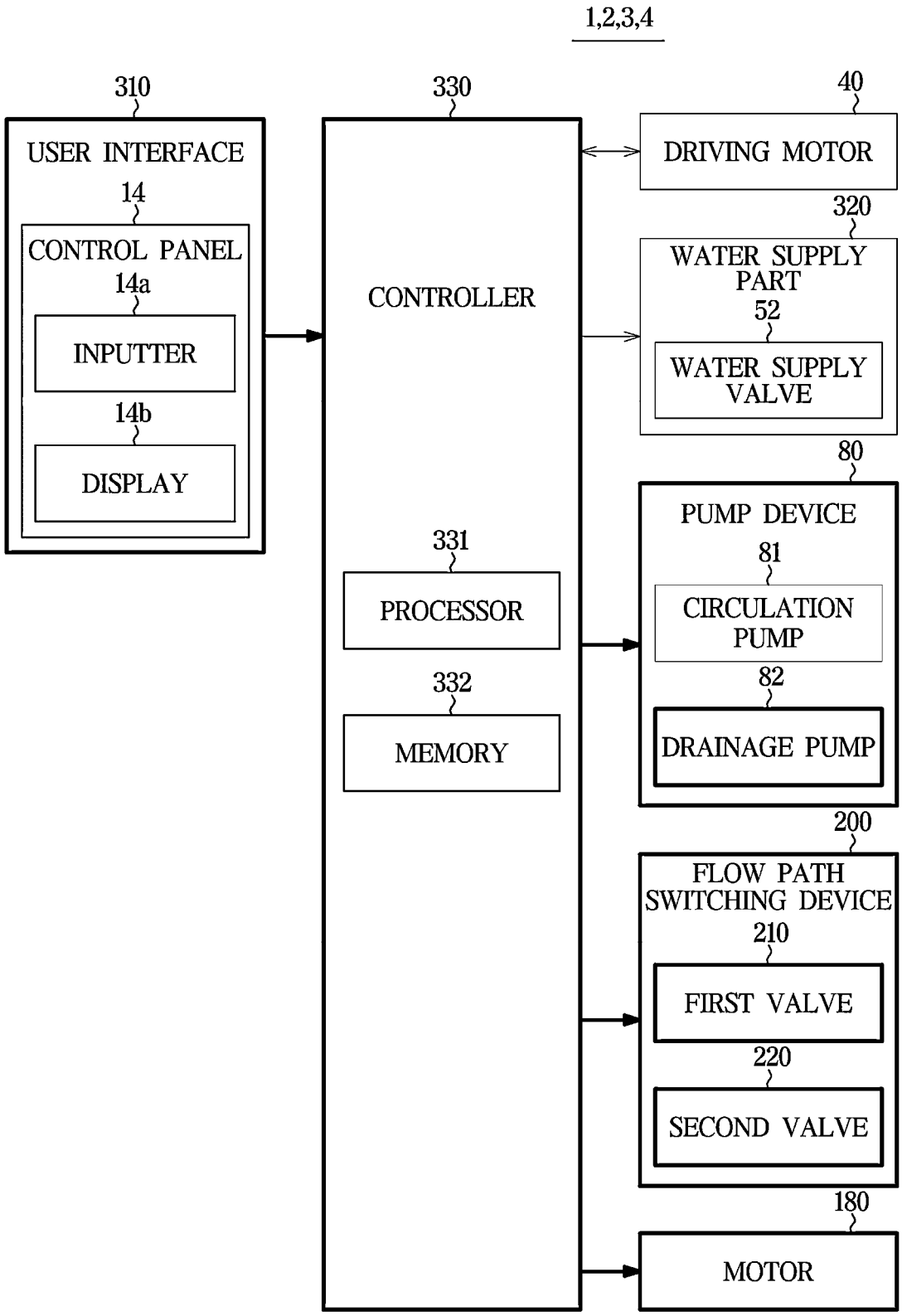
FIG. 40 illustrates an example of a control block diagram and a signal flow of the washing machine according to one embodiment.
Figure 41:
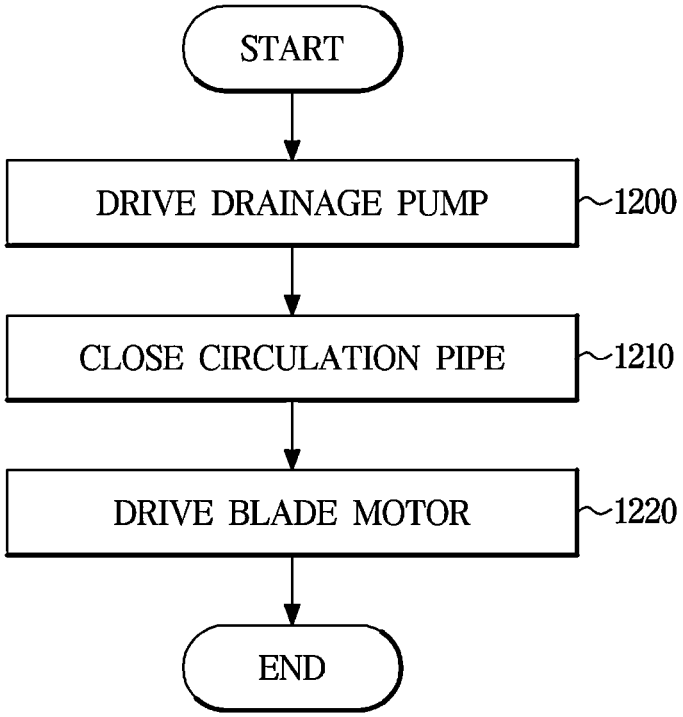
FIG. 41 is a flowchart illustrating a control method of the washing machine according to one embodiment when a driving condition of a drainage pump is satisfied.

FIG. 39 illustrates an example of a control block diagram and a signal flow of the washing machine according to one embodiment. FIG. 40 illustrates an example of a control block diagram and a signal flow of the washing machine according to one embodiment. FIG. 41 is a flowchart illustrating a control method of the washing machine according to one embodiment when a driving condition of a drainage pump is satisfied.

Referring to FIGS. 39 and 40, the controller 330 may control various components based on signals corresponding to user inputs received from the user interface 310.

The pump device 80 may include the circulation pump 81 and the drainage pump 82.

The controller 330 may output a control signal for driving the circulation pump 81 for the circulation operation. The circulation pump 81 may operate based on the control signal of the controller 330.

The controller 330 may output a control signal for driving the drainage pump 82 for the draining operation. The drainage pump 82 may operate based on the control signal of the controller 330.

The controller 330 may output a control signal for driving the motor 180 in order to rotate the blade 140. The motor 180 may operate based on the control signal of the controller 330.

Referring to FIG. 39, the flow path switching device 200 may include the first valve 210.

The controller 330 may output a control signal for opening or closing the first valve 210. The first valve 210 may be opened or closed based on the control signal of the controller 330.

Referring to FIG. 40, the flow path switching device 200 may include the first valve 210 and the second valve 220.

The controller 330 may output a control signal for opening or closing the first valve 210 and the second valve 220. The first valve 210 and the second valve 220 may be opened or closed based on the control signal of the controller 330.

According to various embodiments, the controller 330 may operate the drainage pump 82 and control the first valve 210 to close the circulation pipe 71.

Also, the controller 330 may operate the drainage pump 82, control the first valve 210 to close the circulation pipe 71, and control the second valve 220 to open the drain pipe 72.

According to various embodiments, the controller 330 may operate the drainage pump 82 and drive the motor 180.

The draining processes (1014 and 1023) may be executed in the washing process (1010) and/or the rinsing process (1020). According to various embodiments, the draining processes may also be executed in the dewatering process (1030).

Referring to FIG. 41, the controller 330 may drive the drainage pump 82 (1200) during the drain processes (1014 and 1023). For example, the controller 330 may drive the drainage pump 82 based on which the draining processes (1014 and 1023) have started.

The controller 330 may control the flow path switching device 200 to close the circulation pipe 71 based on the operation of the drainage pump 82 (1210).

According to various embodiments, the operation of closing the circulation pipe 71 (1210) may further include opening the drain pipe 72.

That is, the controller 330 may control the flow path switching device 200 to close the circulation pipe 71 and open the drain pipe 72 based on the operation of the drainage pump 82.

In one embodiment, the controller 330 may drive the motor 180 based on the operation of the drainage pump 82 (1220). The blade 140 may rotate by receiving a driving current from the motor 180.

That is, when water is introduced into the filter 110 by the drainage pump 82, the blade 140 may transfer foreign substances collected by the filter 110 to one side of the inside of the filter 110.

According to the present disclosure, the lifespan of the filter 110 may be improved by quickly transferring the foreign substances collected by the filter 110 during the draining processes (1014 and 1023) to one side of the inside of the filter 110.

Figure 42:
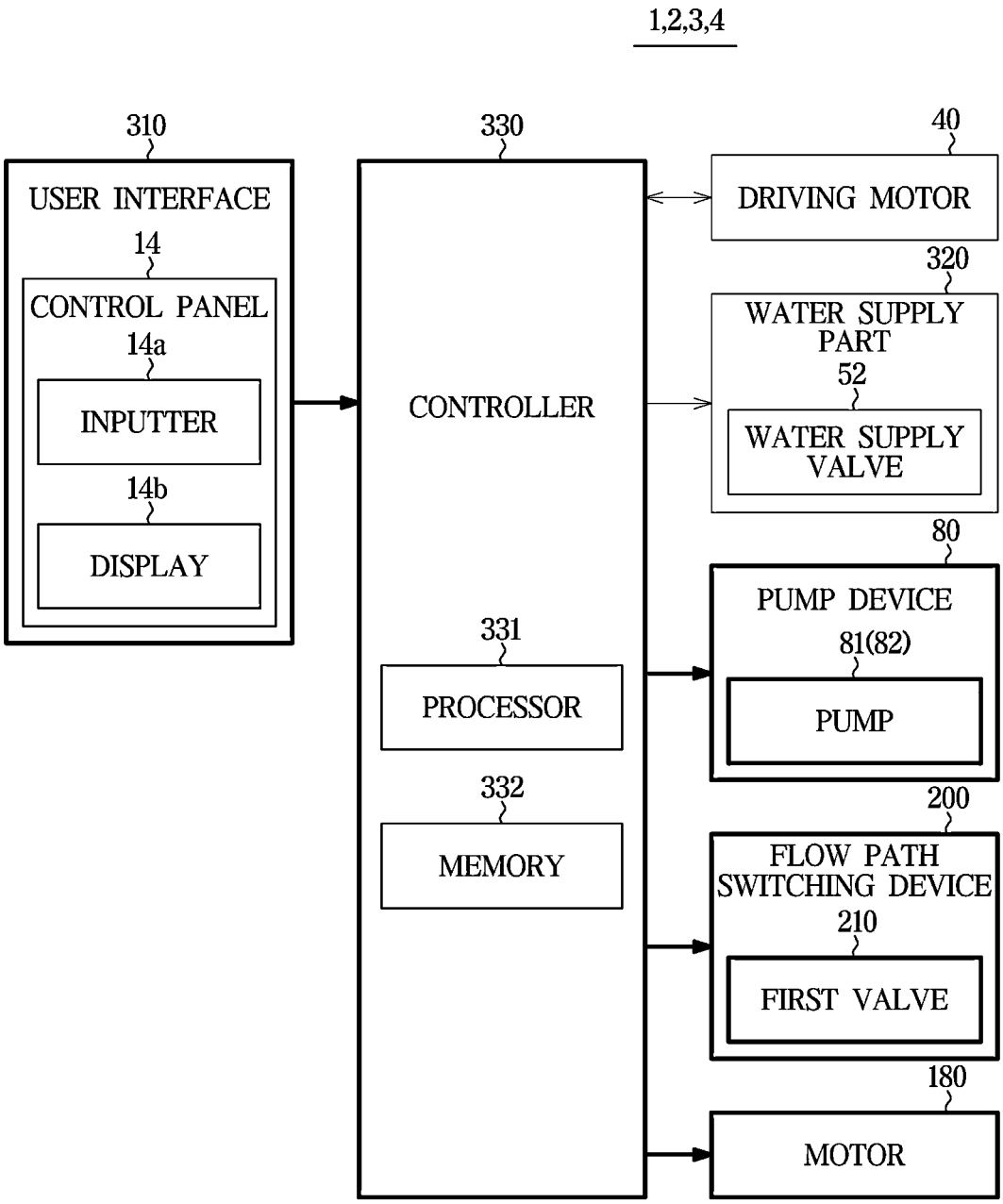
FIG. 42 illustrates an example of a control block diagram and a signal flow of the washing machine according to one embodiment.
Figure 43:
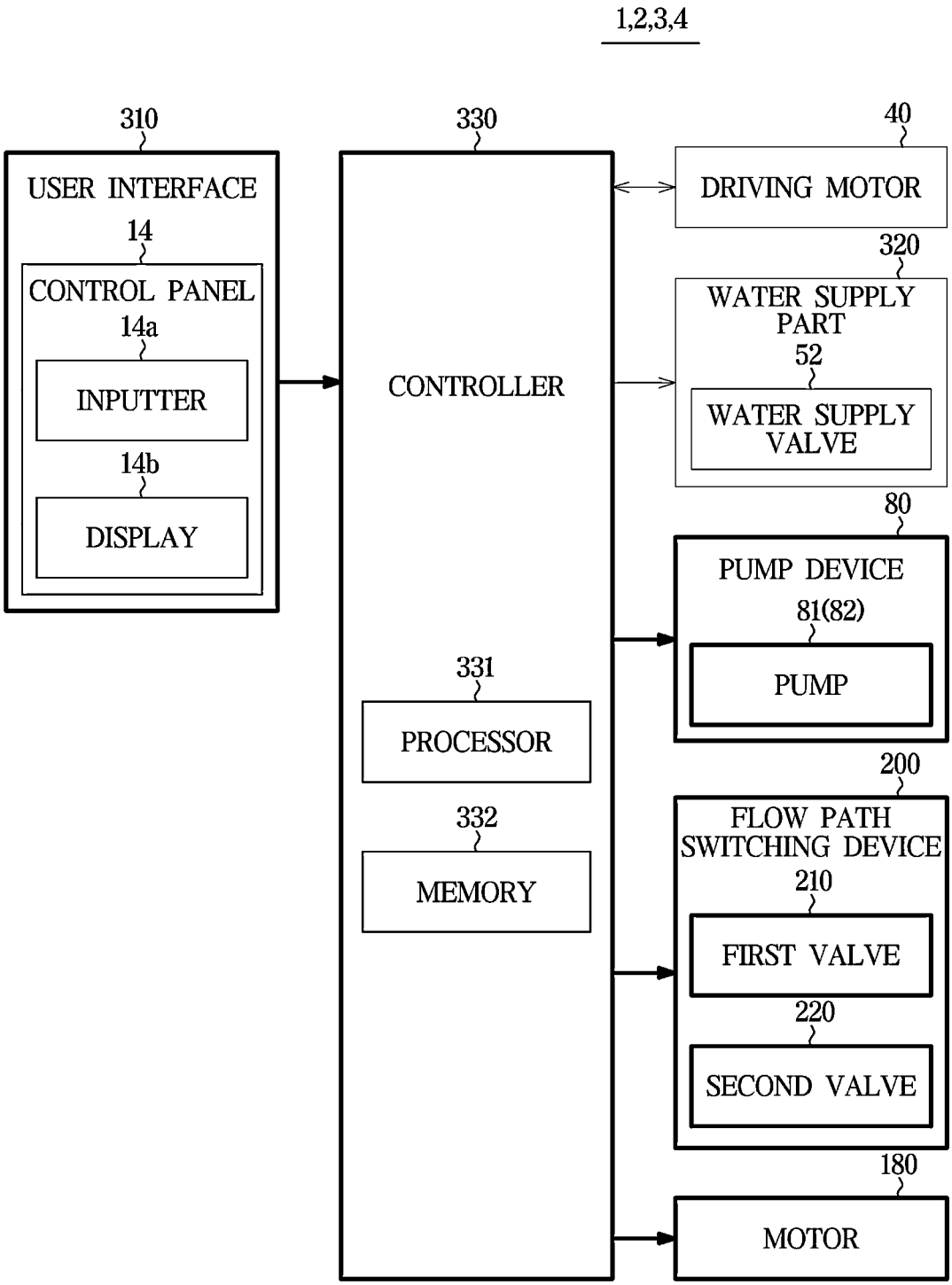
FIG. 43 illustrates an example of a control block diagram and a signal flow of the washing machine according to one embodiment.
Figure 44:
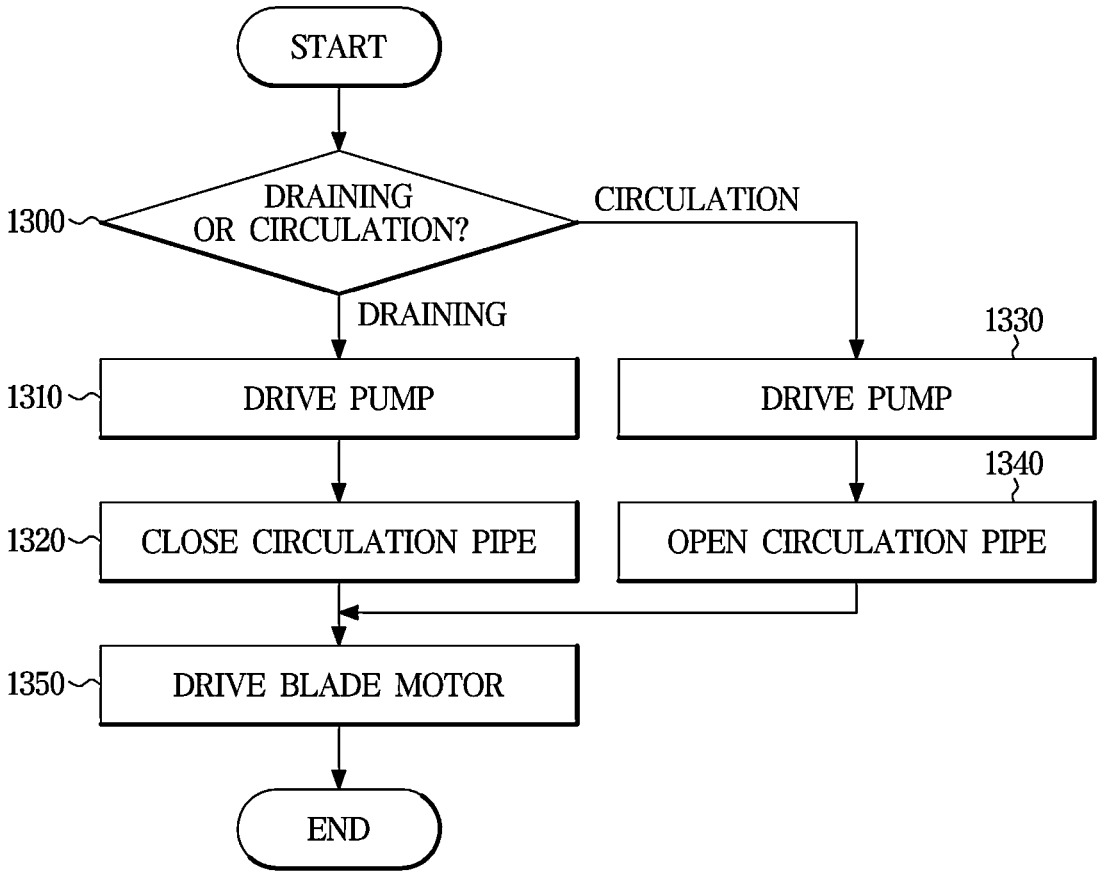
FIG. 44 is a flowchart illustrating a control method of the washing machine according to one embodiment when a driving condition of the circulation pump or the drainage pump is satisfied.

FIG. 42 illustrates an example of a control block diagram and a signal flow of the washing machine according to one embodiment. FIG. 43 illustrates an example of a control block diagram and a signal flow of the washing machine according to one embodiment. FIG. 44 is a flowchart illustrating a control method of the washing machine according to one embodiment when a driving condition of the circulation pump or the drainage pump is satisfied.

Referring to FIGS. 42 and 43, the controller 330 may control various components based on signals corresponding to user inputs received from the user interface 310.

The pump device 80 may include the pump 81 or 82.

The controller 330 may output a control signal for driving the pump 81 or 82 for the circulation operation and the draining operation. The pump 81 or 82 may operate based on the control signal of the controller 330.

The controller 330 may output a control signal for driving the motor 180 in order to rotate the blade 140. The motor 180 may operate based on the control signal of the controller 330.

Referring to FIG. 42, the flow path switching device 200 may include the first valve 210.

The controller 330 may output a control signal for opening or closing the first valve 210. The first valve 210 may be opened or closed based on the control signal of the controller 330.

Referring to FIG. 43, the flow path switching device 200 may include the first valve 210 and the second valve 220.

The controller 330 may output a control signal for opening or closing the first valve 210 and the second valve 220. The first valve 210 and the second valve 220 may be opened or closed based on the control signal of the controller 330.

According to various embodiments, the controller 330 may operate the pump 81 or 82 and control the first valve 210 to close the circulation pipe 71.

Also, the controller 330 may operate the pump 81 or 82, control the first valve 210 to close the circulation pipe 71, and control the second valve 220 to open the drain pipe 72.

According to various embodiments, the controller 330 may operate the pump 81 or 82 and drive the motor 180.

Referring to FIG. 44, the controller 330 may drive the pump 81 or 82 (1310) based on which the draining processes (1014 and 1023) have started (draining in 1300).

As described above, the controller 330 may control the flow path switching device 200 to close the circulation pipe 71 (1320) based on the operation of the pump 81 or 82 in the draining processes (1014 and 1023).

The controlling of the flow path switching device 200 to close the circulation pipe 71 may include opening the drain pipe 72.

Also, the controller 330 may drive the pump 81 or 82 (1330) based on which the circulation operation has started (circulation in 1300).

As described above, the controller 330 may control the flow path switching device 200 to open the circulation pipe 71 based on the operation of the pump 81 or 82 during the circulation operation (1340).

The controlling of the flow path switching device 200 to open the circulation pipe 71 may include closing the drain pipe 72.

The controller 330 may drive the motor 180 based on the operation of the pump 81 or 82 (1350).

For example, the controller 330 may drive the motor 180 based on the operation of the pump 81 or 82 during the draining processes (1014 and 1023).

As another example, the controller 330 may drive the motor 180 based on the operation of the pump 81 or 82 during the circulation operation.

According to the present disclosure, the lifespan of the filter 110 may be improved by quickly transferring the foreign substances collected by the filter 110 during the draining processes and/or the circulation operation to one side of the inside of the filter 110.

Figure 45:
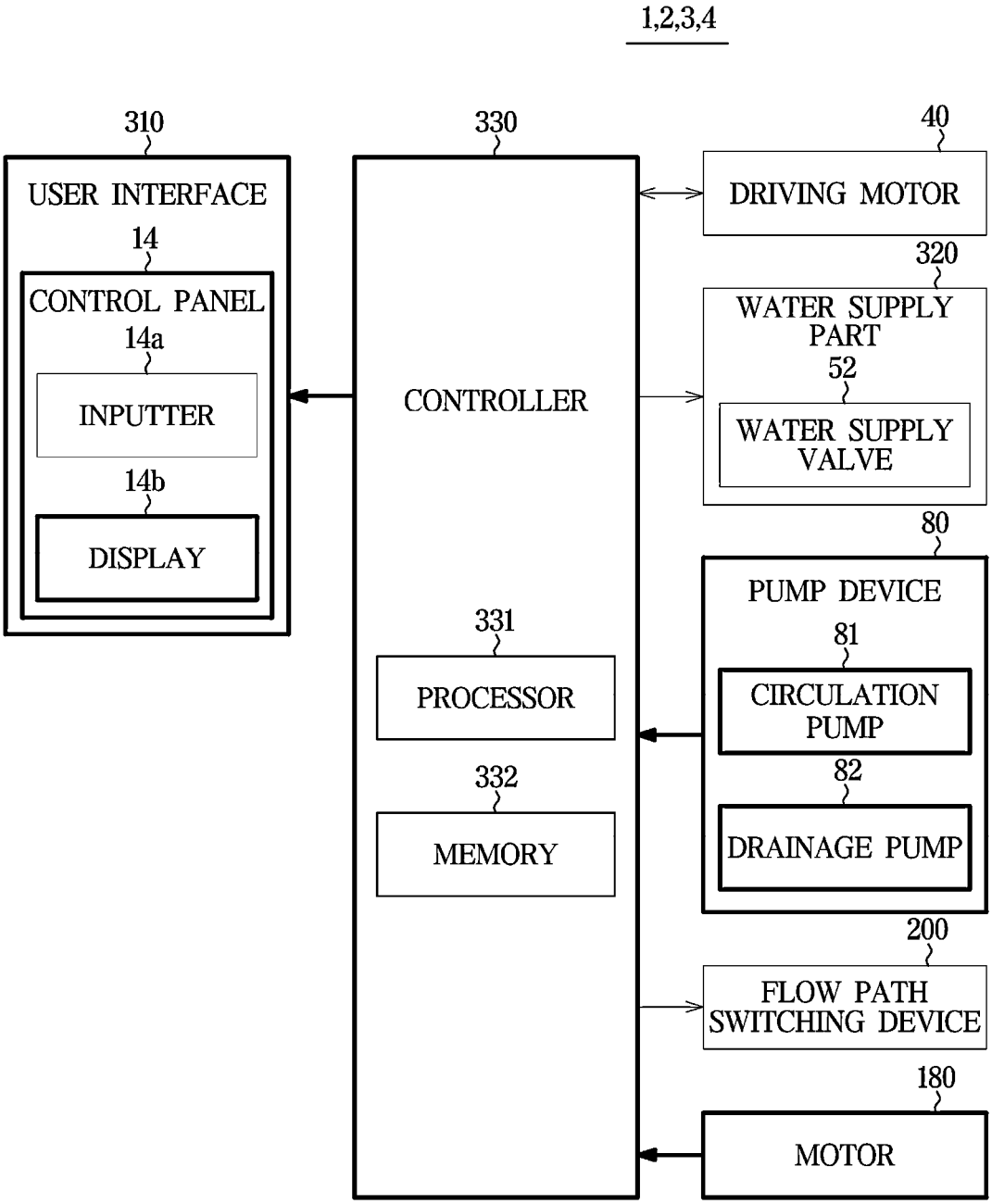
FIG. 45 illustrates an example of a control block diagram and a signal flow of the washing machine according to one embodiment.

FIG. 45 illustrates an example of a control block diagram and a signal flow of the washing machine according to one embodiment.

Figure 46:
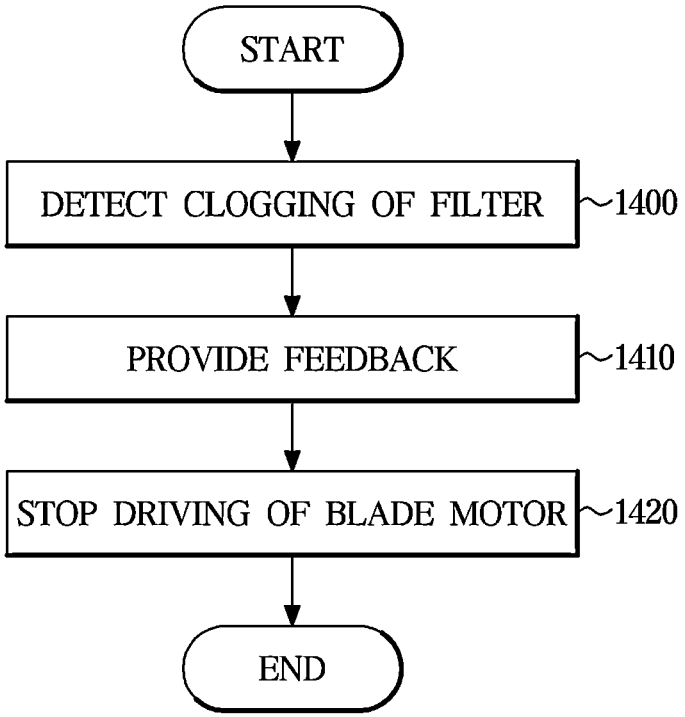
FIG. 46 is a flowchart illustrating a control method of the washing machine according to one embodiment when a clogging of the filter is detected.

FIG. 46 is a flowchart illustrating a control method of the washing machine according to one embodiment when a clogging of the filter is detected.

Referring to FIG. 45, the controller 330 may receive feedback signals from various components.

In one embodiment, the driving circuit included in the pump device 80 may sense values related to a load of the circulation pump 81 and/or the drainage pump 82. For example, the values related to the load of the circulation pump 81 and/or the drainage pump 82 may include a driving current value, a power consumption value, and/or a rotational speed value of the circulation pump 81 and/or the drainage pump 82.

The controller 330 may receive a sensing signal related to a load of the pump device 80 from the pump device 80.

In one embodiment, the driving circuit for driving the motor 180 may sense values related to the load of the motor 180. For example, the values related to the load of the motor 180 may include a driving current value, a power consumption value, and/or a rotational speed value of the motor 180.

The controller 330 may receive a sensing signal related to the load of the motor 180 from the driving circuit of the motor 180.

The controller 330 may detect clogging of the filter 110 based on sensing signals received from various components.

The controller 330 may output a control signal for controlling the display 14*b*.

The controller 330 may control the display 14*b* to notify the clogging of the filter 110.

Referring to FIG. 46, the controller 330 may detect the clogging of the filter 110 (1400). A state in which the filter 110 is clogged may be a predetermined state in which the filter 110 may not efficiently collect foreign substances.

According to various embodiments, the controller 330 may detect the load of the circulation pump 81 while operating the circulation pump 81, and may detect the clogging of the filter 110 based on a load value of the circulation pump 81. For example, the controller 330 may detect the clogging of the filter 110 based on the load value of the circulation pump 81 being kept in a state of exceeding a preset value for a preset period of time.

To this end, washing machines 1, 2, 3, and 4 may include a current sensor (not shown) for detecting a driving current applied to the circulation pump 81, a power sensor (not shown) for detecting power applied to the circulation pump 81, and/or a speed sensor (not shown) for detecting a rotational speed of the circulation pump 81.

The controller 330 may obtain the load value of the circulation pump 81 based on sensor data obtained from the current sensor (not shown) for detecting the driving current applied to the circulation pump 81, the power sensor (not shown) for detecting the power applied to the circulation pump 81, and/or the speed sensor (not shown) for detecting the rotational speed of the circulation pump 81 while operating the circulation pump 81.

According to various embodiments, the controller 330 may detect a load of the drainage pump 82 while operating the drainage pump 82 and detect the clogging of the filter 110 based on a load value of the drainage pump 82. For example, the controller 330 may detect the clogging of the filter 110 based on the load value of the drainage pump 82 being kept in a state of exceeding a preset value for a preset period of time.

To this end, the washing machines 1, 2, 3, and 4 may include a current sensor (not shown) for detecting a driving current applied to the drainage pump 82, a power sensor (not shown) for detecting power applied to the drainage pump 82, and/or a speed sensor (not shown) for detecting a rotational speed of the drainage pump 82.

The controller 330 may obtain the load value of the drainage pump 82 based on sensor data obtained from the current sensor (not shown) for detecting the driving current applied to the drainage pump 82, the power sensor (not shown) for detecting the power applied to the drainage pump 82, and/or the speed sensor (not shown) for detecting the rotational speed of the drainage pump 82 while operating the drainage pump 82.

According to various embodiments, the controller 330 may detect a load of the motor 180 while operating the motor 180 and detect the clogging of the filter 110 based on a load value of the motor 180. For example, the controller 330 may detect the clogging of the filter 110 based on the load value of the motor 180 being kept in a state of exceeding a preset value for a preset period of time.

The controller 330 may control the user interface 310 to provide feedback notifying the clogging of the filter 110 based on the clogging of the filter 110 being detected (1410).

In one embodiment, the controller 330 may control the display 14*b* to output visual feedback indicating the clogging of the filter 110. The visual feedback indicating the clogging of the filter 110 may include various visual indicators such as text, shapes, symbols, icons, images, and/or animation.

In one embodiment, in a case in which the user interface 310 includes a speaker, the controller 330 may control the speaker to output auditory feedback indicating the clogging of the filter 110. The auditory feedback indicating clogging of filter 110 may include a variety of sounds, such as beeps, voices, etc.

In a case in which the motor 180 is continuously driven when the clogging of the filter 110 is detected, not only there is a risk of failure of the motor 180, but also foreign substances in the filter 110 may no longer be transferred to one side.

The controller 330 may stop the driving of the motor 180 based on the clogging of the filter 110 being detected (1420).

According to the present disclosure, when the clogging of the filter 110 is detected, the operation of the motor 180 may be stopped, thereby preventing the occurrence of a failure of the motor 180 in advance.

The foregoing has illustrated and described specific embodiments. However, it should be understood by those of skilled in the art that the present disclosure is not limited to the above-described embodiments, and various changes and modifications may be made without departing from the technical idea of the present disclosure.

The invention claimed is:

1. A washing machine comprising:

a housing;

a tub inside the housing;

a drawer case in the housing and including an inlet portion through which washing water is flowable into the drawer case and an outlet portion through which the washing water is flowable out of the drawer case;

a drawer insertable into, and withdrawable from, the drawer case, and configured to receive a detergent to be supplied to the tub;

a filter detachably mountable in the drawer and configured so that, with the filter mounted in the drawer and the drawer inserted into the drawer case, the washing water that flows into the drawer case through the inlet portion passes through the filter so as to be filtered by the filter and then flows out of the drawer case through the outlet portion;

a circulation pipe to guide, to the tub, washing water that flows out of the drawer case through the outlet portion;

a drain pipe to guide, to an outside of the housing, washing water that flows out of the drawer case through the outlet portion; and a flow path switching device configured to flow the washing water that flows out of the drawer case through the outlet portion into at least one of the circulation pipe and the drain pipe.

2. The washing machine according to claim 1, further comprising a pump device to pump washing water from the tub to the inlet portion of the drawer case.

3. The washing machine according to claim 1, wherein with the filter mounted in the drawer, the filter is insertable into, and withdrawable from, the drawer case.

4. The washing machine according to claim 3, wherein the drawer includes:

a detergent receiving portion configured to receive the detergent, and a filter mounting portion configured so that the filter is detachably mountable therein, and that is arranged to be parallel to the detergent receiving portion.

5. The washing machine according to claim 1, wherein the filter includes:

a first filter port to allow washing water that is filtered by the filter to flow out of the filter toward the circulation pipe, and a second filter port to allow washing water that is filtered by the filter to flow out toward the drain pipe.

6. The washing machine according to claim 5, wherein the flow path switching device includes a valve configured to open and close the first filter port, and the washing machine further includes a controller configured to control the valve to close the first filter port in a draining process.

7. The washing machine according to claim 6, wherein the valve is a first valve, the flow path switching device further includes a second valve configured to open and close the second filter port, and the controller is configured to control the second valve to open the second filter port in the draining process.

8. The washing machine according to claim 1, wherein the circulation pipe is positioned lower than the drain pipe, the flow path switching device includes a valve configured to open and close the circulation pipe, and the washing machine further includes a controller configured to control the valve to close the circulation pipe in a draining process.

9. The washing machine according to claim 1, wherein the flow path switching device includes:

a first valve configured to open and close the circulation pipe; and a second valve configured to open and close the drain pipe, and the washing machine further includes a controller configured to control, in a draining process, the first valve to close the circulation pipe, and the second valve to open the drain pipe.

10. The washing machine according to claim 1, further comprising a main pipe extending from the outlet portion, wherein the circulation pipe and the drain pipe are branched from the main pipe at a branch point, and the flow path switching device is at the branch point.

11. The washing machine according to claim 1, wherein the drawer includes:

a first detergent receiving portion configured to receive a first detergent to be supplied to the tub in a washing process, a second detergent receiving portion configured to receive a second detergent to be supplied to the tub in a rinsing process, and a filter mounting portion configured so that the filter is detachably mountable therein, and that is between the first detergent receiving portion and the second detergent receiving portion.

12. The washing machine according to claim 1, wherein the filter forms a collection space therein, and the collection space is configured to collect foreign substances contained in the washing water as the washing water passes through the filter from an inside of the filter to an outside of the filter.

13. The washing machine according to claim 1, wherein the washing water that passes through the filter flows between the drawer and the drawer case and then flows out of the drawer case through the outlet portion.

14. The washing machine according to claim 13, wherein the drawer case is inclined downward toward the outlet portion to guide the washing water that flows between the drawer and the drawer case to the outlet portion.

15. The washing machine according to claim 1, wherein the drawer further includes a detergent receiving portion configured to receive the detergent, and the washing machine further includes a detergent pump at a rear of the drawer case and that is configured to pump the detergent received in the detergent receiving portion to the drawer case.

* * * * *